US009827776B2

(12) United States Patent
Nakamura et al.

(10) Patent No.: US 9,827,776 B2
(45) Date of Patent: Nov. 28, 2017

(54) METHOD AND APPARATUS FOR MANUFACTURING CARTRIDGE

(71) Applicant: SEIKO EPSON CORPORATION, Tokyo (JP)

(72) Inventors: Hiroyuki Nakamura, Nagano (JP); Tadahiro Mizutani, Nagano (JP); Izumi Nozawa, Nagano (JP); Atsushi Kobayashi, Nagano (JP); Hidetoshi Kodama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 159 days.

(21) Appl. No.: 13/940,958

(22) Filed: Jul. 12, 2013

(65) Prior Publication Data

US 2014/0060692 A1 Mar. 6, 2014

(30) Foreign Application Priority Data

| | | |
|---|---|---|
| Jul. 23, 2012 | (JP) | 2012-162233 |
| Jul. 23, 2012 | (JP) | 2012-162701 |
| Jul. 23, 2012 | (JP) | 2012-162705 |
| Aug. 31, 2012 | (JP) | 2012-190744 |
| Aug. 31, 2012 | (JP) | 2012-191386 |
| Jan. 23, 2013 | (JP) | 2013-009917 |
| Jan. 23, 2013 | (JP) | 2013-009918 |
| Jun. 28, 2013 | (JP) | 2013-136043 |
| Jun. 28, 2013 | (JP) | 2013-136044 |

(51) Int. Cl.
*B41J 2/175* (2006.01)

(52) U.S. Cl.
CPC ..... *B41J 2/17559* (2013.01)

(58) Field of Classification Search
CPC ..... B41J 2/17559
USPC ..... 141/2
See application file for complete search history.

(56) References Cited

U.S. PATENT DOCUMENTS

| | | | |
|---|---|---|---|
| 5,825,388 | A | 10/1998 | Sasaki |
| 5,946,014 | A | 8/1999 | Shimomura et al. |
| 5,980,032 | A | 11/1999 | Pawlowski, Jr. et al. |
| 5,984,462 | A | 11/1999 | DeFilippis |

(Continued)

FOREIGN PATENT DOCUMENTS

| | | |
|---|---|---|
| EP | 0418828 A1 | 3/1991 |
| EP | 0655336 A1 | 5/1995 |

(Continued)

OTHER PUBLICATIONS

Extended European Search Report for the related European Patent Application No. 13177574.4 dated Jan. 25, 2016.

*Primary Examiner* — Jason K Niesz
*Assistant Examiner* — James Hakomaki
(74) *Attorney, Agent, or Firm* — Global IP Counselors, LLP

(57) ABSTRACT

A cartridge manufacturing method is a method for manufacturing a cartridge having a case, a chamber adapted to be filled with printing material, a supply port that leads the printing material inside the chamber to outside the case, a flexible sheet member that constitutes at least a portion of the chamber, and a biasing member that biases the sheet member in the direction that expands the capacity of the chamber. a filling port that communicates with the inside of the chamber is formed in the case, and the filling port is closed after the printing material is filled from the filling port to inside the chamber.

28 Claims, 44 Drawing Sheets

(56) References Cited

U.S. PATENT DOCUMENTS 6,007,191 A 12/1999 Fujii et al.
6,086,193 A 7/2000 Shimada et al.
6,145,974 A 11/2000 Shinada et al.
6,152,555 A 11/2000 Nozawa et al.
6,155,678 A 12/2000 Komplin et al.
6,158,852 A 12/2000 Sato et al.
6,196,671 B1 3/2001 Breemes, Sr. et al.
6,203,148 B1 3/2001 Kishida
6,220,701 B1 4/2001 Umemura
6,250,750 B1 6/2001 Miyazawa et al.
6,254,226 B1 7/2001 Lengyel et al.
6,290,348 B1 9/2001 Becker et al.
6,328,437 B1 12/2001 Mihara et al.
6,332,481 B1 * 12/2001 Shinada et al. ..... 141/18
6,364,473 B1 4/2002 Liu
6,390,613 B1 5/2002 Liu
6,474,796 B1 11/2002 Ishinaga
6,585,007 B2 7/2003 Kubokawa
6,623,104 B1 9/2003 Kotaki et al.
6,634,742 B2 10/2003 Owaki et al.
6,773,099 B2 * 8/2004 Inoue ..... B41J 2/17503 347/86
6,776,479 B2 8/2004 Ardito et al.
6,824,258 B2 11/2004 Yamamoto et al.
6,830,324 B2 * 12/2004 Ogura ..... B41J 2/17506 347/86
6,848,776 B2 2/2005 Nishioka et al.
6,854,835 B2 * 2/2005 Kobayashi ..... B41J 2/17513 347/85
6,976,753 B2 12/2005 Kuwabara et al.
7,104,640 B2 * 9/2006 Ogura ..... B41J 2/17513 347/86
7,165,835 B2 * 1/2007 Ota et al. ..... 347/86
7,237,881 B2 7/2007 Hayasaki et al.
7,293,866 B2 11/2007 Miyazawa et al.
7,325,909 B2 2/2008 Yuen
7,393,088 B2 7/2008 Sasaki
7,445,323 B2 11/2008 Anderson, Jr. et al.
7,470,008 B2 12/2008 Yan
7,735,983 B2 6/2010 Pearson et al.
7,918,547 B2 4/2011 Hatasa et al.
7,938,523 B2 5/2011 Aldrich
7,954,662 B2 * 6/2011 Ogura ..... B41J 2/17513 220/4.12
8,142,000 B2 3/2012 Ishizawa et al.
8,177,342 B2 5/2012 Wanibe et al.
8,366,250 B2 2/2013 Wanibe et al.
8,366,251 B2 2/2013 Wanibe et al.
8,382,263 B2 2/2013 Okajima
8,684,505 B2 4/2014 Campbell-Brown et al.
9,050,813 B2 6/2015 Qing et al.
9,308,753 B2 4/2016 Nakano
2001/0009431 A1 7/2001 Kobayashi et al.
2001/0050113 A1 12/2001 Shinada et al.
2001/0052370 A1 12/2001 Shinada et al.
2002/0104578 A1 8/2002 Kubokawa
2002/0139441 A1 10/2002 Schonfelder et al.
2002/0175977 A1 11/2002 Hanson et al.
2003/0090553 A1 * 5/2003 Jung et al. ..... 347/86
2004/0100540 A1 5/2004 Hatasa et al.
2005/0041076 A1 2/2005 Katayama
2005/0068386 A1 3/2005 Hatasa et al.
2005/0116997 A1 6/2005 Katoh et al.
2005/0179750 A1 8/2005 Hayasaki et al.
2005/0185034 A1 8/2005 Anma et al.
2005/0219303 A1 10/2005 Matsumoto et al.
2005/0275699 A1 12/2005 Sasaki
2006/0132555 A1 * 6/2006 Uehara et al. ..... 347/85
2006/0203045 A1 9/2006 Kobayashi et al.
2006/0203051 A1 9/2006 Kanbe
2006/0227190 A1 10/2006 Ishizawa et al.
2007/0024683 A1 2/2007 Yan
2007/0139492 A1 6/2007 Anderson, Jr. et al.
2007/0195141 A1 8/2007 Anma et al.
2007/0195144 A1 8/2007 McNestry
2007/0229612 A1 10/2007 Oyanagi et al.
2007/0236549 A1 10/2007 Yamada
2008/0034712 A1 * 2/2008 Miyajima et al. ..... 53/473
2008/0204526 A1 8/2008 Pearson et al.
2008/0204529 A1 8/2008 Matsumoto et al.
2008/0230141 A1 9/2008 Hattori
2008/0231672 A1 9/2008 Mano
2008/0239037 A1 10/2008 Inoue et al.
2008/0284833 A1 * 11/2008 Uehara et al. ..... 347/86
2008/0309740 A1 12/2008 Aldrich
2009/0128609 A1 5/2009 Matsumoto et al.
2009/0167826 A1 7/2009 Ishizawa et al.
2009/0244221 A1 10/2009 Shimizu
2009/0322832 A1 12/2009 Wanibe et al.
2009/0322838 A1 12/2009 Wanibe et al.
2009/0322839 A1 12/2009 Ishizawa et al.
2010/0073438 A1 3/2010 Wanibe et al.
2010/0208015 A1 8/2010 Matsumoto et al.
2010/0277555 A1 11/2010 Katoh et al.
2010/0302291 A1 12/2010 Matsumoto et al.
2010/0309265 A1 12/2010 Matsumoto et al.
2010/0309266 A1 12/2010 Matsumoto et al.
2011/0037815 A1 2/2011 Anma et al.
2011/0169899 A1 7/2011 Nozawa et al.
2011/0241231 A1 10/2011 Mizutani et al.
2012/0056955 A1 3/2012 Kodama et al.
2012/0127247 A1 5/2012 Anma et al.
2012/0133713 A1 * 5/2012 Camp ..... 347/85
2013/0208044 A1 8/2013 Matsumoto et al.

FOREIGN PATENT DOCUMENTS

EP 0712727 A2 5/1996
EP 0739740 A1 10/1996
EP 0847861 A2 6/1998
EP 0947328 A2 10/1999
EP 1053881 A1 5/2000
EP 1095777 A2 10/2000
EP 1053876 A2 11/2000
EP 1080918 A1 3/2001
EP 1090767 A2 4/2001
EP 1170135 A1 1/2002
EP 1258361 A1 11/2002
EP 1707380 A2 10/2006
EP 2103435 A2 9/2009
EP 2127886 A1 12/2009
EP 2380744 A2 10/2011
EP 2425981 A2 3/2012
EP 2837499 A2 2/2015
GB 2288148 A 10/1995
JP 06-106729 A 4/1994
JP 08-112915 A 5/1996
JP 08-267775 A 10/1996
JP 10-044454 A 2/1998
JP 10-095129 A 4/1998
JP 10-175311 A 6/1998
JP 10-217500 A 8/1998
JP 10-250091 A 9/1998
JP 2000-203053 A 7/2000
JP 2001-063085 A 3/2001
JP 2001-162819 A 3/2001
JP 2001-130022 A 5/2001
JP 2002-036590 A 2/2002
JP 2002-505212 A 2/2002
JP 2002-120376 A 4/2002
JP 2002-225306 A 8/2002
JP 2002-370370 A 12/2002
JP 2003-237108 A 8/2003
JP 2004-230705 A 8/2004
JP 2005-103855 A 4/2005
JP 2005-170027 A 6/2005
JP 2005-205893 A 8/2005
JP 2005-349786 A 12/2005
JP 2006-248053 A 9/2006
JP 2006-281539 A 10/2006
JP 2006-306035 A 11/2006
JP 2007-055126 A 3/2007
JP 2007-112150 A 5/2007

(56) References Cited

FOREIGN PATENT DOCUMENTS

| | | | |
|---|---|---|---|
| JP | 2007-230188 | A | 9/2007 |
| JP | 2007-283753 | A | 11/2007 |
| JP | 2008-246896 | A | 10/2008 |
| JP | 2008-307881 | A | 12/2008 |
| JP | 2009-061785 | A | 3/2009 |
| JP | 2009-241608 | A | 10/2009 |
| JP | 2010-005957 | A | 1/2010 |
| JP | 2010-221477 | A | 10/2010 |
| JP | 2010-260202 | A | 11/2010 |
| JP | 3166084 | U | 1/2011 |
| JP | 2011-110712 | A | 6/2011 |
| JP | 2011-140189 | A | 7/2011 |
| JP | 2011-207066 | A | 10/2011 |
| JP | 2011-207067 | A | 10/2011 |
| JP | 2012-035489 | A | 2/2012 |
| JP | 2012-126100 | A | 7/2012 |
| JP | 2012-136039 | A | 7/2012 |
| WO | 98/55325 | A1 | 12/1998 |
| WO | 00/58100 | A1 | 10/2000 |
| WO | 2006/028082 | A1 | 3/2006 |
| WO | 2008/056736 | A1 | 5/2008 |

* cited by examiner

METHOD AND APPARATUS FOR MANUFACTURING CARTRIDGE

CROSS-REFERENCE TO RELATED APPLICATIONS

This application claims priority to Japanese Patent Application Nos. 2013-136043 and 2013-136044, filed on Jun. 28, 2013, Nos. 2013-009917 and 2013-009918, filed on Jan. 23, 2013, Nos. 2012-191386 and 2012-190744, filed on Aug. 31, 2002, and Nos. 2012-162701, 2012-162705, and 2012-162233, filed on Jul. 23, 2012. The entire disclosure of Japanese Patent Application Nos. 2013-136043, 2013-136044, 2013-009917, 2013-009918, 2012-191386, 2012-190744, 2012-162701, 2012-162705, and 2012-162233 are expressly incorporated by reference herein.

TECHNICAL FIELD

The present invention relates to a method for manufacturing a cartridge, to a cartridge manufacturing apparatus, and the like.

BACKGROUND ART

For cartridges adapted to be filled with printing material, for example, cartridges for supplying ink, which is one example of a printing material, to an inkjet printer, are known. With this kind of cartridge, in the past, items were known which had a case having a recess which is filled with ink, a sheet member for sealing the case recess, and a supply port for supplying the ink filled inside the recess to the inkjet printer. See, for example, Unexamined Patent Publication No. 2011-140189 and U.S. Patent Application Publication No. 2012/133713.

SUMMARY

There is a desire for provision of a method of filling printing material to the cartridge noted above which has a constitution for which the recess filled with the printing material is sealed by the sheet member. Also, this kind of demand is not limited to cartridges filled with ink, but is also common to cartridges filled with printing material other than ink.

The present invention was created to address at least a portion of the problems described above, and can be realized as the following modes and application examples.

A manufacturing method of a cartridge for a first application example, comprising a case, a chamber adapted to be filled with printing material, the chamber provided inside the case, a supply port that leads the printing material inside the chamber to outside the case, a flexible sheet member constituting at least a portion of the chamber, and a biasing member that biases the sheet member in the direction that expands the capacity of the chamber, the biasing member provided inside the case, wherein a filling port that communicates with the inside of the chamber is formed in the case or the sheet member, filling the printing material inside the chamber from the filling port, and the filling port is closed after filling the printing material inside the chamber from the filling port.

With the cartridge manufacturing method of this application example, it is possible to manufacture a recycled cartridge or new cartridge by filling printing material from the filling port opened on the case or the sheet member into a cartridge for which at least a portion of the chamber is constituted by a sheet member.

As the second application example, it is possible to use the manufacturing method of a cartridge according to the application example noted above, further comprising making an exhaust port that leads from the inside of the chamber to outside the chamber on the chamber before filling the printing material, wherein filling the printing material inside the chamber is performed in a state with the exhaust port opened.

With this application example, it is possible to fill printing material into the chamber while allowing air inside the chamber escape from the exhaust port. Because of this, it is easier to introduce printing material into the chamber, and it is possible to shorten the time it takes for filling.

As the third application example, it is possible to use the manufacturing method of a cartridge according to the application example noted above, further comprising exhausting at least a portion of the substance inside the chamber using the exhaust port before filling the printing material.

With this application example, it is possible to manufacture a higher quality cartridge.

As the fourth application example, it is possible to use the manufacturing method of a cartridge according to the application example noted above, wherein filling the printing material inside the chamber is performed in a state with the inside of the chamber in communication with the outside of the chamber, while opening the air introduction port by applying an external force on the valve section.

With this application example, it is possible to fill printing material into the chamber while allowing air inside the chamber to escape from the air introduction port. Because of this, introduction of the printing material into the chamber is easier, and it is possible to shorten the time taken for filling.

As the fifth application example, it is possible to use the manufacturing method of a cartridge according to the application example noted above, further comprising exhausting at least a portion of the substance inside the chamber using the air introduction port before filling the printing material.

With this application example, it is possible to manufacture a higher quality cartridge.

As the sixth application example, it is possible to use the manufacturing method of a cartridge according to the application example noted above, further comprising exhausting at least a portion of the substance inside the chamber using the supply port before filling the printing material.

With this application example, it is possible to manufacture a higher quality cartridge.

As the seventh application example, it is possible to use the manufacturing method of a cartridge according to the application example noted above, further comprising exhausting at least a portion of the substance inside the chamber using the filling port before filling the printing material.

With this application example, it is possible to manufacture a higher quality cartridge.

As the eighth application example, it is possible to use the manufacturing method of a cartridge according to the application example noted above, further comprising a step of removing at least a portion of the case.

As the ninth application example, it is possible to use the manufacturing method of a cartridge according to the application example noted above, wherein the step of removing at least a portion of the case is a step of removing a second case attached to a first case so as to cover the sheet member joined to the first case.

With these application examples, the interior of the chamber is exposed, and it is easier to visually recognize the interior. Thus, it is possible to efficiently implement cartridge manufacturing work, especially the filling of the printing material.

The manufacturing method of a cartridge of the tenth application example is a manufacturing method of a cartridge that has a case, a chamber adapted to be filled with printing material, the chamber provided inside the case, a supply port that leads the printing material inside the chamber to outside the case, the supply port leading from the inside of the chamber to the outside of the case, a sheet member having flexibility and constituting at least a portion of a wall of the chamber, a biasing member that biases the sheet member in the direction that expands the capacity of the chamber, the biasing member provided inside the case, an air introduction port through which air is introduced from outside the chamber to inside the chamber, and a valve section that opens and closes the air introduction port, comprising filling the printing material inside the chamber from the supply port in a state with the inside of the chamber in communication with the outside of the chamber while opening the air introduction port by applying an external force on the valve section.

With the cartridge manufacturing method of this application example, it is possible to manufacture a recycled cartridge or a new cartridge by filling printing material from the supply port into a cartridge for which at least a portion of the chamber is constituted by a sheet member. In fact, it is possible to fill the printing material inside the chamber while allowing air inside the chamber to escape from the air introduction port. Because of this, it is easier to introduce the printing material inside the chamber, and possible to shorten the time it takes for filling.

As the eleventh application example, it is possible to use the manufacturing method of a cartridge according to the application example noted above, further comprising exhausting at least a portion of the substance inside the chamber using the air introduction port before filling the printing material.

With this application example, it is possible to manufacture a higher quality cartridge.

As the twelfth application example, it is possible to use the manufacturing method of a cartridge according to the application example noted above, further comprising a step of removing at least a portion of the case.

Also, as the thirteenth application example, it is possible to use the manufacturing method of a cartridge according to the application example noted above, wherein the step of removing at least a portion of the case is a step of removing a second case attached to a first case so as to cover the sheet member joined to the first case.

With these application examples, the interior of the chamber is exposed, and it is easier to visually recognize the interior. Thus, it is possible to implement cartridge manufacturing work with good efficiency, especially the filling of the printing material.

The manufacturing method of a cartridge of the fourteenth application example is a manufacturing method of a cartridge that has a case, a chamber adapted to be filled with printing material, the chamber provided inside the case, a supply port that leads the printing material inside the chamber to outside the case, the supply port leading from the inside of the chamber to the outside of the case, a sheet member having flexibility and constituting at least a portion of a wall of the chamber, and a biasing member that biases the sheet member in the direction that expands the capacity of the chamber, the biasing member provided inside the case, comprising opening an exhaust port on the chamber, the exhaust port leading from the inside of the chamber to the outside of the chamber, filling the printing material inside the chamber from the supply port in a state with the exhaust port opening, and closing the exhaust port is after filling the printing material inside the chamber.

With the cartridge manufacturing method of this application example, it is possible to manufacture a recycled cartridge or new cartridge by filling printing material from the supply port into a cartridge for which at least a portion of the chamber is constituted by a sheet member. In fact, it is possible to fill the printing material into the chamber while allowing air inside the chamber to escape from the exhaust port. Because of this, introduction of the printing material into the chamber is easier, and it is possible to shorten the time taken for filling.

As the fifteenth application example, it is possible to use the manufacturing method of a cartridge according to the application example noted above, further comprising exhausting at least a portion of the substance inside the chamber using the exhaust port before filling the printing material.

With this application example, it is possible to manufacture a higher quality cartridge.

As the sixteenth application example, it is possible to use the manufacturing method of a cartridge according to the application example noted above, further comprising a step of removing at least a portion of the case.

As the seventeenth application example, it is possible to use the manufacturing method of a cartridge according to the application example noted above, wherein the step of removing at least a portion of the case is a step of removing a second case attached to a first case so as to cover the sheet member joined to the first case.

With these application examples, the interior of the chamber is exposed, and it is easier to visually recognize the interior. Thus, it is possible to implement cartridge manufacturing work with good efficiency, especially the filling of the printing material.

The manufacturing method of a cartridge of the eighteenth application example is a manufacturing method of a cartridge that has a case, a chamber adapted to be filled with printing material, the chamber provided inside the case, a supply port that leads the printing material inside the chamber to outside the case, the supply port leading from the inside of the chamber to the outside of the case, a sheet member having flexibility and constituting at least a portion of a wall of the chamber, a biasing member that biases the sheet member in the direction that expands the capacity of the chamber, the biasing member provided inside the case, and an air chamber provided inside the case and outside the chamber, wherein the case has a first case joined by the sheet member, and a second case attached to the first case so as to cover the sheet member, comprising removing the second case, forming an airtight space corresponding to the air chamber outside the chamber after removing the second case, and filling the printing material inside the chamber from the supply port while reducing the pressure of the space.

With the cartridge manufacturing method of this application example, it is possible to manufacture a recycled cartridge or a new cartridge by filling printing material from the supply port into a cartridge for which at least a portion of the chamber is constituted by a sheet member. In fact, when filling the printing material, the airtight space formed on the outside of the chamber has the pressure reduced.

Specifically, the printing material is filled while pulling the sheet member in the direction that expands the capacity of the chamber. Because of this, it is easier to introduce the printing material into the chamber, and it is possible to shorten the time it takes for filling.

As the nineteenth application example, it is possible to use the manufacturing method of a cartridge according to the application example noted above, wherein exhausting at least a portion of the substance inside the chamber to outside the case from the supply port by pressurizing the space, before filling the printing material and after forming the airtight space corresponding to the air chamber on the outside of the chamber.

With this application example, it is possible to manufacture a higher quality cartridge.

The manufacturing method of a cartridge of the twentieth application example is a manufacturing method of a cartridge that has a case, a chamber adapted to be filled with printing material, the chamber provided inside the case, a supply port that leads the printing material inside the chamber to outside the case, the supply port leading from the inside of the chamber to outside the case, a sheet member having flexibility and constituting at least a portion of a wall of the chamber, a biasing member that biases the sheet member in the direction that expands the capacity of the chamber, the biasing member provided inside the case, an air introduction port by which air from outside the chamber adapted to be introduced to inside the chamber, and a valve section that opens and closes the air introduction port, comprising filling the printing material inside the chamber from the air introduction port in a state with the inside of the chamber in communication with the outside of the chamber while opening the air introduction port by applying an external force on the valve section.

With the cartridge manufacturing method of this application example, it is possible to manufacture a recycled cartridge or a new cartridge by filling printing material from the air introduction port into a cartridge for which at least a portion of the chamber is constituted by a sheet member.

As the twenty-first application example, it is possible to use the manufacturing method of a cartridge according to the application example noted above, further comprising making an exhaust port that leads from inside the chamber to outside the chamber on the chamber before filling the printing material, wherein filling the printing material inside the chamber is performed in a state with the exhaust port open.

With this application example, it is possible to fill the printing material into the chamber while allowing air inside the chamber to escape from the exhaust port. Because of this, introduction of the printing material into the chamber is easier, and it is possible to shorten the time taken for filling.

As the twenty-second application example, it is possible to use the manufacturing method of a cartridge according to the application example noted above, further comprising exhausting at least a portion of the substance inside the chamber using the exhaust port before filling the printing material.

With this application example, it is possible to manufacture a higher quality cartridge.

As the twenty-third application example, it is possible to use the manufacturing method of a cartridge according to the application example noted above, further comprising exhausting at least a portion of the substance inside the chamber using the air introduction port before filling the printing material.

With this application example, it is possible to manufacture a higher quality cartridge.

As the twenty-fourth application example, it is possible to use the manufacturing method of a cartridge according to the application example noted above, further comprising exhausting at least a portion of the substance inside the chamber using the supply port before filling the printing material.

With this application example, it is possible to manufacture a higher quality cartridge.

As the twenty-fifth application example, it is possible to use the manufacturing method of a cartridge according to the application example noted above, further comprising a step of removing at least a portion of the case.

As the twenty-sixth application example, it is possible to use the manufacturing method of a cartridge according to the application example noted above, wherein the step of removing at least a portion of the case is a step of removing a second case attached to a first case so as to cover the sheet member joined to the first case.

With these application examples, the interior of the chamber is exposed, and it is easier to visually recognize the interior. Thus, it is possible to implement cartridge manufacturing work with good efficiency, especially the filling of the printing material.

As the twenty-seventh application example, it is possible to use a manufacturing apparatus of a cartridge for implementing the manufacturing method according to the first through ninth application examples, having a filling port forming member that forms the filling port, a filling member that fills printing material from the filling port to inside the chamber, and a filling port sealing member that closes the filling port.

With the cartridge manufacturing apparatus of this application example, it is possible to implement the manufacturing method of from the first to ninth application examples.

As the twenty-eighth application example, it is possible to use a manufacturing apparatus of a cartridge for implementing the manufacturing method according to the tenth to thirteenth application examples, having an opening member that opens the air introduction port, and a filling member that fills printing material from the supply port to inside the chamber.

With the cartridge manufacturing apparatus of this application example, it is possible to implement the manufacturing method of from the tenth to thirteenth application examples.

As the twenty-ninth application example, it is possible to use a manufacturing apparatus of a cartridge for implementing the manufacturing method according to the fourteenth through seventeenth application examples, having an exhaust port forming member that forms the exhaust port, an exhaust port sealing member that closes the exhaust port, and a filling member that fills the printing material from the supply port to inside the chamber.

With the cartridge manufacturing apparatus of this application example, it is possible to implement the manufacturing method of from the fourteenth to seventeenth application examples.

As the thirtieth application example, it is possible to use a manufacturing apparatus of a cartridge for implementing the manufacturing method according to the eighteenth and nineteenth application examples, wherein an airtight space corresponding to the air chamber is formed on the outside of the chamber, and having a pressure addition and reduction device that increases and reduces the pressure of the space.

With the cartridge manufacturing apparatus of this application example, it is possible to implement the manufacturing method of the eighteenth and nineteenth application examples.

As the thirty-first application example, it is possible to use a manufacturing apparatus of a cartridge for implementing the manufacturing method according to the twentieth to twenty-sixth application examples, having an opening member that opens the air introduction port, and a filling member that fills the printing material from the air introduction port to inside the chamber.

With the cartridge manufacturing apparatus of this application example, it is possible to implement the manufacturing method of from the twentieth to twenty-sixth application examples.

DETAILED DESCRIPTION OF EMBODIMENTS

Figure 1:
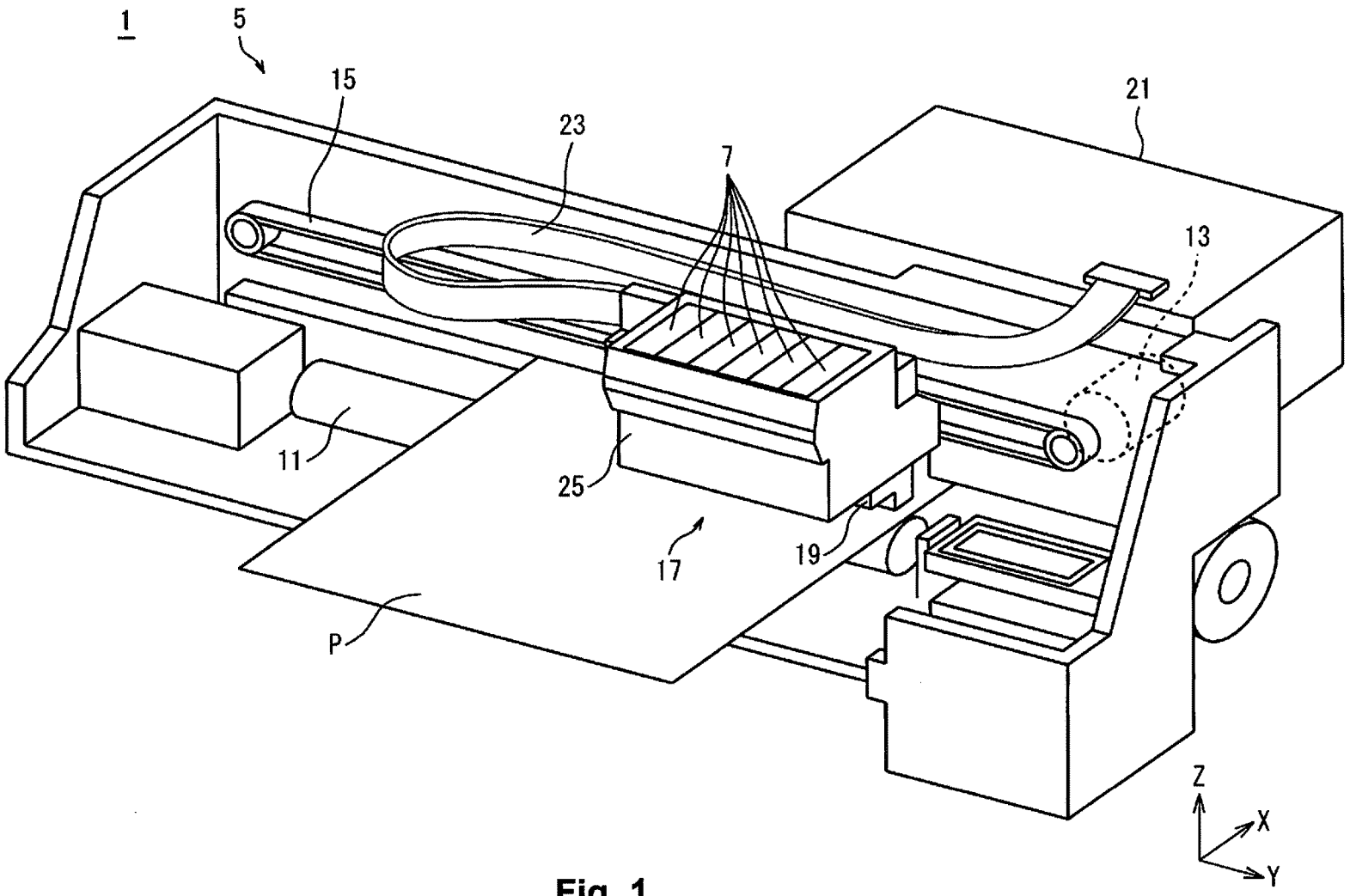
FIG. 1 is a perspective view showing the constitution of the printing system of this embodiment.

We will describe this embodiment with a printing system as an example while referring to the drawings. In each drawing, to make each respective constitution a visually recognizable size, there are cases when the constitution and member scale differ.

Printing System Constitution

As shown in FIG. 1, a printing system 1 has a printer 5, and a cartridge 7 as an example of a container for filling ink as a printing material. XYZ axes which are the coordinate axes that are orthogonal to each other are noted in FIG. 1. The XYZ axes are also noted as necessary in drawings shown hereafter. In FIG. 1, the printer 5 is arranged on a horizontal plane stipulated by the X axis direction and the Y axis direction. The Z axis direction is the direction orthogonal to the horizontal plane, and the Z axis negative direction is the vertical downward direction.

The printer 5 has a sub scan feed mechanism, a main scan feed mechanism, and a head drive mechanism. The sub scan feed mechanism conveys printing paper P in the sub scan direction using a paper feed roller 11 which uses a paper feed motor (not illustrated) for power. The main scan feed mechanism moves a carriage 17 connected to a drive belt 15 back and forth in the main scan direction using the force of a carriage motor 13. The printer 5 main scan direction is the Y axis direction, and the sub scan direction is the X axis direction. The head drive mechanism drives a print head 19 equipped on the carriage 17 and executes ink discharge and dot formation. The printer 5 is further equipped with a control unit 21 for controlling each mechanism described above. The print head 19 is connected to the control unit 21 via the flexible cable 23.

The carriage 17 is equipped with a holder 25 and the print head 19. The holder 25 is constituted to be able to mount a plurality of cartridges 7, and is arranged on the top side of the print head 19. With this embodiment, six types of cartridge 7 including black, yellow, magenta, cyan, light magenta, and light cyan are mounted one at a time in the holder 25. The six cartridges 7 are respectively adapted to be attached and detached with the holder 25. The types of cartridge 7 are not limited to the six types noted above, and any other type can also be used. Also, the number of cartridges 7 that can be mounted in the holder 25 is not limited to six, and any number of one or more can be used. The print head 19 sprays ink by discharging ink.

Figure 2:
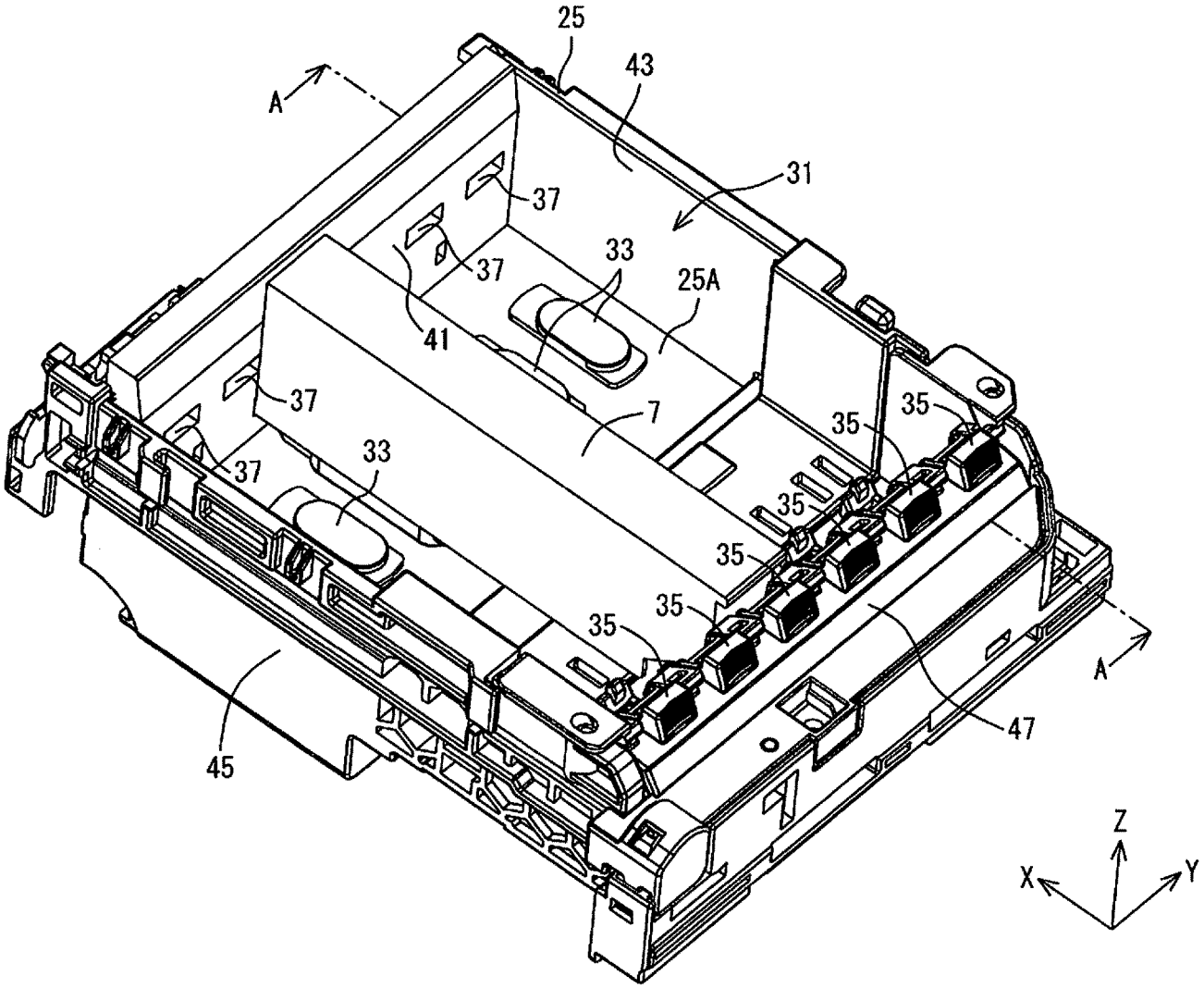
FIG. 2 is a perspective view showing the constitution of the holder of this embodiment.

As shown in FIG. 2, the holder 25 has a recess 31. The cartridge 7 is mounted inside the recess 31 of the holder 25. With this embodiment, it is possible to house six cartridges 7 inside the recess 31. With this embodiment, the six cartridges 7 mounted inside the recess 31 are housed inside the recess 31 in a state with a gap opened between them. Inside the recess 31, the respective corresponding mounting positions of the six cartridges 7 mounted in the recess 31 are prescribed. The six mounting positions are aligned in the Y axis direction inside the recess 31. In other words, the six cartridges 7 are housed inside the recess 31 in a state aligned in the Y axis direction.

Inside the recess 31, six introduction portions 33 are provided on a bottom part 25A of the holder 25. The six introduction portions 33 are respectively provided at each mounting position. In other words, the six introduction portions 33 are respectively provided corresponding respectively to the six cartridges 7 mounted inside the recess 31. Because of this, the six introduction portions 33 are aligned in the Y axis direction inside the recess 31. Then, the six cartridges 6 mounted in the holder 25 are aligned along the Y axis direction inside the recess 31. In FIG. 2, a state with one cartridge 7 mounted in the holder 25 is shown.

Also, six levers 35 and six engagement holes 37 are provided in the holder 25. With this embodiment, for each cartridge 7 mounting position, one lever 35 and one engagement hole 37 is provided. The six levers 35 are aligned in the Y axis direction. The six engagement holes 37 are also aligned in the Y axis direction.

The levers 35 are provided at the −X axis direction side of the introduction portion 33. With the holder 25, a side wall 41 is provided at the side opposite the lever 35 (+X axis direction side) sandwiching the introduction portion 33. Also, a side wall 43 and a side wall 45 are provided at the respective positions confronting in the Y axis direction sandwiching the introduction portions 33. The side wall 43 is positioned at the +Y axis direction side of the bottom part 25A. The side wall 45 is positioned at the −Y axis direction side of the bottom part 25A. Also, a side wall 47 is provided at the position confronting the side wall 41 sandwiching the lever 35 in the X axis direction. The side wall 41, the side wall 43, the side wall 45, and the side wall 47 respectively project in the +Z axis direction from the bottom part 25A. The bottom part 25A is enclosed by the side wall 41, the side wall 43, the side wall 45, and the side wall 47. By doing this, the recess 31 is demarcated.

Figure 3:
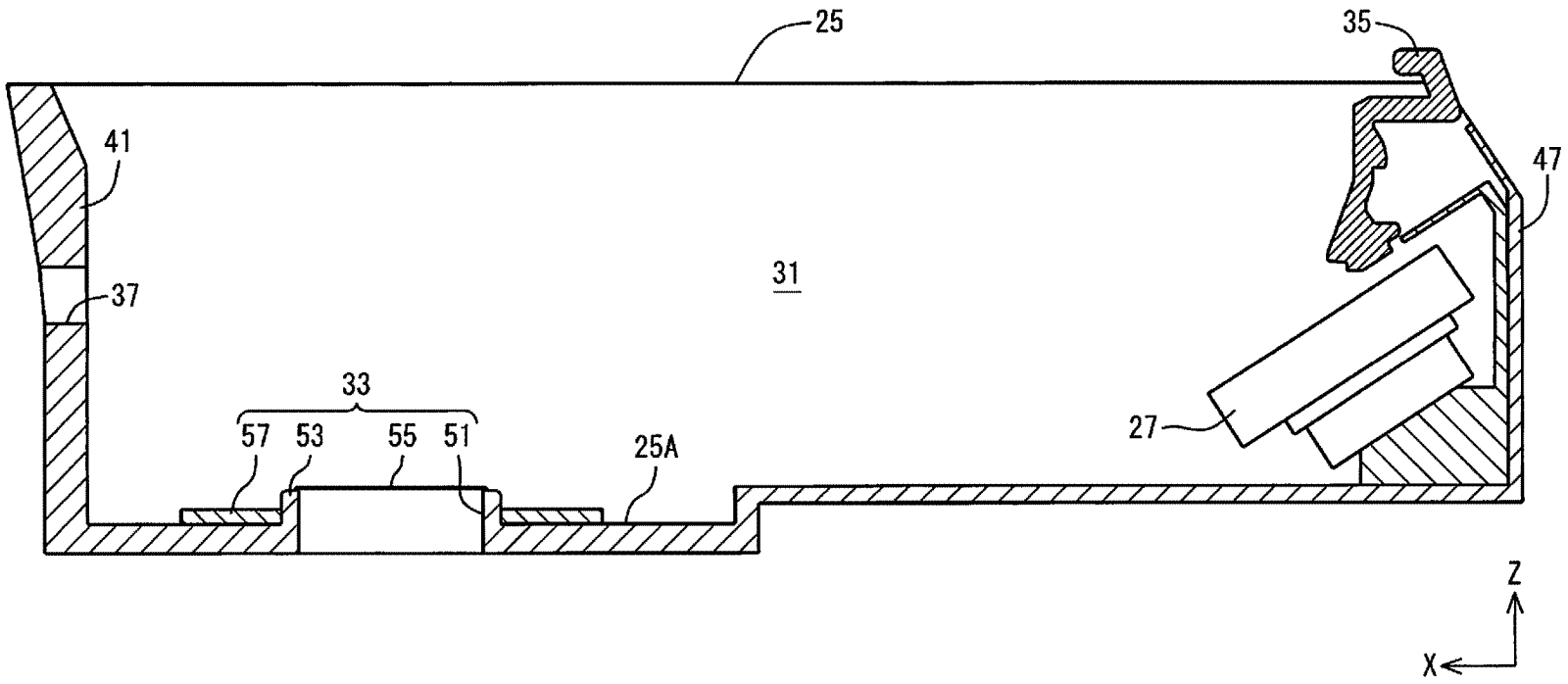
FIG. 3 is a cross section view of line A-A in FIG. 2.

As shown in FIG. 3 which is a cross section view of line A-A in FIG. 2, the lever 35 is provided between the side wall 47 and the side wall 41. FIG. 3 correlates to a cross section view when cut at the XZ plane that pierces through the introduction port 33. The lever 35 is provided between the side wall 47 and the introduction portion 33. The lever 35 fixes the cartridge 7 mounted in the holder 25. By canceling the fixing of the cartridge 7 by the lever 35, the operator is able to remove the cartridge 7 from the holder 25. The engagement hole 37 is provided on the side wall 41. The engagement hole 37 pierces through the side wall 41.

The introduction portion 33 is provided on the bottom part 25A between the lever 35 and the side wall 41. The introduction portion 33 includes a flow path 51, a projecting part 53, a filter 55, and packing 57. The flow path 51 is a path for ink supplied from the cartridge 7, and is provided as an opening piercing through the bottom part 25A. The projecting part 53 is provided on the bottom part 25A, and projects facing the direction that is convex facing the +Z axis direction from the bottom part 25A. The projecting part 53 encloses the flow path 51 on the inside of the recess 31. The filter 55 is placed over the projecting part 53, and covers the opening on the inside of the recess 31 of the flow path 51 from the projecting part 53 side. The packing 57 is provided on the bottom part 25A, and encloses the projecting part 53 on the inside of the recess 31. The packing 57 is constituted with a material having elasticity such as rubber, an elastomer or the like, for example.

Cartridge Constitution

Figure 4:
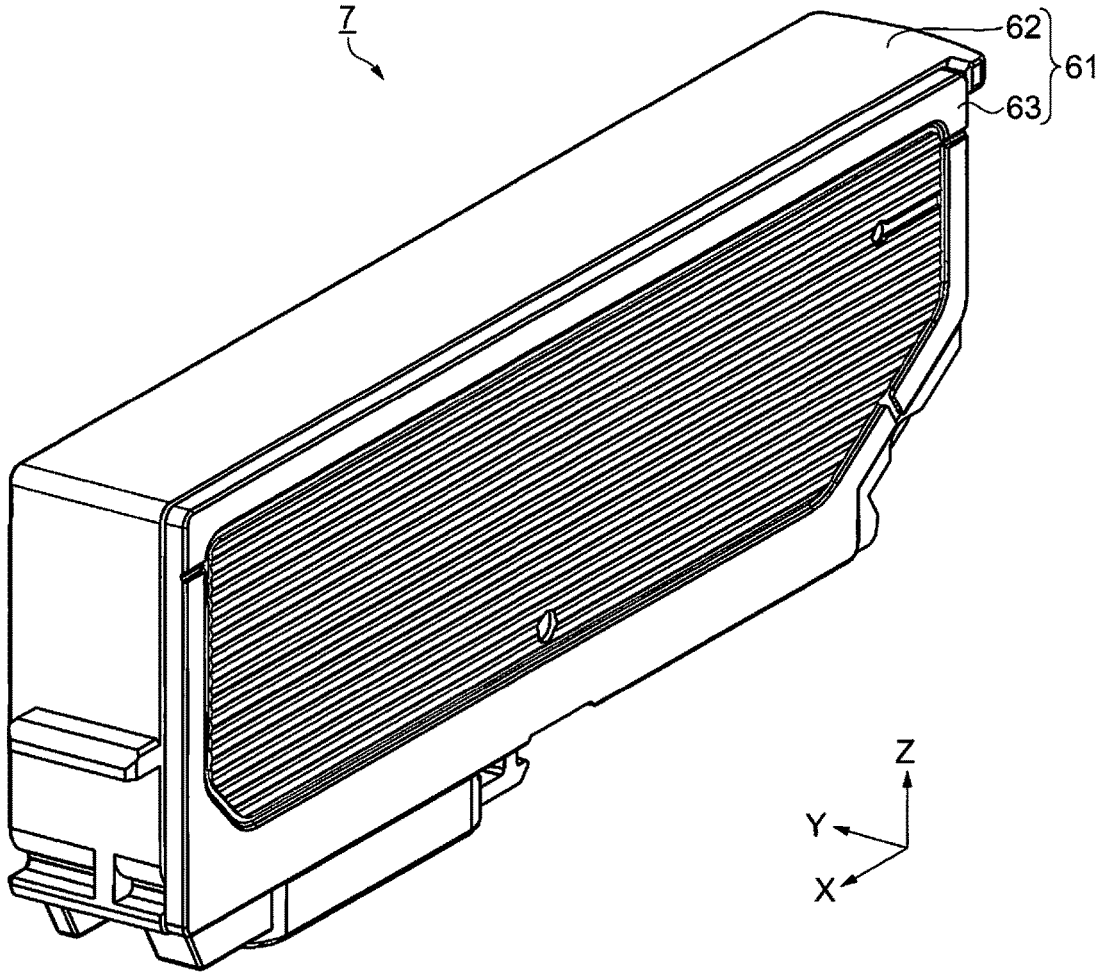
FIG. 4 is a perspective view showing the cartridge of this embodiment.
Figure 5:
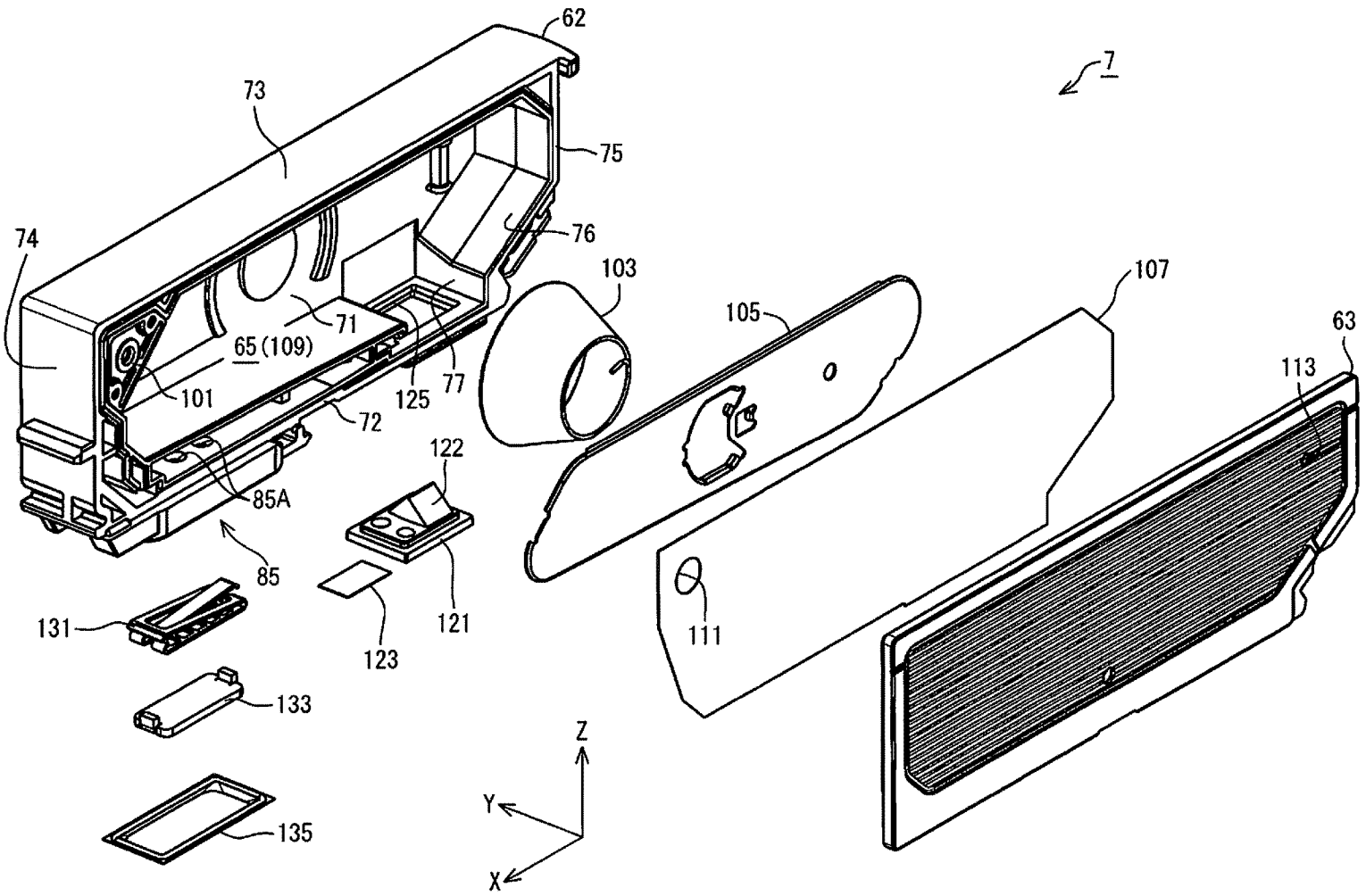
FIG. 5 is a perspective view showing the constitution of the cartridge of this embodiment.

As shown in FIG. 4, the cartridge 7 has a case 61. The case 61 constitutes the outer shell of the cartridge 7. The case 61 includes a first case 62 and a second case 63. With this embodiment, the outer shell of the cartridge 7 is constituted by the first case 62 and the second case 63. As shown in FIG. 5, the first case 62 has a first wall 71, a second wall 72, a third wall 73, a fourth wall 74, a fifth wall 75, a sixth wall 76, and a seventh wall 77. The second wall 72 through the seventh wall 77 respectively intersect the first wall 71. The second wall 72 through the seventh wall 77 respectively project facing the −Y axis direction side from the first wall 71, specifically, facing the second case 63 side from the first wall 71.

The second wall 72 and the third wall 73 are provided at mutually confronting positions sandwiching the first wall 71 in the Z axis direction. The fourth wall 74 and the fifth wall 75 respectively intersect the third wall 73. Also, the fourth wall 74 intersects the second wall 72 at the side opposite the third wall 73 side.

The sixth wall 76 intersects the fifth wall 75 at the second wall 72 side of the fifth wall 75 in the Z axis direction, specifically, at the side opposite the third wall 73 side of the fifth wall 75. The seventh wall 77 intersects the sixth wall 76 at the side opposite the fifth wall 75 side of the sixth wall 76. Also, the seventh wall 77 intersects the second wall 72 at the side opposite the fourth wall 74 side of the second wall 72.

The sixth wall 76 slants respectively in relation to the fifth wall 75 and the second wall 72. The sixth wall 76 slants in the direction approaching the fourth wall 74 as it nears the second wall 72 side from the third wall 73 side.

With the constitution noted above, the first wall 71 is enclosed by the second wall 72 through the seventh wall 77. The second wall 72 through the seventh wall 77 project facing the −Y axis direction from the first wall 71. Because of that, the first case 62 is constituted as a recess shape by the second wall 72 through the seventh wall 77 with the first wall 71 as the bottom part (bottom surface). A recess 65 is constituted by the first wall 71 through the seventh wall 77. The recess 65 is constituted facing with the +Y axis direction as the direction that is recessed. The recess 65 is open facing the −Y axis direction, specifically, facing the second case 63 side. The recess 65 is closed by a sheet member 107 described later. Then, ink is filled inside the recess 65 closed by the sheet member 107. The area enclosed by the recess 65 and the sheet member 107 function as an ink chamber 109. Hereafter, the surface inside of the recess 65 is noted as the inner surface 67.

Figure 6:
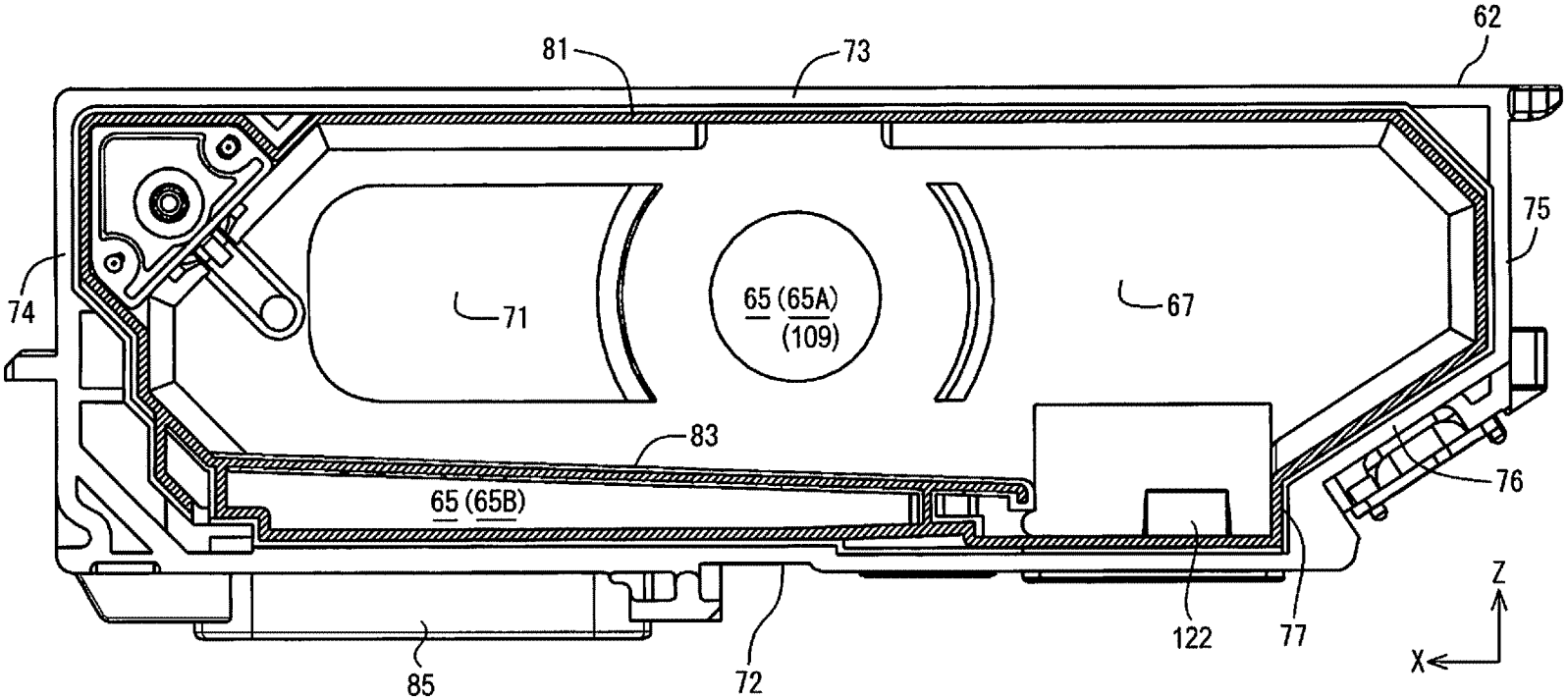
FIG. 6 is a plan view showing the first case of this embodiment.

As shown in FIG. 6, a sheet junction part 81 is provided along the contour of the recess 65 on the first case 62. The sheet junction part 81 is provided along the second wall 72 through the seventh wall 77. Also, a partition wall 83 that partitions the recess 65 into a first recess 65A and a second recess 65B is provided on the first case 62. The sheet junction part 81 is also provided on the partition wall 83. With FIG. 6, to make it easier to understand the constitution, cross hatching is shown on the sheet junction part 81. Of the recess 65, the area enclosed by the third wall 73, the fifth wall 75, the seventh wall 77, a portion of the second wall 72, the partition wall 83, and a portion of the fourth wall 74 is the first recess 65A. Also, of the recess 65, the area enclosed by the other part of the second wall 72, the partition wall 83, and the other part of the fourth wall 74, specifically, the area for which the first recess 65A is excepted from the recess 65, is the second recess 65B.

Figure 7A:
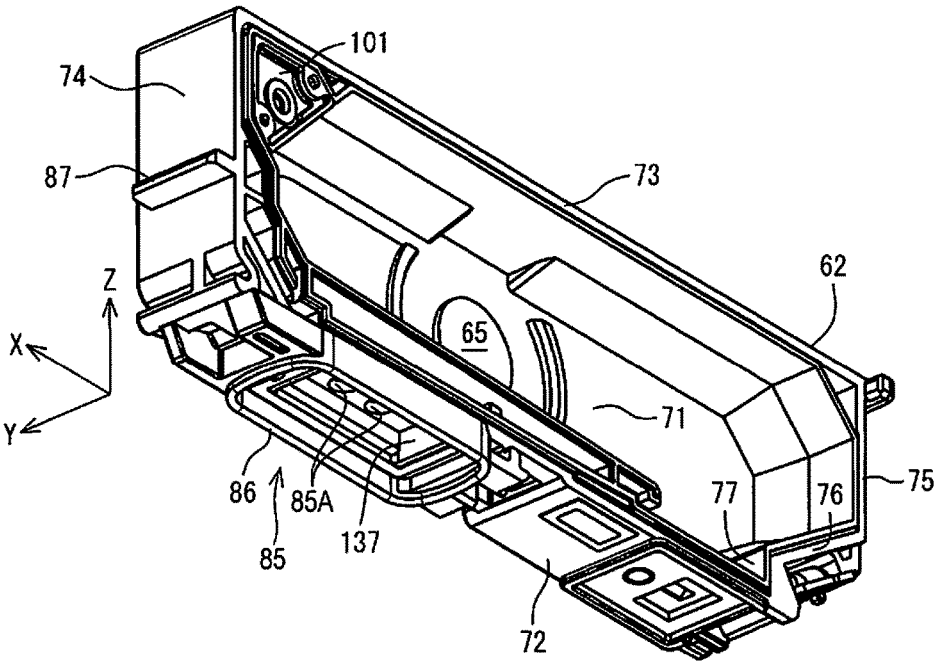
FIG. 7 is a perspective view showing the first case of this embodiment.
Figure 7B:
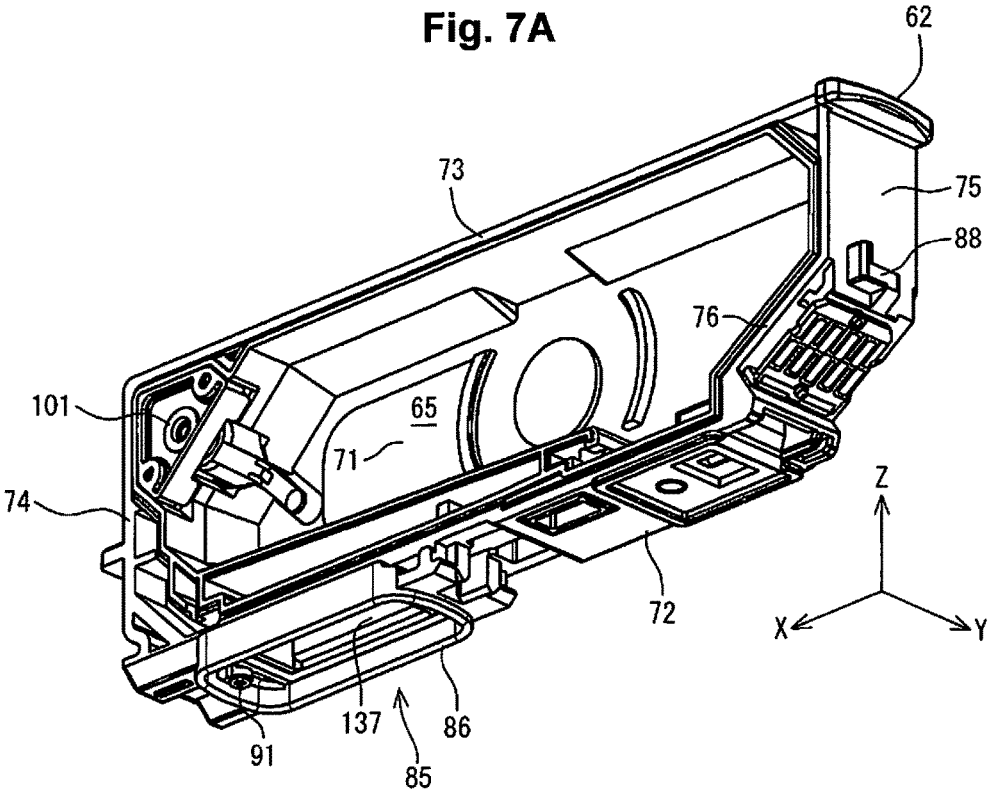

Also, a supply port 85 is provided on the second wall 72. The ink filled inside the chamber 109 is exhausted from the supply port 85 to outside the cartridge 7. As shown in FIG. 7 (*a*), the supply port 85 is equipped with a peripheral wall 86 provided on the second wall 72. The peripheral wall 86 is provided on the side opposite the recess 65 side of the second wall 72, specifically, the outside of the second wall 72. Also, the peripheral wall 86 projects facing the side opposite the third wall 73 side from the second wall 72 (−Z axis direction side). Also, a communication hole 85A that allows communication between the chamber 109 and the supply port 85 is provided on the second wall 72. The ink filled inside the chamber 109 is sent to the supply port 85 via this communication hole 85A.

Figure 8:
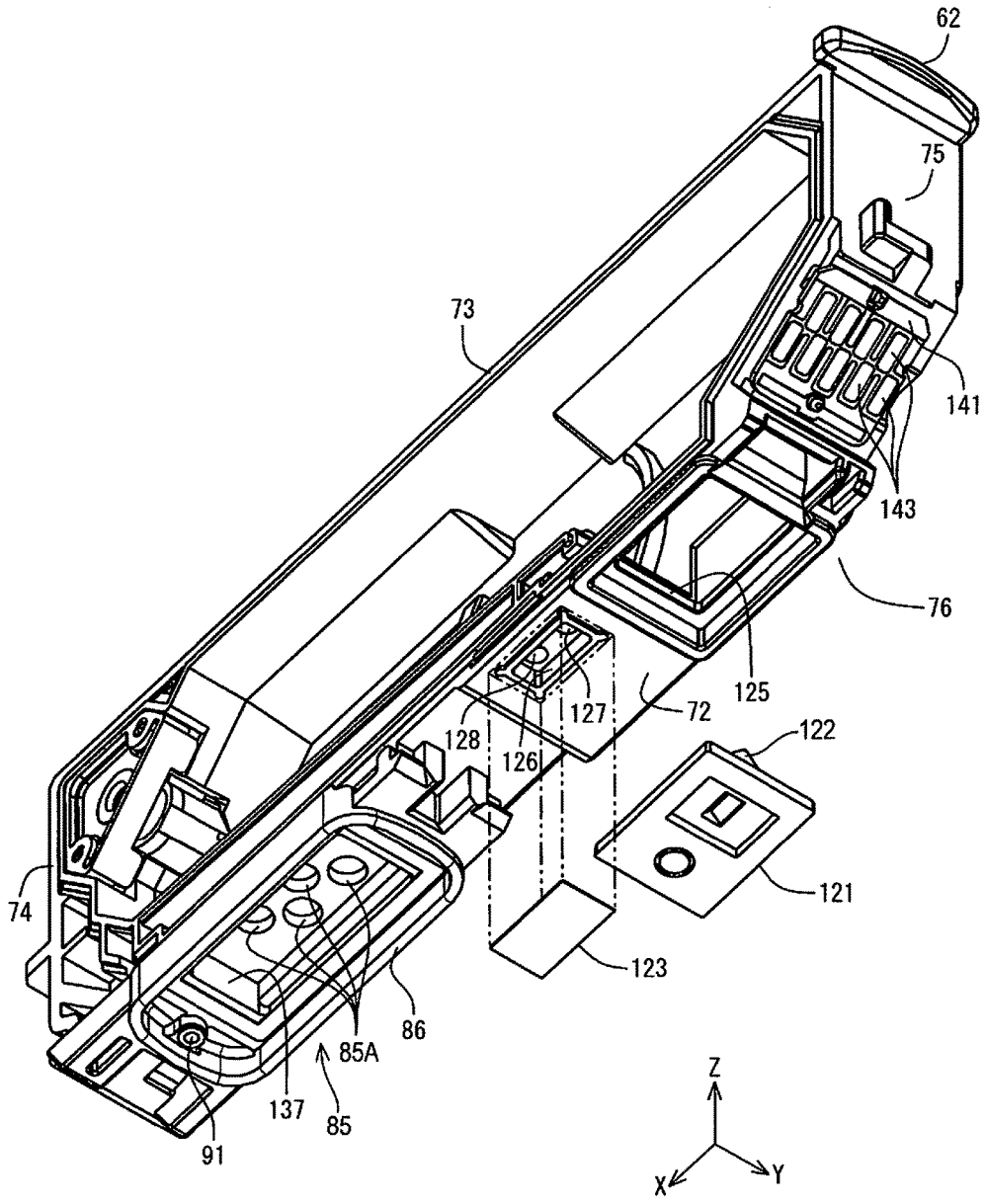
FIG. 8 is a perspective view showing the first case of this embodiment.
Figure 9:
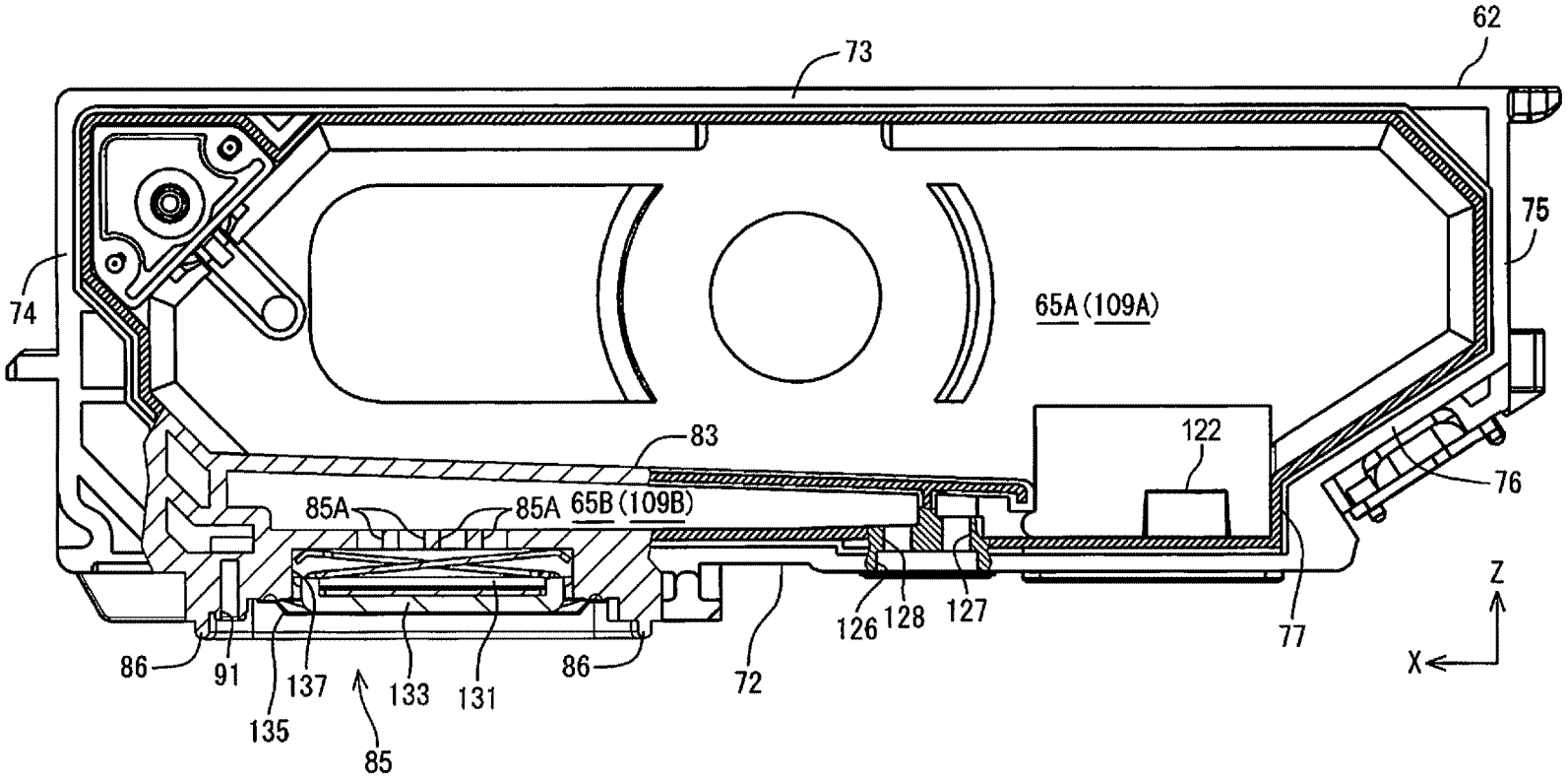
FIG. 9 is a drawing for explaining the constitution of the interior of the first case of this embodiment.

Also, as shown in FIG. 5, the supply port 85 has a plate spring 131, a foam 133, and a filter 135. As shown in FIG. 8, in the first case 62, a recess 137 is provided inside the area enclosed by the peripheral wall 86. Then, as shown in FIG. 9, the plate spring 131 and the foam 133 are set inside the recess 137. Also, the filter 135 is provided inside the area enclosed by the peripheral wall 86, and the recess 137 is covered from outside the second wall 72. As the filter 135, for example, it is possible to use an item for which through holes are opened in a film material such as by press working or the like, an asymmetric membrane such as an MMM membrane made by PALL Corp. or the like, for example an asymmetric membrane such as woven fabric or the like. The foam 133 and the filter 135 are respectively porous members. A plurality of members are provided on the supply port 85. With the manufacturing method of the cartridge 7 described later, ink is filled so that among these members, the entire surface of the filter 135 which is a porous member positioned at the furthest tip side of the supply port 85 is in a state wetted by ink after the ink filling is completed.

A projecting part 87 is provided on the fourth wall 74. The projecting part 87 projects facing the side opposite the fifth wall 75 side from the fourth wall 74 (+X axis direction side). The projecting part 87 is positioned between the second wall 72 and the third wall 73 in the Z axis direction. The projecting part 87 engages with the engagement hole 37 shown in FIG. 3 in a state with the cartridge 7 mounted in the holder 25. Also, as shown in FIG. 7 (*b*), a projecting part 88 is provided on the fifth wall 75. The projecting part 88 projects facing the side opposite the fourth wall 74 side from the fifth wall 75 (−X axis direction side). The projecting part 88 is latched by the lever 35 shown in FIG. 3 in a state with the cartridge 7 mounted in the holder 25. By doing this, it is possible to fix the cartridge 7 to the holder 25. At the second wall 72, a communication hole 91 is provided in the area enclosed by the peripheral wall 86 and in the area outside the filter 135 of the supply port 85. The communication hole 91 pierces through between the inside of the recess 65 and the outside of the first case 62.

Also, as shown in FIG. 5, the cartridge 7 has a valve unit 101, a coil spring 103, a pressure receiving plate 105 as a pressure receiving portion, and the sheet member 107 as a flexible portion. The sheet member 107 is formed using synthetic resin (e.g. nylon, polypropylene or the like), and has flexibility. The sheet member 107 is provided on the first case 62 side of the second case 63. The sheet member 107 is joined to the sheet junction part 81 of the first case 62. With this embodiment, the sheet member 107 is joined to the sheet junction part 81 by welding. By doing this, the recess 65 of the first case 62 is closed by the sheet member 107. The area enclosed by the recess 65 and the sheet member 107 is called the chamber 109. Then, ink is filled inside the recess 65 closed by the sheet member 107, specifically, inside the chamber 109. Because of this, with this embodiment, the sheet member 107 constitutes a portion of the wall of the chamber 109.

As described previously, as shown in FIG. 6, with the first case 62, the recess 65 is partitioned into the first recess 65A and the second recess 65B by the partition wall 83. Because of this, when the sheet member 107 is joined to the sheet junction part 81, the chamber 109 is partitioned into a first chamber 109A and a second chamber 109B. The first chamber 109A corresponds to the first recess 65A. The second chamber 109B corresponds to the second recess 65B. As described above, the sheet member 107 has flexibility. Because of this, it is possible to change the capacity of the first chamber 109A. The sheet member 107 is joined to the first case 62 in a state pressed and extended along the inner surface 67 of the recess 65 in advance so as to easily follow the changes in capacity of the first chamber 109A.

As shown in FIG. 5, the coil spring 103 is provided at the first case 62 side of the sheet member 107, and is housed inside of the recess 65. The coil spring 103 is wound in a conical trapezoid shape. In FIG. 5, the coil spring 103 is simplified. The pressure receiving plate 105 is provided at the sheet member 107 side of the coil spring 103. In other words, the pressure receiving plate 105 is interposed between the coil spring 103 and the sheet member 107. The pressure receiving plate 105 faces opposite the second case 63, and contacts the sheet member 107. The lower base part of the coil spring 103 abuts the first wall 71. The upper base part of the coil spring 103 abuts the surface on the opposite side to the surface of the sheet member 107 side of the pressure receiving plate 105. Also, the upper base part of the coil spring 103 abuts the roughly center part of the pressure receiving plate 105. The pressure receiving plate 105 is formed using a synthetic resin such as polypropylene or the like, or a metal such as stainless steel or the like. The pressure receiving plate 105, and the part of the sheet member 107 in contact with the pressure receiving plate 105 are members that directly or indirectly receive pressure from the coil spring 103, so it is possible to perceive these together as the "pressure receiving portion."

The coil spring 103 energizes the pressure receiving plate 105 facing the sheet member 107 side (second case 63 side). To say this another way, the coil spring 103 energizes the pressure receiving plate 105 in the Y axis negative direction. Specifically, the coil spring 103 has a function as an energizing member that energizes the pressure receiving plate 105 in the direction that expands the capacity of the chamber 109. The second case 63 is provided on the side opposite to the pressure receiving plate 105 side of the sheet member 107. The second case 63 is attached to the first case 62 so as to cover the sheet member 107. By doing this, the sheet member 107 is protected from the exterior.

The valve unit 101 is provided on the inside of the recess 65. The sheet member 107 covers the recess 65 for each valve unit 101. A ventilation hole 111 is formed at the site at which the sheet member 19 overlaps the valve unit 101. Also, an air communication hole 113 is provided on the second case 63. Then, the space between the sheet member 107 and the second case 63 communicates with outside the cartridge 7 via the air communication hole 113. Because of this, air is interposed in the space between the sheet member 107 and the second case 63.

The space between the sheet member 107 and the second case 63 is called an air chamber 115. The communication hole 113 communicates with the air chamber 115. With this embodiment, the communication hole 91 communicates with the air chamber 115. In other words, with this embodiment, the space enclosed by the peripheral wall 86 communicates with the air communication hole 113 via the air chamber 115 from the communication hole 91.

Also, as shown in FIG. 5, the cartridge 7 has a prism unit 121 and a sheet member 123. Here, as shown in FIG. 8, an opening part 125 is provided on the second wall 72 of the first case 62. The opening part 125 is closed from the outside of the first case 62 by the prism unit 121. Then, as shown in FIG. 9, the prism unit 121 is equipped with a prism 122 projecting to the inside of the first case 62 from the outside of the first case 62 via the opening part 125.

The prism 122 functions as a detection section for detecting ink optically. The prism 122 is a member having optical transparency formed using a synthetic resin such as polypropylene, for example. The member constituting the prism 122 does not have to be transparent as long as it has suitable optical transparency. The ink inside the chamber 109 is detected as follows, for example. An optical sensor equipped with a light emitting element and a light receiving element are provided in the printer 5. Light is emitted toward the prism 122 from the light emitting element. When there is ink in the periphery of the prism 122, almost all the light passes through the prism 122, and goes toward the inside of the chamber 109. Meanwhile, when ink does not exist in the periphery of the prism 122, most of the light radiated from the light emitting element is reflected by two reflective surfaces of the prism 122, and reaches the light receiving element. The printer 5 judges whether there is only a slight amount of ink remaining inside the chamber 109 or whether there is no ink inside the chamber 109 based on whether light reached the light receiving element. This judgment is performed by the control unit 21 of the printer 5.

Also, as shown in FIG. 8, a recess 126 is provided on the second wall 72 of the first case 62. The recess 126 is provided at a position that is between the supply port 85 and the prism 122 in the X axis direction. The recess 126 is recessed facing the direction of the recess 65 from the outside of the second wall 72. A communication hole 127 and a communication hole 128 are provided on the second wall 72 leading from the recess 126 to the inside of the recess 65. The communication holes 127 and 128 are provided inside the recess 65. The recess 126 is closed from the outside of the first case 62 by the sheet member 123.

As shown in FIG. 9, the communication hole 127 leads from the inside of the first recess 65A to the inside of the recess 126. The communication hole 128 leads from the inside the recess 126 to the inside of the second recess 65B. In other words, the first recess 65A and the second recess 65B communicate each other via the communication hole 127, the recess 126, and the communication hole 128. With FIG. 9, a cross section is shown when the communication hole 127 and the communication hole 128 are cut at XZ plane.

As shown in FIG. 8, a circuit substrate 141 is provided on the opposite side to the recess 65 side of the sixth wall 76, specifically on the outside of the sixth wall 76. The circuit substrate 141 extends along the sixth wall 76. Because of this, the circuit substrate 141 is slanted respectively in relation to the second wall 72 and the fifth wall 75. The circuit substrate 141 is slanted in the direction approaching the fourth wall 74 as it nears the second wall 72 side from the third wall 73 side. A plurality of terminals 143 in contact with a contact mechanism 27 (FIG. 3) of the holder 25 are provided on the surface of the opposite side to the sixth wall 76 side of the circuit substrate 141. A storage device (not illustrated) such as non-volatile memory or the like is provided on the sixth wall 76 side of the circuit substrate 141.

In a state with the cartridge 7 mounted in the holder 25, the plurality of terminals 143 are in electrical contact with the contact mechanism 27 shown in FIG. 3. The contact mechanism 27 is electrically connected to a control unit 21 via a flexible cable 23 (FIG. 1). Then, by the contact mechanism 27 and the cartridge 7 storage device being electrically connected via the circuit substrate 141, it is possible to transmit various types of information between the control unit 21 and the cartridge 7 storage device.

Figure 10:
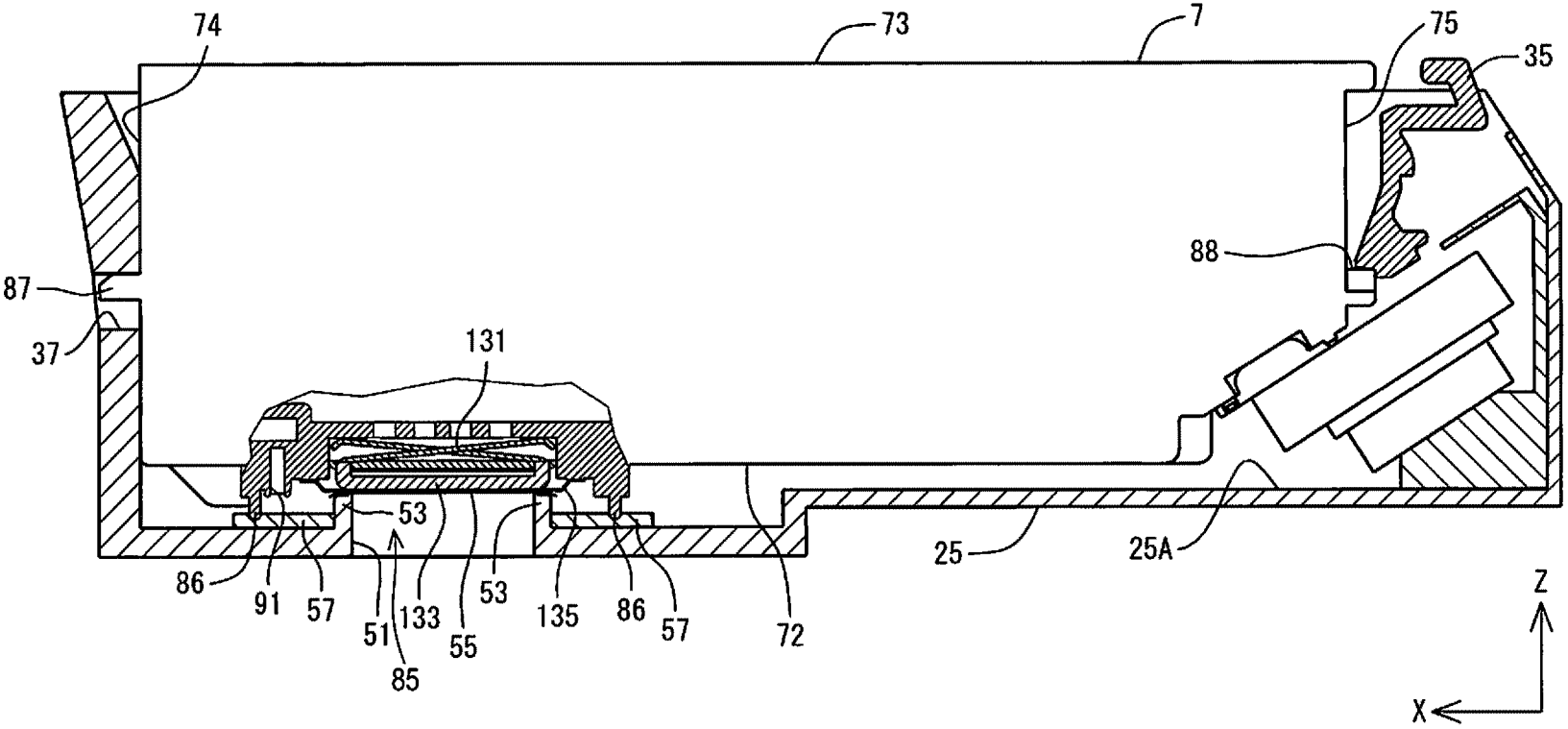
FIG. 10 is a drawing showing the state with the cartridge of this embodiment mounted in the holder.

As shown in FIG. 10, the cartridge 7 having the constitution noted above has its position fixed by the lever 35 in the state mounted in the holder 25. When the cartridge 7 is mounted in the holder 25, the peripheral wall 86 abuts the packing 57, and the projecting part 53 is inserted inside the area surrounded by the peripheral wall 86. In other words, the peripheral wall 86 surrounds the flow path 51 from further outside than the projecting part 53. Then, the filter 135 contacts the filter 55 inside the area surrounded by the peripheral wall 86. By doing this, the ink inside the chamber 109 can be supplied to the flow path 51 from the filter 55 via the foam 133 and the filter 135 from the supply port 85.

At this time, the peripheral wall 86 abuts the packing 57 in an area enclosing the flow path 51 from further outside than the projecting part 53. By doing this, the air tightness of the space enclosed by the peripheral wall 86 and the packing 57 increases. Because of this, when ink is supplied to the flow path 51 from the cartridge 7, the ink that spilled to outside of the area enclosed by the projecting part 53 is held back by the packing 57 and the peripheral wall 86.

Figure 11A:
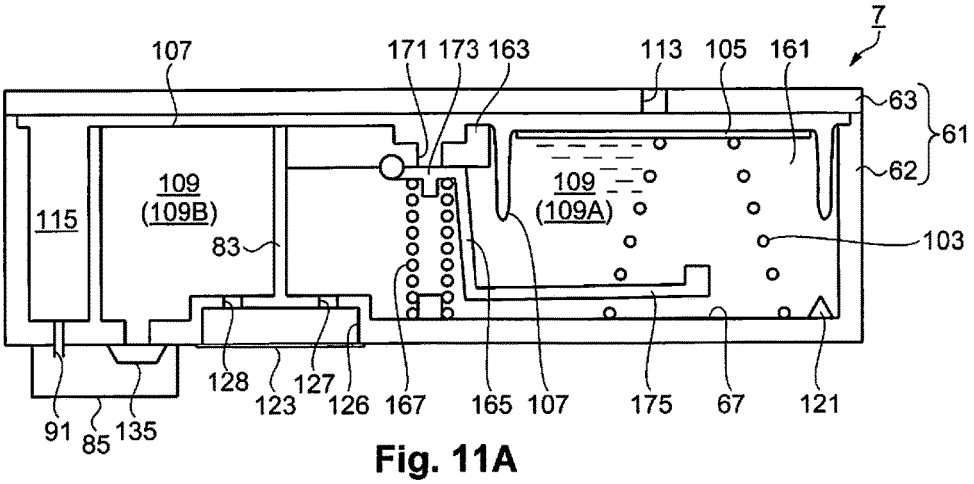
FIG. 11 is a cross section view typically showing the interior of the cartridge of this embodiment.
Figure 11B:
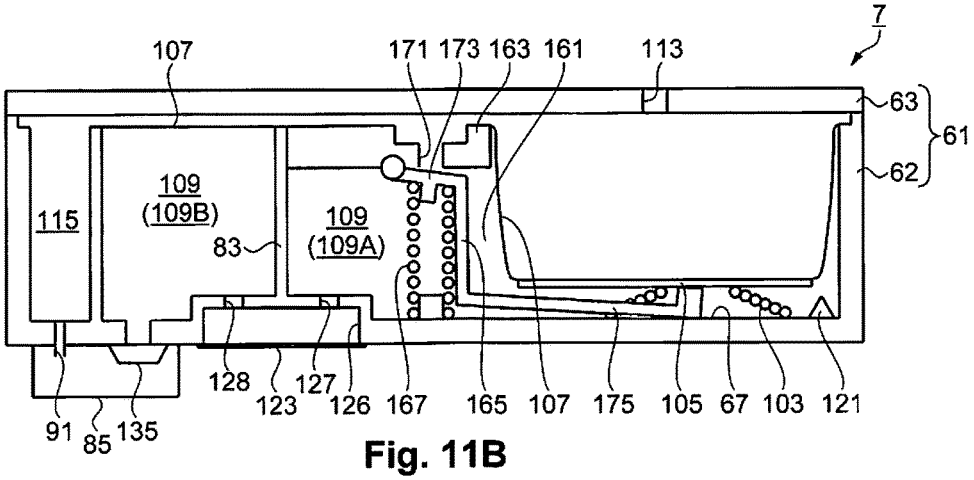
Figure 11C:
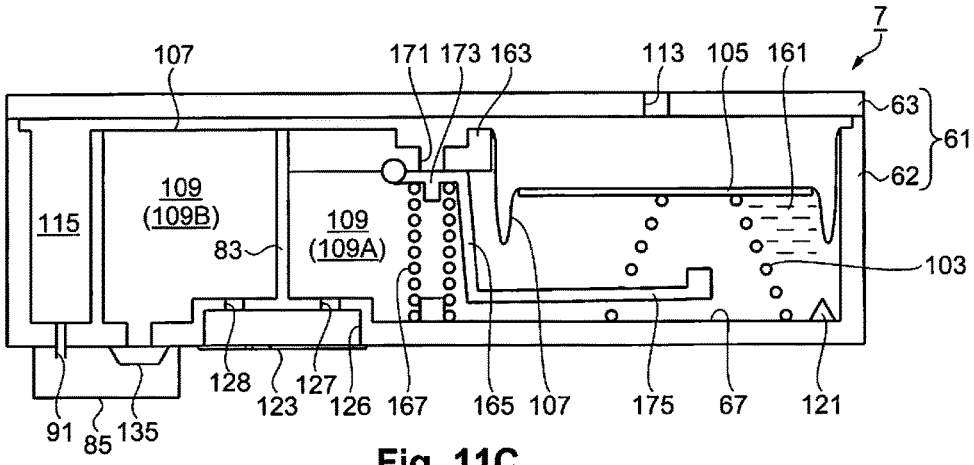

We will explain the ink flow and the air flow with the cartridge 7 of this embodiment. With the cartridge 7, as shown in FIG. 11 (*a*), the ink 161 is filled in the chamber 109 demarcated by the first case 62 and the sheet member 107. The chamber 109 is partitioned into the first chamber 109A and the second chamber 109B by the partition wall 83. The valve unit including a cover valve 163, a lever valve 165, and a spring member 167 is provided inside the case 61.

An air introduction port 171 is provided on the cover valve 163. The air introduction port 171 pierces through the cover valve 163. The air introduction port 171 functions as a communication path for communicating between the interior of the first chamber 109A and the air chamber 115 outside the chamber 109 on the inside of the cartridge 7. Specifically, the air introduction port 171 is an inlet port when introducing air to the chamber 109. The lever valve 165 is provided on the side opposite the second case 63 side of the cover valve 163. The lever valve 165 includes a valve section 173 and a lever section 175. The valve section 173 overlaps the air introduction port 171 of the cover valve 163. The lever section 175 is provided extending inside the area between the pressure receiving plate 105 and the internal surface 67 of the first wall 71 from the valve section 173. The spring member 167 is provided on the side opposite the cover valve 163 side of the lever valve 165. The spring member 167 biases the valve section 173 of the lever valve 165 facing the cover valve 163 side. By doing this, the air introduction port 171 of the cover valve 163 is closed by the valve section 173. Hereafter, the state of the air introduction port 171 being closed by the valve section 173 is expressed as the air introduction port 171 being in a closed state.

When the ink 161 inside the chamber 109 is consumed, as shown in FIG. 11 (*b*), the pressure receiving plate 105 is displaced toward the inner surface 67 side of the first wall 71, and the capacity of the first chamber 109A is decreased. When the pressure receiving plate 105 is displaced toward the inner surface 67 side of the first wall 71, the pressure receiving plate 105 pushes the lever section 175 toward the inner surface 67 side of the first wall 71. By doing this, the orientation of the valve section 173 changes, and a gap occurs between the valve section 173 and the cover valve 163. By doing this, there is communication between the air introduction port 171 and the first chamber 109A. Hereafter, by a gap occurring between the valve section 173 and the cover valve 163, the state of communication between the air introduction port 171 and the chamber 109 is expressed as the air introduction port 171 being in an open state. When the air introduction port 171 is in an open state, the air of the air chamber 115 that is at the outside of the chamber 109 passes through the air introduction port 171 and flow into the inside of the first chamber 109A.

When the air goes through the air introduction port 171 and flows into the first chamber 109A, as shown in FIG. 11 (*c*), the pressure receiving plate 105 is displaced toward the second case 63 side. In other words, by the air passing through the air introduction port 171 and flowing into the inside of the first chamber 109A, compared to the state shown in FIG. 11 (*b*), the capacity of the first chamber 109A increases. By doing this, the negative pressure inside the chamber 109 decreases (comes closer to atmospheric pressure). Then, when a certain amount of air is introduced to the first chamber 109A, the pressure receiving plate 105 is separated from the lever section 175. By doing this, the valve section 173 closes the air introduction port 171. Specifically, the air introduction port 171 is in a closed state. In this way, along with consumption of the ink 161 of the chamber 109, when the negative pressure inside the chamber 109 increases, the air introduction port 171 is temporarily in an open state, and thus it is possible to hold the pressure inside the chamber 109 at a suitable pressure range.

As described above, the cartridge 7 of this embodiment is a semi-sealed type cartridge for which air is introduced into the chamber 109 from the air introduction port 171 midway during use. The cartridge 7 is constituted so that as ink inside the chamber 109 is consumed, the capacity of the chamber 109 becomes smaller and also the negative pressure increases, and when the negative pressure reaches a designated size, the valve section 173 opens the air introduction port 171 and outside air is introduced into the chamber 109, and after that, the valve section 173 is made to close the air introduction port 171.

With this embodiment, the communication hole 91 pierces through the second wall 72 of the first case 62 from inside the area enclosed by the peripheral wall 86, and communicates with the air chamber 115. In other words, the inside of the area enclosed by the peripheral wall 86 and the air chamber 115 communicate via the communication hole 91. The air chamber 115 communicates with the air communication hole 113 via the gap between the second case 63 and the sheet member 107. Because of this, the interior of the area surrounded by the peripheral wall 86 goes through the inside of the case 61 and goes through to outside the case 61. By doing this, when the interior of the area enclosed by the peripheral wall 86 is sealed from the outside of the cartridge 7, it is possible to reduce the difference between the pressure inside the area enclosed by the peripheral wall 86 and the pressure outside the case 61 (atmospheric pressure).

With this embodiment, when the cartridge 7 is mounted in the printer 5, inside the holder 25, the area enclosed by the peripheral wall 86 is in a sealed state. Then, in a state with the area enclosed by the peripheral wall 86 sealed, the filter 135 of the inside of the area enclosed by the peripheral wall 86 abuts the filter 55 of the printer 5 side (FIG. 3). By doing this, it is possible to suppress the ink 161 from leaking out to the outside from the inside of the area enclosed by the peripheral wall 86. When the cartridge 7 is mounted in the printer 5, when the area enclosed by the peripheral wall 86 is sealed, there are cases when the pressure inside the area enclosed by the peripheral wall 86 becomes high. At this time, due to the rise in pressure inside the area enclosed by the peripheral wall 86, there are cases when the air inside the area enclosed by the peripheral wall 86 goes through the filter 135 and flows into the chamber 109. When air flows into the inside of the chamber 109, it is thought that the air that flowed in becomes air bubbles and reaches the print head 19 of the printer 5. When air bubbles are mixed inside the print head 19, there are cases when the ink 161 discharge performance decreases due to the air bubbles.

In contrast to this kind of situation, with this embodiment, the interior of the area enclosed by the peripheral wall 86 goes through to the outside of the first case 62 via the communication hole 91, the air chamber 115, and the air communication hole 113. Because of this, when the cartridge 7 is mounted in the printer 5, when the area enclosed by the peripheral wall 86 is sealed, even if the pressure inside the area enclosed by the peripheral wall 86 becomes high, it is possible to allow the air inside the area enclosed by the peripheral wall 86 to escape to outside the first case 62 via the communication hole 91, the air chamber 115, and the air communication hole 113. Also, for example when there is a rise in the pressure of the space enclosed by the peripheral wall 86 due to air expansion or the like due to temperature changes, it is possible to allow the air of the space enclosed by the peripheral wall 86 to escape to outside the cartridge 7. By doing this, it is possible to reduce the difference between the pressure inside the area enclosed by the peripheral wall 86 and the pressure outside the first case 62 (atmospheric pressure). As a result, it is easy to keep the ink discharge performance of the print head 19 high.

Cartridge Manufacturing Method

We will describe the manufacturing method of the cartridge 7. With this embodiment, we will describe with a focus on a method of manufacturing the cartridge 7 (recycled cartridge) by filling ink again (refill process) in an already use cartridge for which the ink has been consumed and the ink residual volume has gone to a designated value or less. The cartridge 7 manufacturing method of this embodiment can also be used as the method of manufacturing the cartridge 7 (new cartridge) by filling (initial filling) ink into an unused cartridge 7 before ink is filled.

Figure 12:
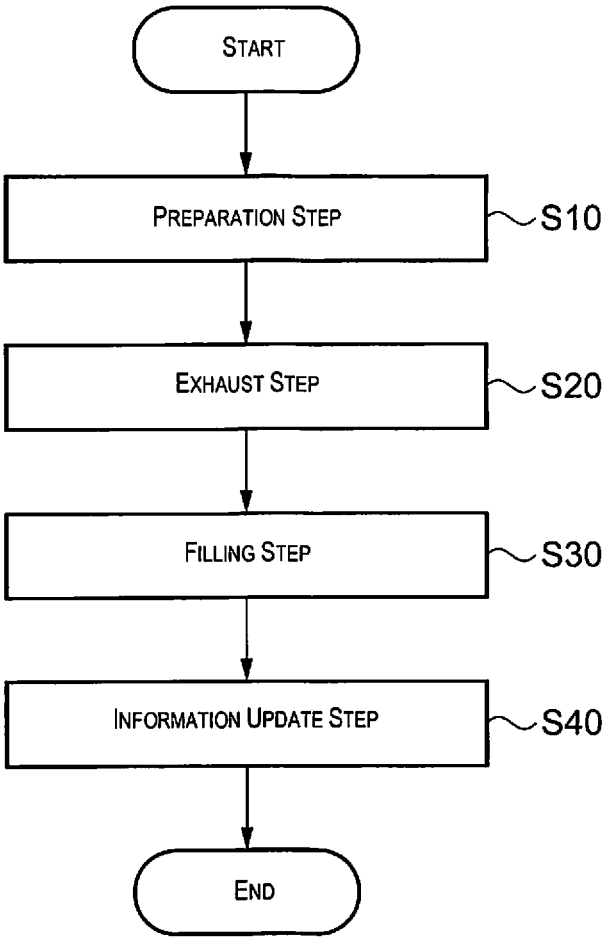
FIG. 12 is a drawing for explaining the flow of the cartridge manufacturing method of this embodiment.

As shown in FIG. 12, the cartridge 7 manufacturing method of this embodiment includes a preparation step S10 for preparing the cartridge 7, an exhaust step S20 for exhausting the substance inside the chamber 109, such as ink, air or the like, for example, a filling step S30 for filling ink into the chamber 109, and an information update step S40.

At the preparation step S10, an already used cartridge for which the ink has been consumed and the ink residual volume has reached a designated value or less is prepared. Alternatively, an unused cartridge before ink is filled is prepared.

The exhaust step S20 is a step of exhausting the substance inside the chamber 109 of the cartridge 7 prepared at the preparation step S10, such as ink, air or the like, for example. For example, there are many cases with already used cartridges when air or old ink remains in the chamber 109. In such a case, when implementing the exhaust step S20, it is possible to reduce the amount of old ink or air mixed into the newly filled ink IK. Also, when manufacturing a new cartridge as well, by filling the ink IK after exhausting the air inside the chamber 109 or the debris or dust remaining inside the chamber 109 during manufacturing, it is possible to reduce the amount of air or impurities mixed into the ink IK. Thus, it is possible to manufacture a higher quality cartridge. The exhaust step S20 can also be omitted.

At the filling step S30, ink is filled into the chamber 109. The exhaust step S20 and the filling step S30 can be implemented using various methods. We will give a detailed description using working examples later regarding details of the exhaust step S20 and the filling step S30.

The information update step S40 is a step of rewriting the information relating to the ink consumption for the memory provided in the circuit substrate 14 of the cartridge 7 to usable values. When the ink is used and the ink residual volume of the cartridge 7 reaches a designated volume or lower, there are cases when information expressing that the ink residual volume has reached a designated value or less is stored in the memory. In this case, the printer 5 judges that there is no ink in the cartridge 7, and there are cases when it does not shift to a normal printing operation. With this embodiment, at the information update step S40, the information relating to ink consumption volume of the memory is updated to a usable value that shows that there is a designated value or greater of ink. By doing this, when the cartridge 7 is mounted in the printer 5, the printer 5 shifts to the normal printing operation. When it is sufficient merely to fill ink, step S40 is unnecessary. Also, the step S40 can also be implemented using other methods other than rewriting the storage device information, such as replacing the circuit substrate 141 or the like. Also, in the case of a new cartridge, step S40 can be implemented by writing information relating to ink in the memory, or attaching a circuit substrate equipped with memory in which this kind of information has been written to the cartridge.

Working Example 1

With working example 1, as a working example of the filling step S30, we will describe an example of providing a filling port 181 communicating directly with the chamber 109, and filling ink from this filling port 181. With FIG. 13, the filling port 181 is formed on the third wall 73 of the first case 62. The position at which the filling port 181 is formed can be any position communicating directly with the chamber 109, and is not limited to the position shown in FIG. 13. It can also be formed at another position of the third wall 73 of the first case 62. Also, the filling port 181 can be formed on any wall other than the third wall 73 as long as it is a position that communicates directly with the chamber 109, specifically, the first wall 71, the second wall 72, and the fourth wall 74 through the seventh wall 77. Furthermore, as with the prism unit 121 (FIG. 8) or the sheet member 123 (FIG. 8), it is also possible to form the filling port 181 at a location that can be regarded as a portion of the first case 62.

Figure 13:
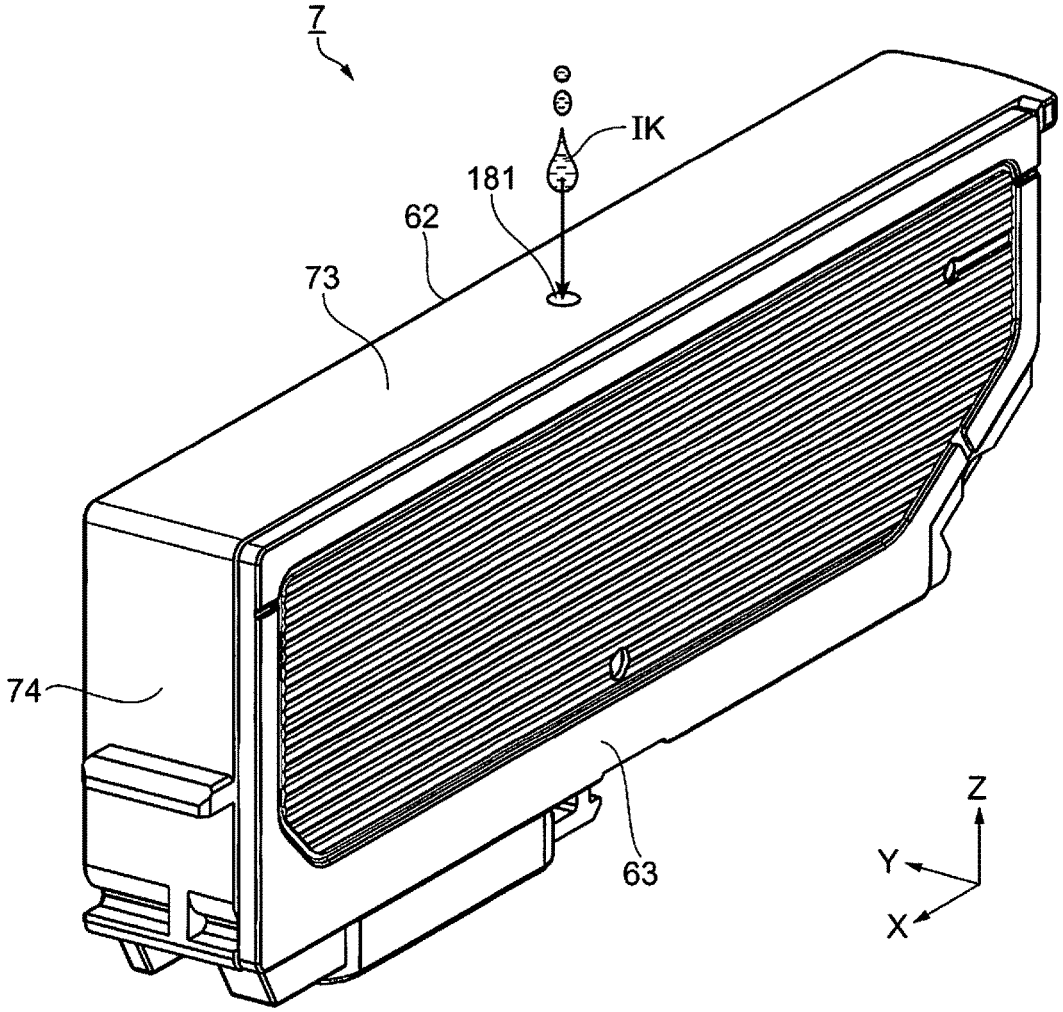
FIG. 13 is a perspective view showing the filling port with working example 1.

Then, as shown in FIG. 13, the ink IK can be filled from the filling port 181. With working example 1, when the filling port 181 is formed on the prism unit 121, the prism unit 121 has optical transparency, so it is easy to visually recognize the filling volume of the ink IK.

Figure 14:
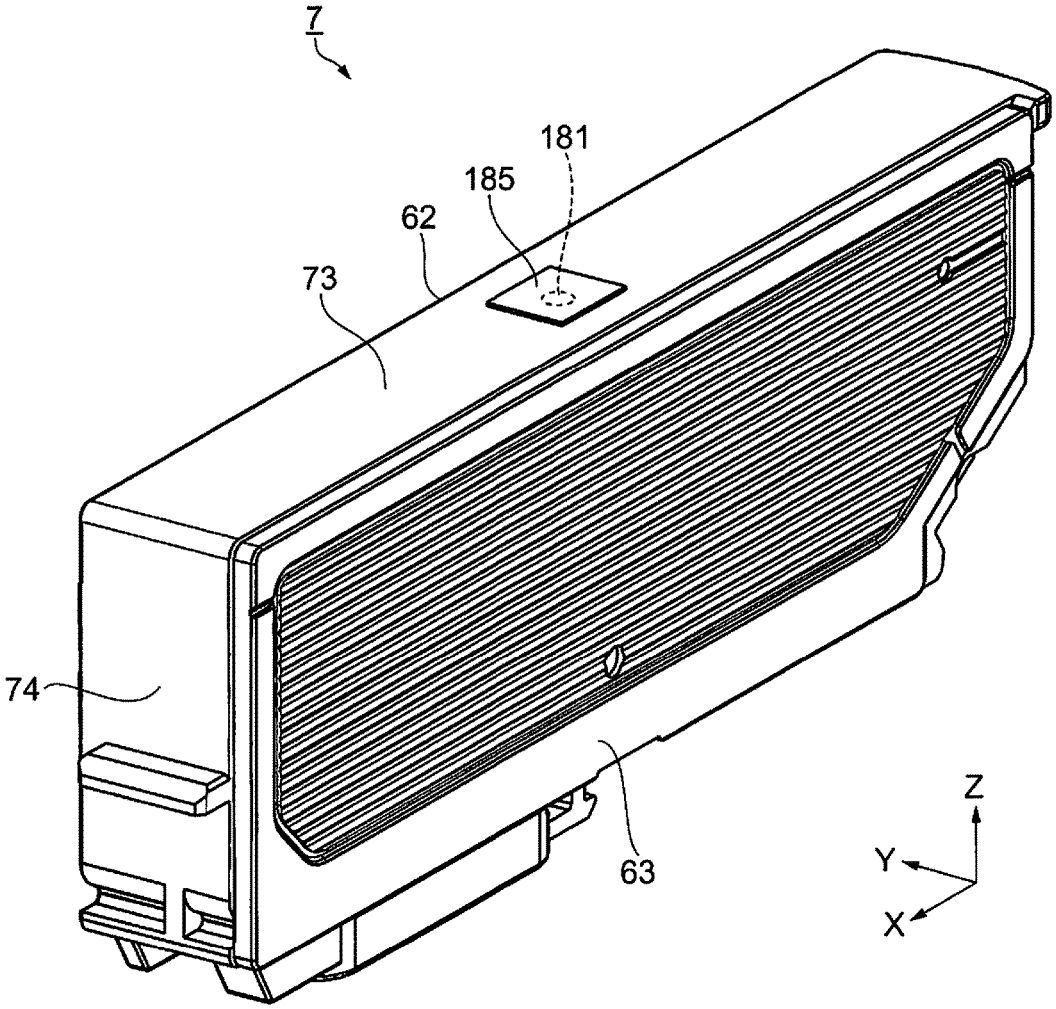
FIG. 14 is a perspective view showing the sealed filling port with working example 1.

After filling the ink IK, as shown in FIG. 14, the filling port 181 is sealed by a sealing member 185. With FIG. 14, shown is an example of sealing the filling port 181 by joining the sealing member 185 constituted by a plate member to the first case 62 using an adhesive agent for working example 1. As the sealing member 185, examples include a plate material or sheet material consisting of resin, rubber or the like, an adhesive agent, a plug or the like consisting of resin, rubber or the like. The method of sealing the filling port 181 is not limited to adhesion of a plate material. For example, before implementing the filling step S30, by having the filling port 181 closed with a sealing member 185 having a self sealing function, pricking a filling needle into the sealing member 185, and after filling the ink IK via the filling needle, removing the filling needle, it is possible to automatically seal the filling port 181 using a self sealing function of the sealing member 185. In this way, if the sealing member 185 having the self sealing function is used, it is easy to prevent inflow of air from the filling port 181 into the chamber 109 when removing the filling needle 229.

Working Example 2

With working example 2, as a second working example of the filling step S30, we will describe another example of providing the filling port 181 communicating directly with the chamber 109 and filling ink from this filling port 181. Compared to working example 1, with which the filling port 181 was formed on the first case 62, with working example 2, the filling port 181 is formed on the sheet member 107. Working example 2 differs from working example 1 by the position at which the filling port 181 is formed, but the remainder including the effects and modification examples are the same as working example 1.

Figure 15:
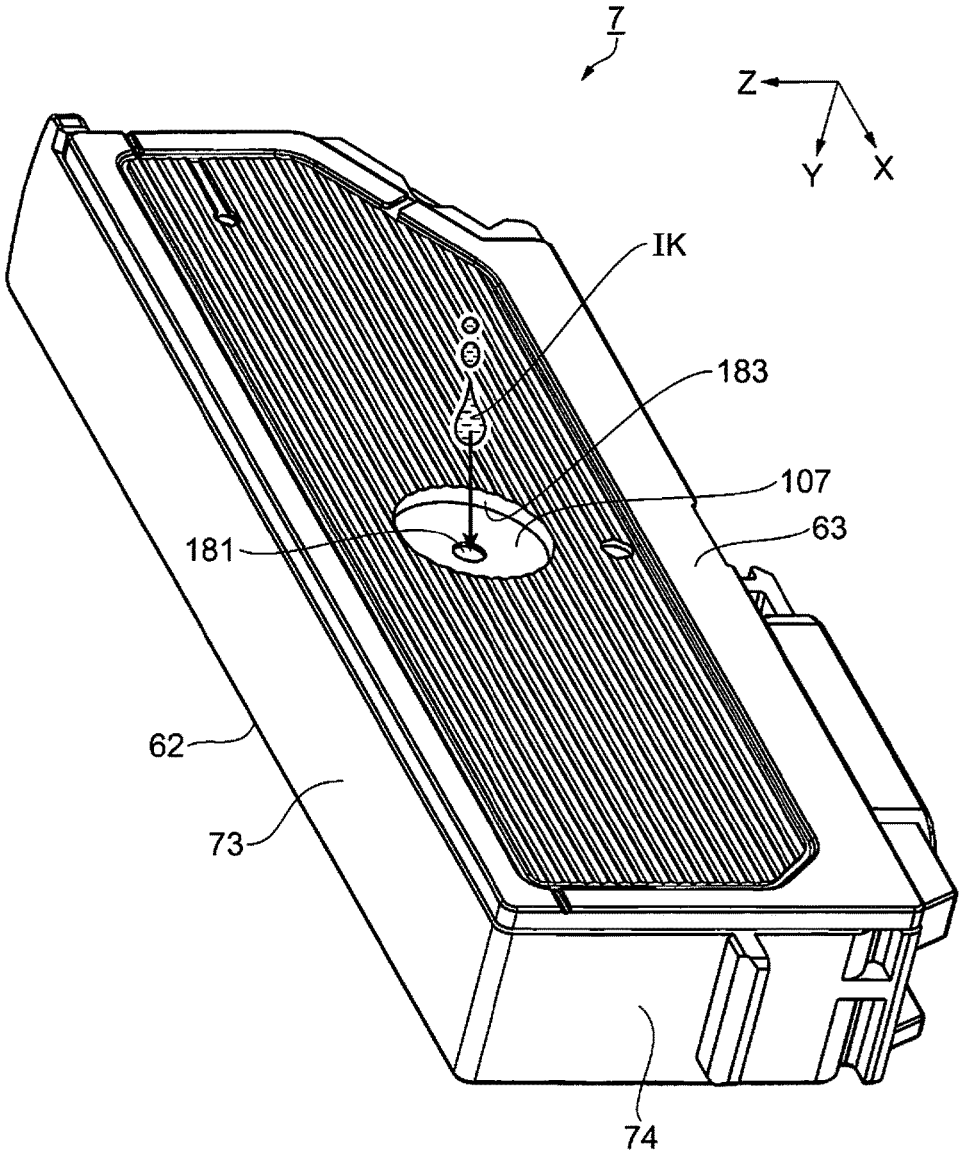
FIG. 15 is a perspective view showing the filling port with working example 2.
Figure 16:
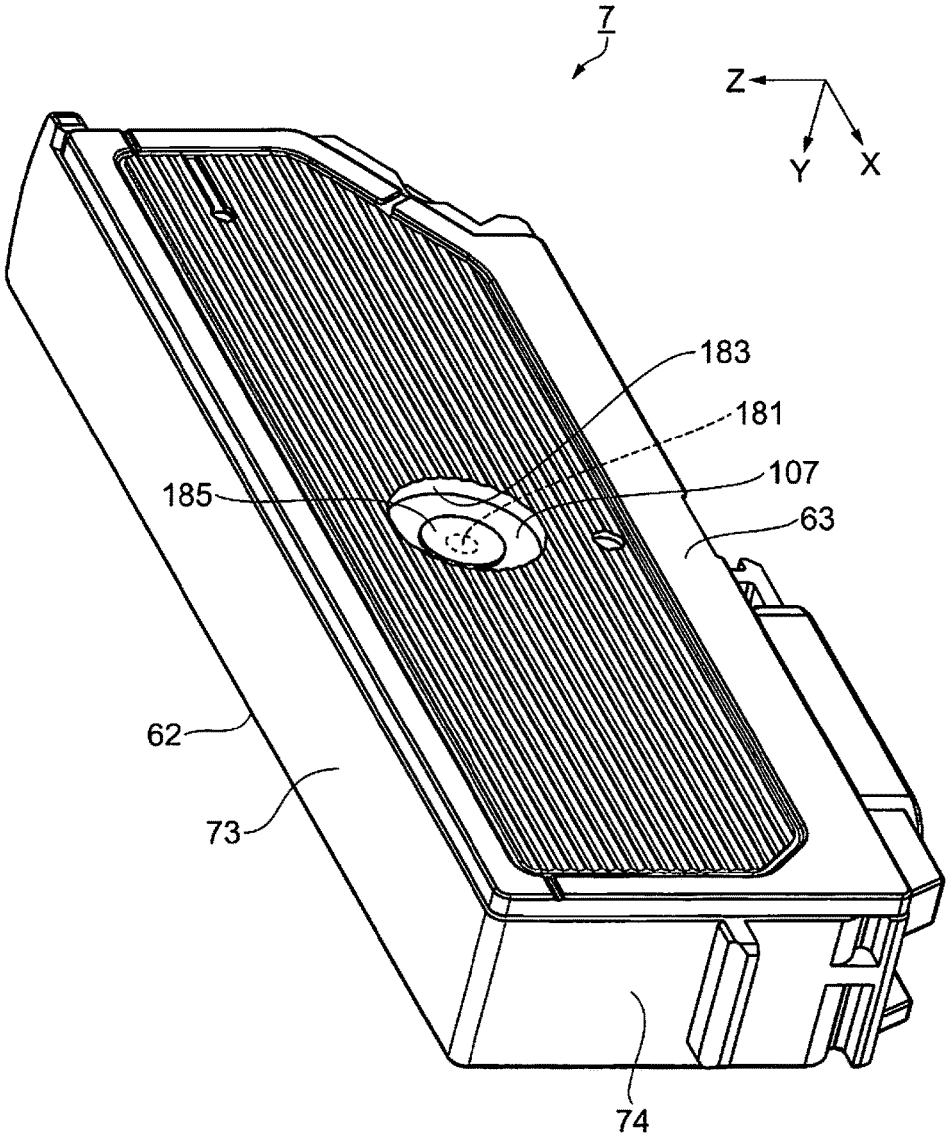
FIG. 16 is a perspective view showing the sealed filling port with working example 2.

With working example 2, as shown in FIG. 15, the filling port 181 is formed on the sheet member 107 via the opening part 183 provided on the second case 63. Then, after ink is filled from the filling port 181, as shown in FIG. 16, the filling port 181 is sealed.

The opening part 183 can be formed by removing a portion of the second case 63. Also, the position of the filling port 181 on the sheet member 107 is acceptable as long as it is a position that communicates directly with the chamber 109, and is not particularly limited. As the position of the filling port 181 on the sheet member 107, it is possible to be a position overlapping the pressure receiving plate 105, and also possible to be outside the area overlapping the pressure receiving plate 105. The opening part 183 can also be formed on the first case 62 rather than the second case 63. In other words, the opening part 183 can be formed by removing a portion of the case 61.

Any size and shape can be used for the opening part 183, and this is not limited to the relatively small circle shape like that shown in FIG. 15. By piercing the second case 63 and the sheet member 107 simultaneously using a tool such as a borer, it is also possible to simultaneously form the opening part 183 and the filling port 181. In this case, the opening part 183 has almost the same size and almost the same shape as the filling port 181.

Also, instead of forming the opening part 183 on the second case 63, it is also possible to remove all of the second case 63. When manufacturing a new cartridge, it is possible to implement the filling step S30 (FIG. 12) before joining the second case 63, specifically, in a state with the second case 63 not joined.

Here, the state with the second case 63 removed or the case with the second case 63 not joined are called a "state without the second case 63." The "state without the second case 63" is also included in removal of a portion of the case 61.

If put in a state without the second case 63, the chamber 109 is exposed, and it becomes easier to visually recognize the interior of the chamber 109. Thus, it is possible to implement the cartridge manufacturing work, especially filling the ink, with good efficiency. With working example 1, in a state without the second case 63, it is not essential to implement the filling step S30 (FIG. 12). However, with working example 1 as well, if the ink filling step is implemented in this kind of state, it is possible to implement the cartridge manufacturing work, especially filling the ink, with good efficiency.

Also, with working example 2, it is possible to use the following kind of method other than the kind of method described with working example 1 in regards to forming and sealing the filling port 181. First, after removing a portion of the case 61, before forming the filling port 181, the sealing member 185 having a self-sealing function is attached by adhesion or the like to a portion of the sheet member 107. Next, by pricking the filling needle so as to pierce through the sheet member 107 from above the sealing member 185, the filling port 181 is formed. Finally, after filling the ink IK via the filling needle, it is possible to seal the filling port 181 automatically using the self-sealing function of the sealing member 185. In this way, if the sealing member 185 having the self-sealing function is used, it is easier to prevent inflow of air from the filling port 181 into the chamber 109 when removing the filling needle 229.

Working Example 3

Figure 17:
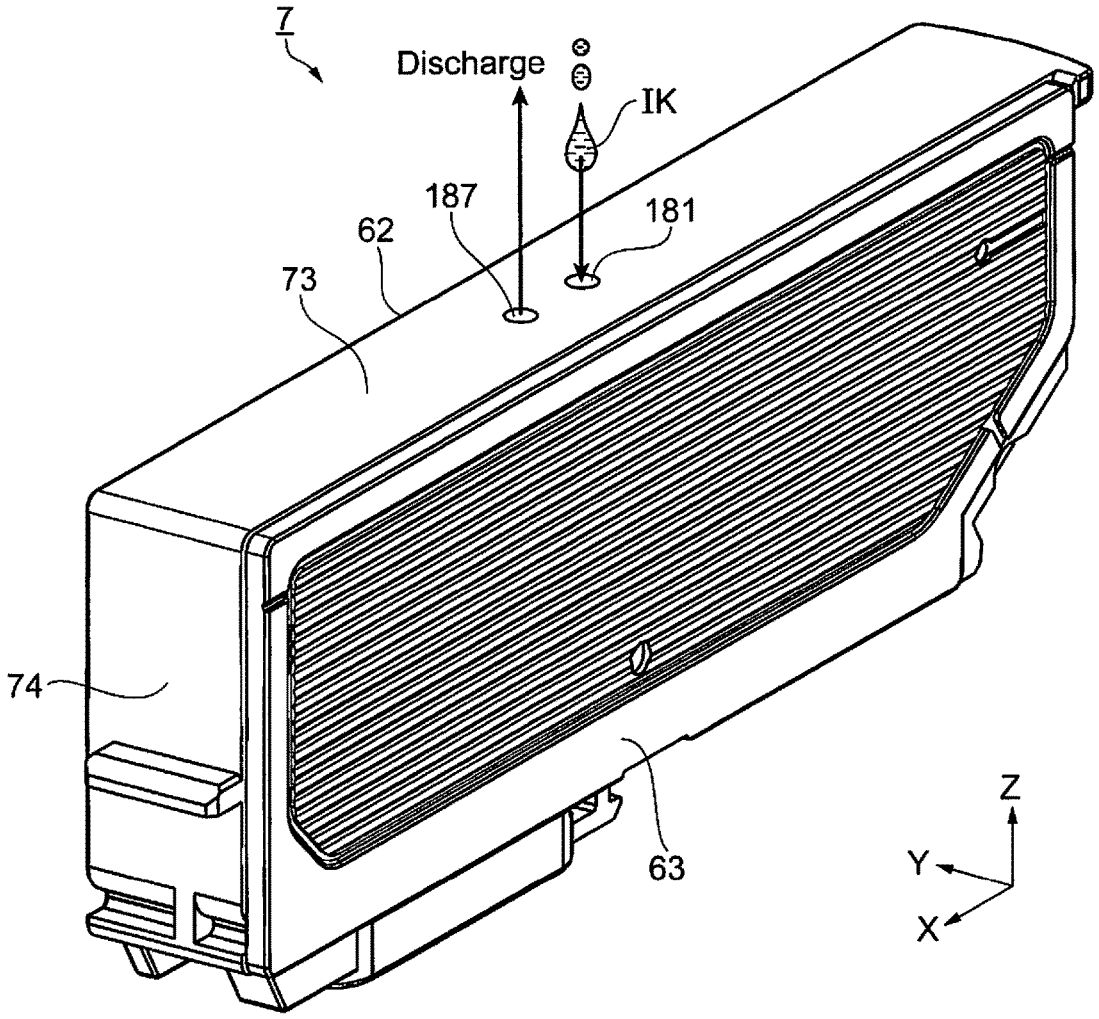
FIG. 17 is a perspective view showing the filling port and the exhaust port with working example 3.

With working example 3, in addition to the filling port 181, an exhaust port 187 is formed on the first case 62, and we will explain an example of the exhaust step S20 and the filling step S30 using the exhaust port 187. With working example 3, as shown in FIG. 17, in addition to the filling port 181 of working example 1 (FIG. 13 and FIG. 14), the exhaust port 187 is formed on the first case 62. The exhaust port 187 leads from the inside of the chamber 109 to outside the first case 62. Other than the point of using the exhaust port 187, this is the same as working example 1, including effects and modification examples.

With working example 3, when the ink IK is filled from the filling port 181, it is possible to allow air inside the chamber 109 to escape to outside the chamber 109 from the exhaust port 187. In other words, it is possible to fill the ink IK into the chamber 109 while allowing air from the chamber 109 to escape to outside the chamber 109 from the exhaust port 187. By doing this, it is easier to introduce the ink IK inside the chamber 109, so it is possible to shorten the time it takes for filling.

Also, with working example 3, it is also possible to implement the exhaust step S20 before filling the ink IK. For example, it is possible to clean the interior of the chamber 109 by filling a cleaning solution from the filling port 181 and exhausting the cleaning solution from the exhaust port 187. Alternatively, it is also possible to fill the cleaning solution from the exhaust port 187 and exhaust it from the filling port 181. By filling the ink IK after exhausting the substance inside the chamber 109, for example ink, air or the like by cleaning, it is possible to obtain a higher quality cartridge.

With working example 3, after ink filling has ended, the filling port 181 and the exhaust port 187 are sealed. For the exhaust port 187 sealing method, it is possible to use the same method as the filling port 181 sealing method. The sealing of the filling port 181 and the sealing of the exhaust port 187 can be implemented with either one implemented first, or with both implemented at the same timing.

The location for forming the exhaust port 187 is acceptable as long as it is a position that can directly communicate with the chamber 109, and the same as with the filling port 181 described previously, it is possible form it at various positions on the first case 62.

Also, other than the cleaning described previously, the exhaust step S20 can be implemented using the following kind of method. In a state with the chamber 109 essentially sealed tight (a state with the chamber 109 open to the outside at only the exhaust port 187), the interior of the chamber is suctioned from the exhaust port 187. Alternatively, in a state with a portion of the case 61 removed, and the chamber 109 in an essentially sealed tight state, in a state with the chamber 109 open to the outside (at only the exhaust port 187), the sheet member 107 is pressed in the direction that would compress the chamber. In either case, it is possible to exhaust the substance inside the chamber 109, for example ink, air or the like, from the exhaust port 187. Also, at the exhaust step S20, air is sent inside the chamber 109 from the filling port 181, and it is also possible to make it such that the substance inside the chamber 109 such as ink, debris or the like is exhausted from the exhaust port 187 by that pressure.

Working Example 4

Figure 18:
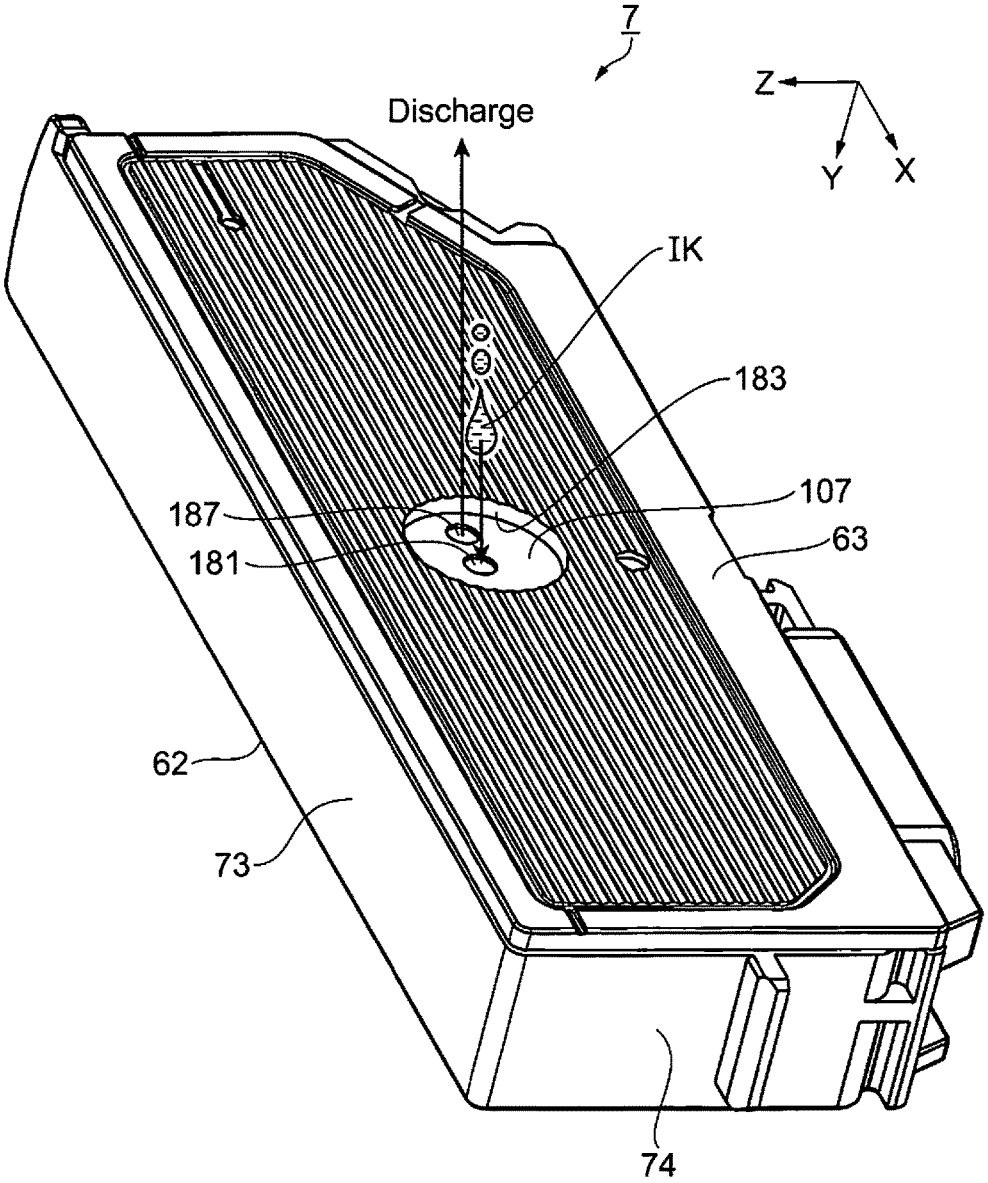
FIG. 18 is a perspective view showing the filling port and the exhaust port with working example 4.

With working example 4, in addition to the filling port 181, the exhaust port 187 is formed on the sheet member 107, and we will explain an example of using the exhaust port 187 with the exhaust step S20 and the filling step S30. With working example 4, as shown in FIG. 18, in addition to the filling port 181 of working example 2 (FIG. 15 and FIG. 16), the exhaust port 187 is formed on the sheet member 107. By using the exhaust port 187 with the exhaust step S20 and the filling step S30 in the same way as the exhaust port 187 of working example 3, the same effects are provided as those explained with working example 3.

With working example 4, after filling of the ink has ended, the filling port 181 and the exhaust port 187 are sealed. The exhaust port 187 can be sealed using the same method as the sealing method of the filling port 181 of working example 2 described previously. Sealing of the filling port 181 and sealing of the exhaust port 187 can be implemented with either before the other, or both can be implemented at the same timing.

The position at which the exhaust port 187 is formed is acceptable as long as it is a position that can directly communicate with the chamber 109, and the same as with the filling port 181 of working example 2 described previously, it is possible to form it at various positions on the sheet member 107. Also, as shown in FIG. 18, with working example 4, the filling port 181 and the exhaust port 187 are formed via the opening part 183. This opening part 183 can be formed with the same position, size, and shape as the opening part 183 of working example 2. With FIG. 18, the filling port 181 and the exhaust port 187 are formed via a common opening part 183. However, it is also possible to form these via separate opening parts. These kinds of separate opening parts can be formed using the same method as for the opening part 183 of working example 2. Also, by piercing two locations in the second case 63 and the sheet member 107 using a tool such as a borer, it is also possible to form the first opening part and the filling port 181 simultaneously, and to form the second opening part and the exhaust port 187 simultaneously. Also, the same as with working example 2, instead of forming the opening part 183 on the second case 63, it is also possible to have a state without the second case 63. If using the state without the second case 63, it is possible to implement the cartridge manufacturing work, particularly ink filling, with good efficiency.

In other words, for the filling port 181 and the exhaust port 187 of working example 4, either of these can be formed by removing a portion of the case 61, and the removed part can be at a common position at the filling port 181 and the exhaust port 187, or can be at different positions.

Working Example 5

Figure 19:
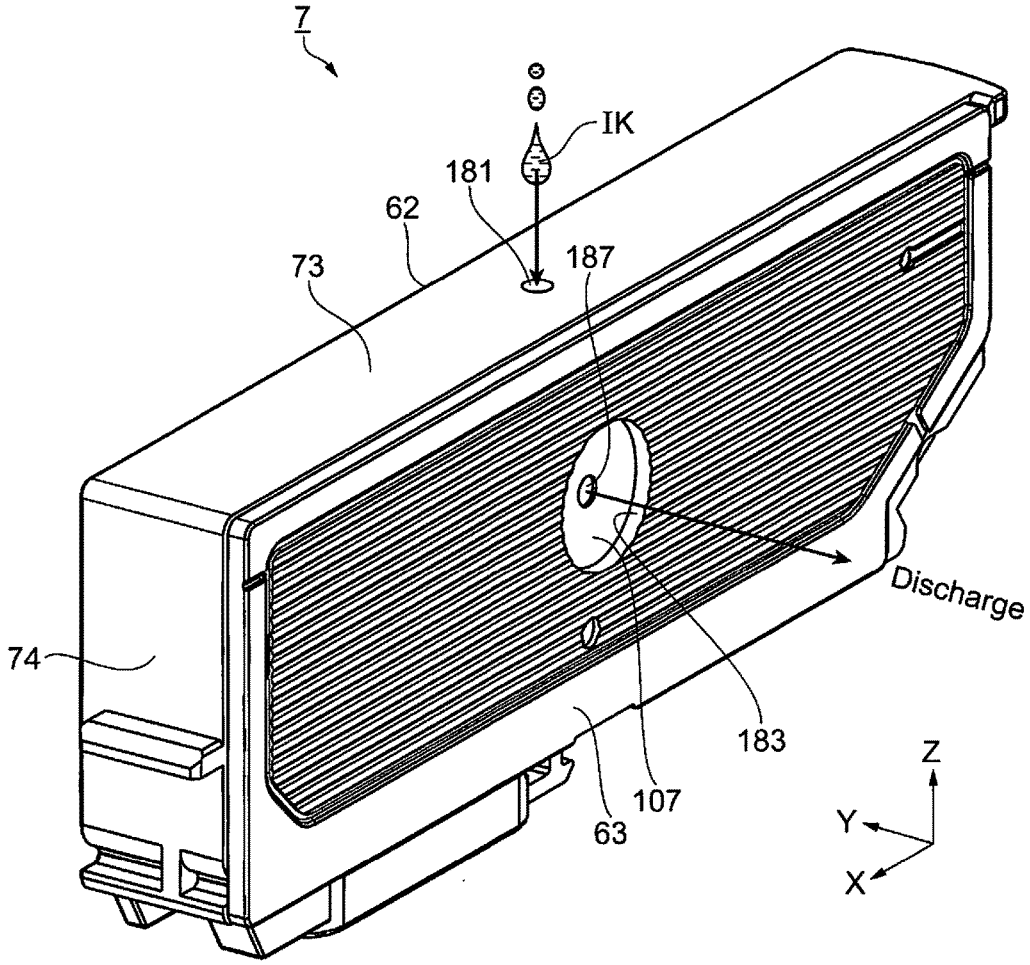
FIG. 19 is a perspective view showing the filling port and the exhaust port with working example 5.

With working example 5, the filling port 181 is formed on the first case 62, and the exhaust port 187 is formed on the sheet member 107, and we will describe an example of using the exhaust port 187 with the exhaust step S20 and the filling step S30. With working example 5, as shown in FIG. 19, in addition to the filling port 181 of the cartridge shown with working example 1 (FIG. 13 and FIG. 14), the exhaust port 187 is formed on the sheet member 107. This exhaust port 187, the same as with the filling port 181 of working example 2, can be formed using various methods in various positions. In FIG. 19, as an example, shown is the situation of the exhaust port 187 formed on the sheet member 107 via the opening part 183 provided on the second case 63. This exhaust port 187 also gives the same effects as described with working example 3 by using it in the same way as the exhaust port of working example 3.

With working example 5, after filling of the ink ends, the filling port 181 and the exhaust port 187 are sealed. The exhaust port 187 can be sealed using the same method as the sealing method of the filling port 181 of working example 2 described previously. Also, sealing of the filling port 181 and sealing of the exhaust port 187 can be implemented one before the other, or can be implemented with both at the same timing.

Working Example 6

Figure 20:
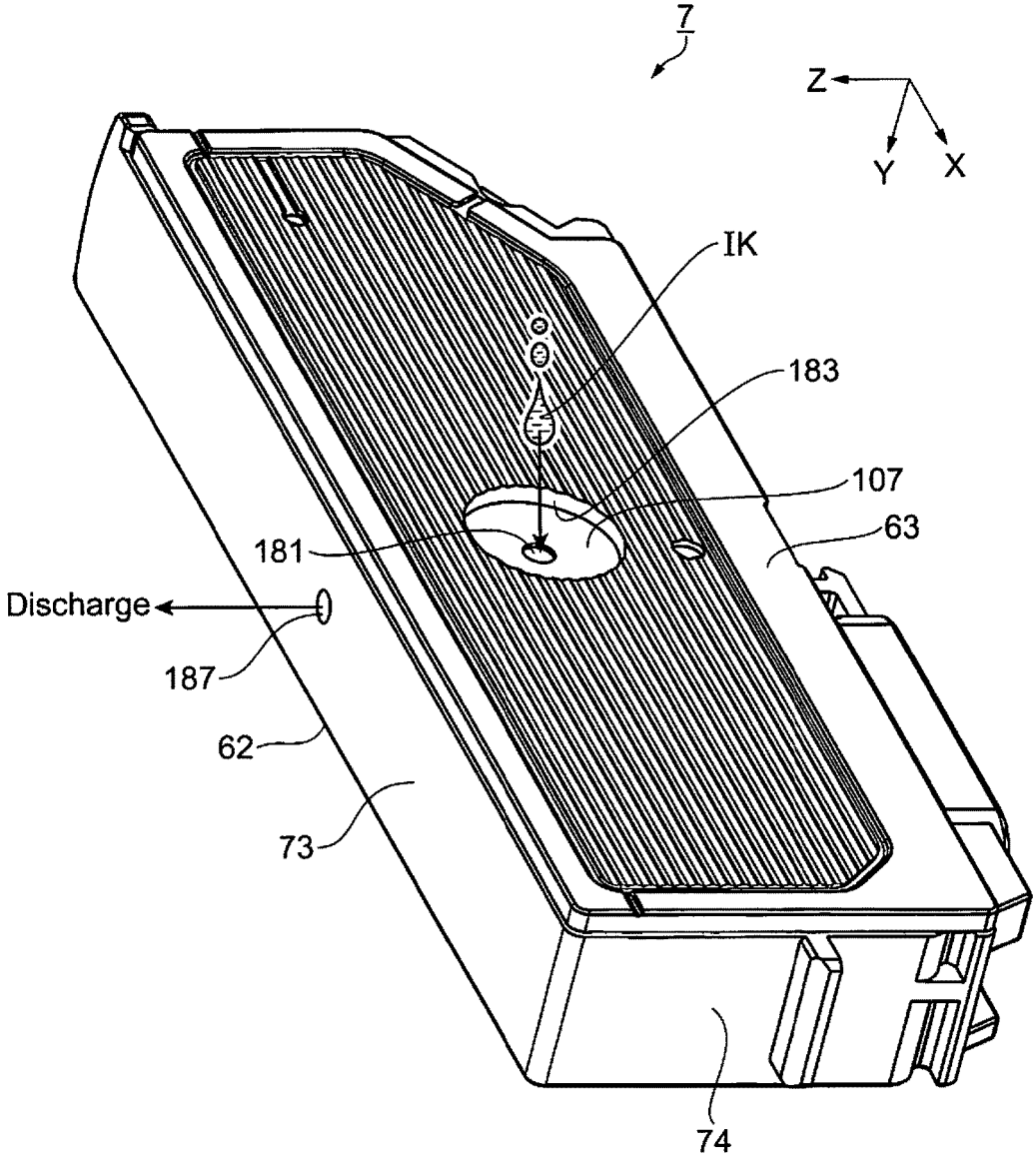
FIG. 20 is a perspective view showing the filling port and the exhaust port with working example 6.

With working example 6, the filling port 181 is formed on the sheet member 107, the exhaust port 187 is formed on the first case 62, and we will describe an example of using the exhaust port 187 with the exhaust step S20 and the filling step S30. With working example 6, as shown in FIG. 20, in addition to the filling port 181 of the cartridge shown with working example 2 (FIG. 15 and FIG. 16), the exhaust port 187 is formed on the first case 62. This exhaust port 187, the same as with the filling port 181 of working example 1, can be formed using various methods at various positions. With FIG. 20, as one example, shown is the situation with the exhaust port 187 formed near the center of the third wall 73. This exhaust port 187 provides the same effects as described with working example 3 by using in the same manner as the exhaust port of working example 3.

With working example 6, after filling of the ink ends, the filling port 181 and the exhaust port 187 are sealed. The exhaust port 187 can be sealed using the same method as the filling port 181 of working example 1 described previously. Also, sealing of the filling port 181 and sealing of the exhaust port 187 can be implemented one before the other, or both can be implemented at the same timing.

Working Example 7

Figure 21:
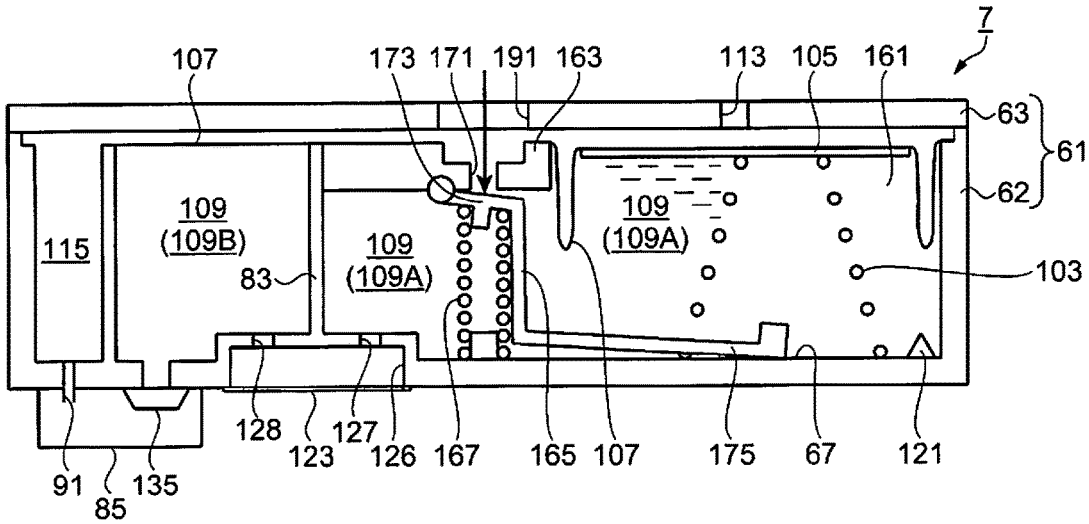
FIG. 21 is a cross section view typically showing the situation when the air introduction port is forcibly opened with working example 7.

Instead of providing the exhaust port 187 of working example 3 through working example 6, it is possible to have the air introduction port 171 in an open state, and use this as the exhaust port. By using the air introduction port 171 as the exhaust port, it is possible to obtain the same effects as of working example 3 to working example 6. With exhaust step S20 and filling step S30, for a specific method using an exhaust port, since this is as was described with working example 3, a detailed explanation will be omitted. With this method, it is possible to omit the exhaust port 187. To put the air introduction port 171 in an open state, as shown in FIG. 21, for example it is possible to have an external force act in the arrow direction shown in the drawing on the valve section 173. Specifically, it is possible to forcibly open the air introduction port 171 by pressing the valve section 173.

Figure 22:
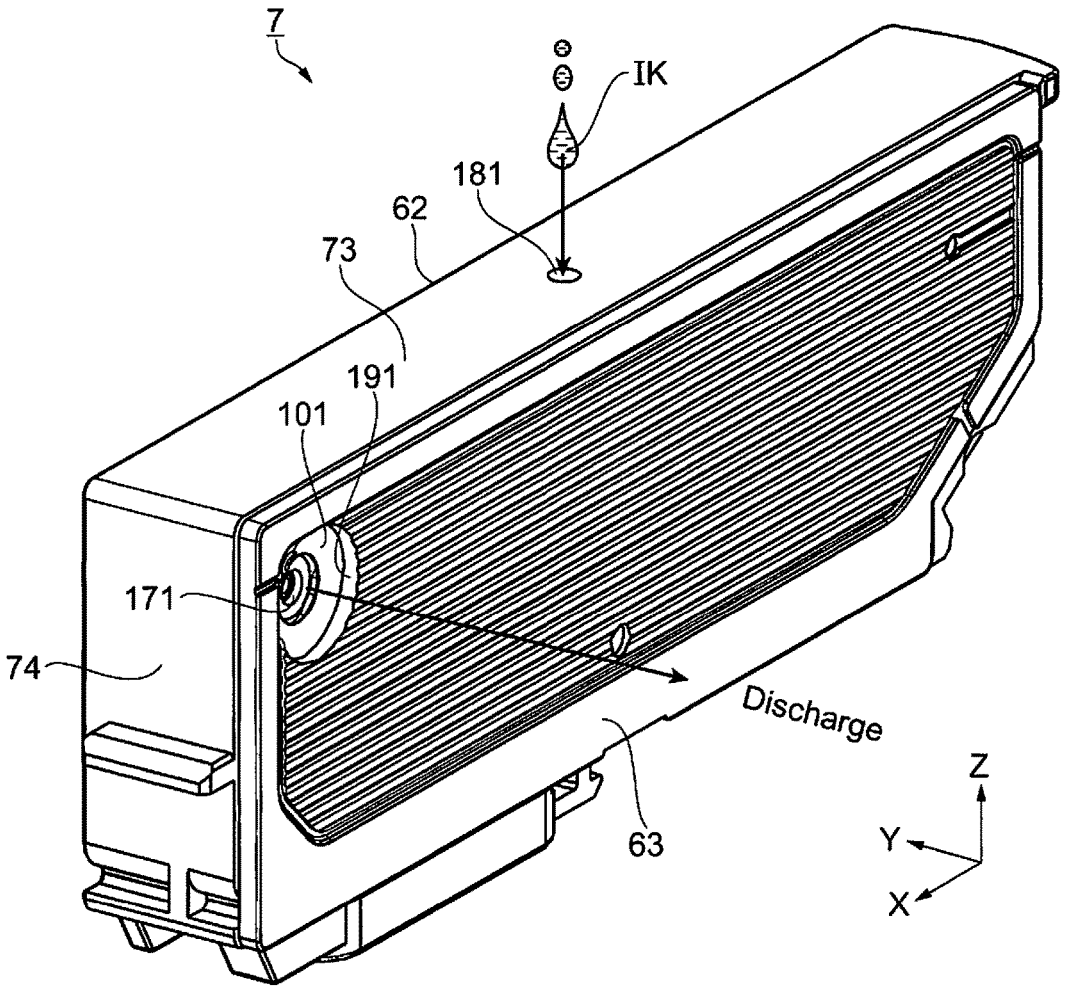
FIG. 22 is a perspective view of working example 7, showing the situation when the air introduction port is used as the exhaust port for the working example 1.
Figure 23:
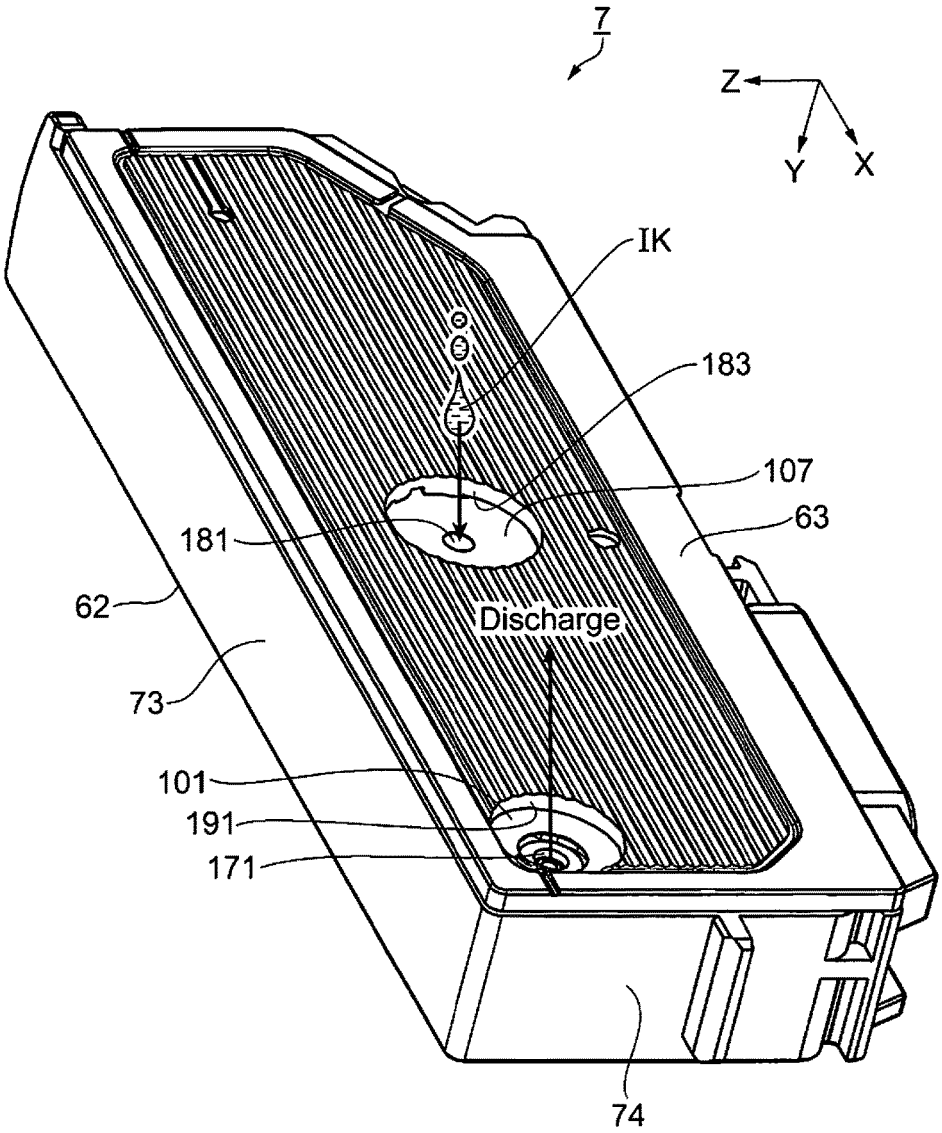
FIG. 23 is a perspective view of working example 7, showing the situation when the air introduction port is used as the exhaust port for the working example 2.

FIG. 22 shows an example of using the air introduction port 171 as the exhaust port for working example 1 noted above. Also, FIG. 23 shows an example of using the air introduction port 171 as the exhaust port for working example 2 noted above. In either case, an opening part 191 is formed on the second case 63. The opening part 191 is formed in the area overlapping the air introduction port 171 when the second case 63 is seen with a planar view in the Y axis direction. It is possible to have the air introduction port 171 exposed using the opening part 191. Then, by having an external force act on the valve section 173 via the opening part 191, it is possible to have the air introduction port 171 in an open state.

The position at which the opening part 191 is formed is acceptable as long as it is a position for which it is possible to expose the air introduction port 171, and is not limited to the positions in FIG. 21 through FIG. 23. The size and shape of the opening part 191 can be anything, and is not limited to the relatively small circle shape like that shown in FIG.

21 through FIG. 23. It is also possible to press the valve section 173 simultaneous with piercing the second case 63 using a tool such as a borer. Also, instead of forming the opening part 191 on the second case 63, it is also possible to have a state without the second case 63. If using the state without the second case 63, it is possible to implement cartridge manufacturing, particularly ink filling, with good efficiency.

In other words, it is possible to have the air introduction port 171 exposed by removing a portion of the case 61.

With working examples 3 through 6, after ink filling has ended, the exhaust port 187 was sealed. With working example 7, by having the air introduction port 171 in a closed state, it is possible to seal the air introduction port 171 as the exhaust port 187. In specific terms, by removing the external force that was acting on the valve section 173 (force in the arrow direction in FIG. 21), the air introduction port 171 closes. Also, if the valve section 173 is broken in the process of forcibly opening the air introduction port 171, it is possible to seal the air introduction port using the same method as with working examples 3 through 6. Sealing of the filling port 181 and sealing of the air introduction port 171 as the exhaust port (work of putting the air introduction port 171 in a closed state) can be implemented one before the other, or both can be implemented with the same timing.

With working example 7, it is possible to omit the exhaust port 187, so it is possible to manufacture the cartridge more easily than with working examples 3 through 6.

Working Example 8

Instead of providing the exhaust port 187 of working example 3 through working example 6, it is possible to use the supply port 85 as the exhaust port. By using the supply port 85 as the exhaust port, it is possible to obtain the same effects as working example 3 through working example 6. With the exhaust step S20 and the filling step S30, for the specific method using the exhaust port, this is as described with working example 3, so a detailed description is omitted. With this method, it is possible to omit the exhaust port 187.

Figure 24:
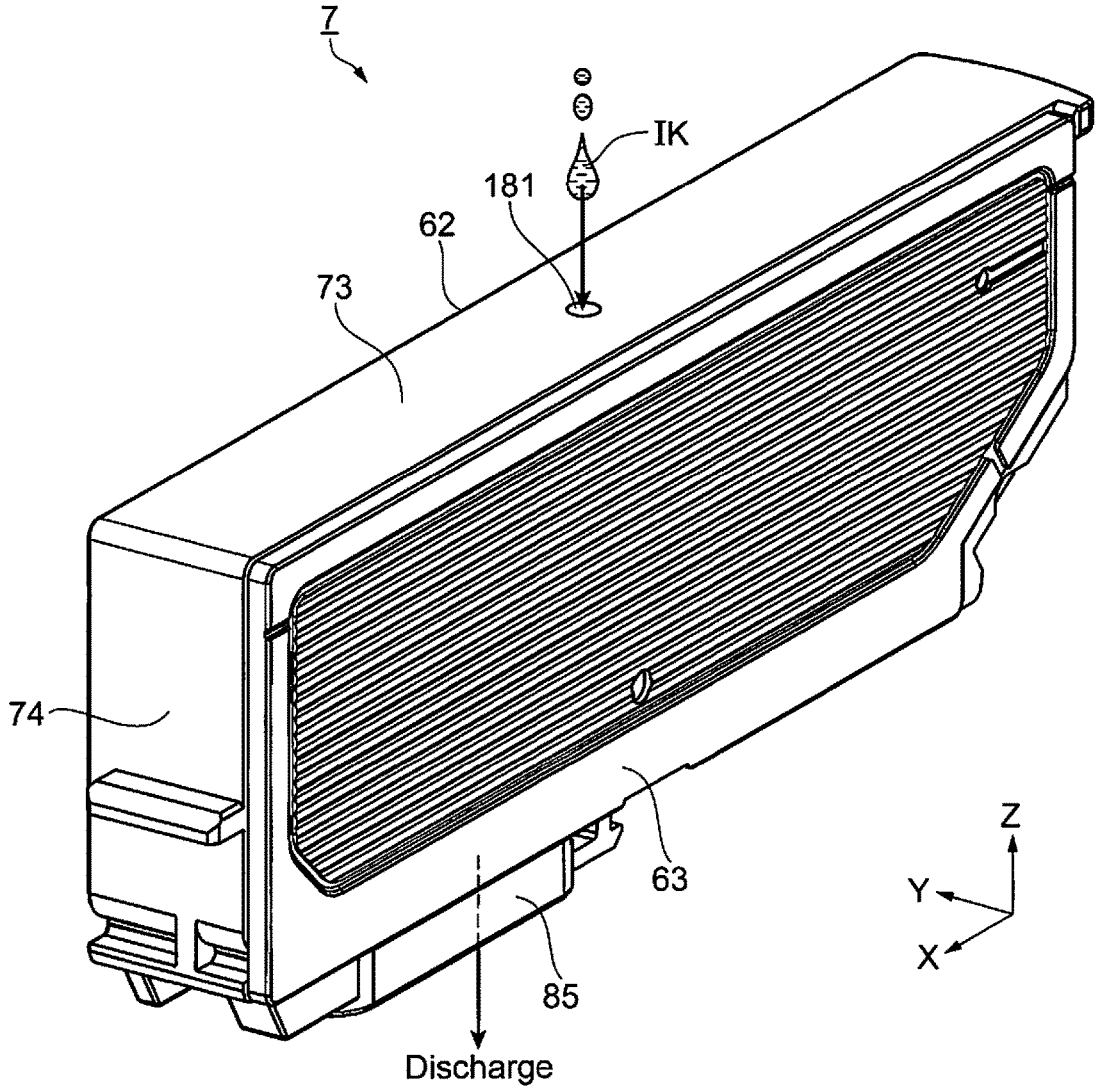
FIG. 24 is a perspective view of working example 8, showing the situation when the supply port is used as the exhaust port for the working example 1.
Figure 25:
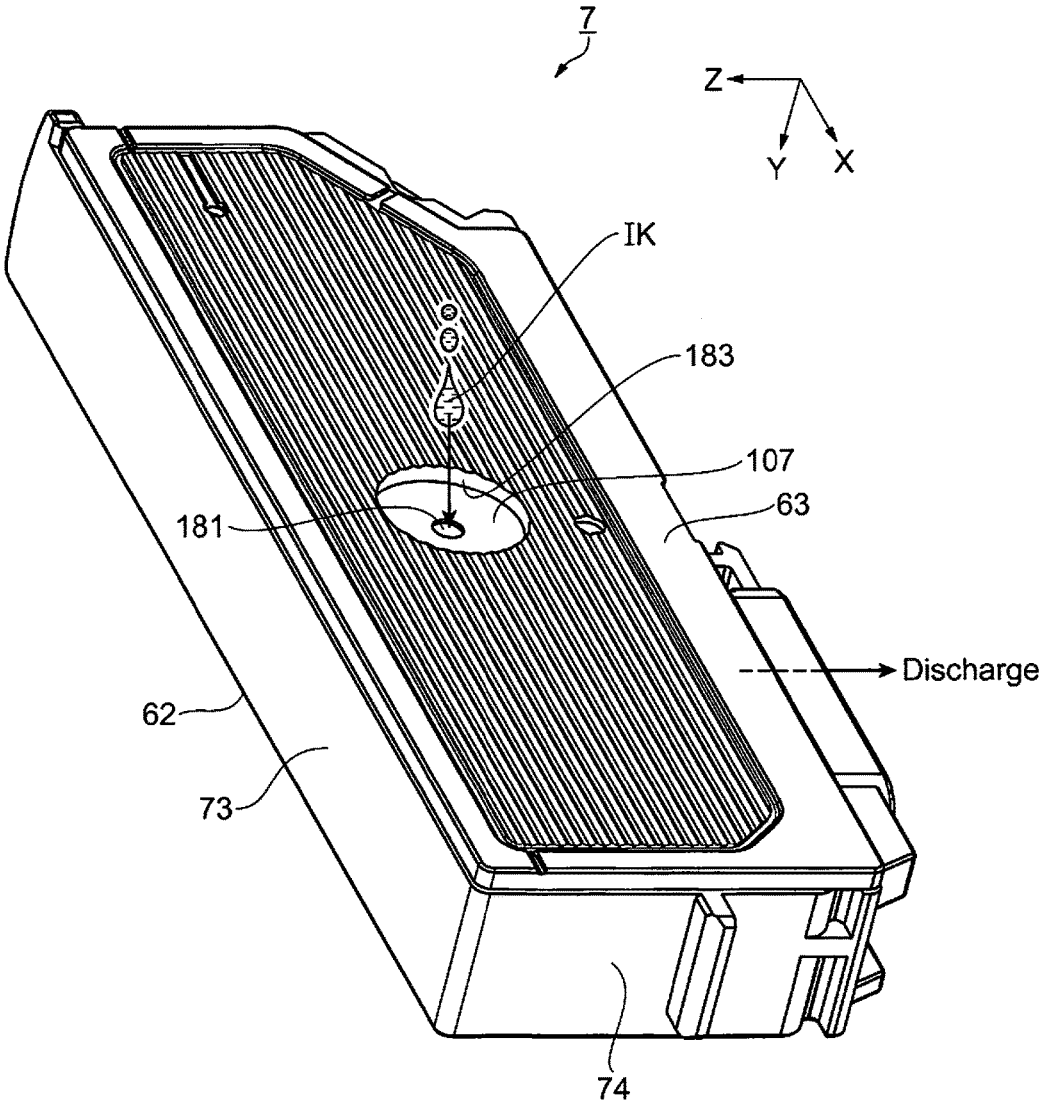
FIG. 25 is a perspective view of working example 8, showing the situation when the supply port is used as the exhaust port for the working example 2.

FIG. 24 shows an example of using the supply port 85 as the exhaust port for working example 1 noted above. Also, FIG. 25 shows an example of using the supply port 85 as the exhaust port for working example 2 noted above.

With working example 8, it is possible to omit the exhaust port 187, so it is possible to manufacture the cartridge more easily than with working examples 3 through 6. Also, because it is not necessary to expose and forcibly open the air introduction port 171, it is possible to manufacture the cartridge more easily than with working example 7.

Working Example 9

Figure 26:
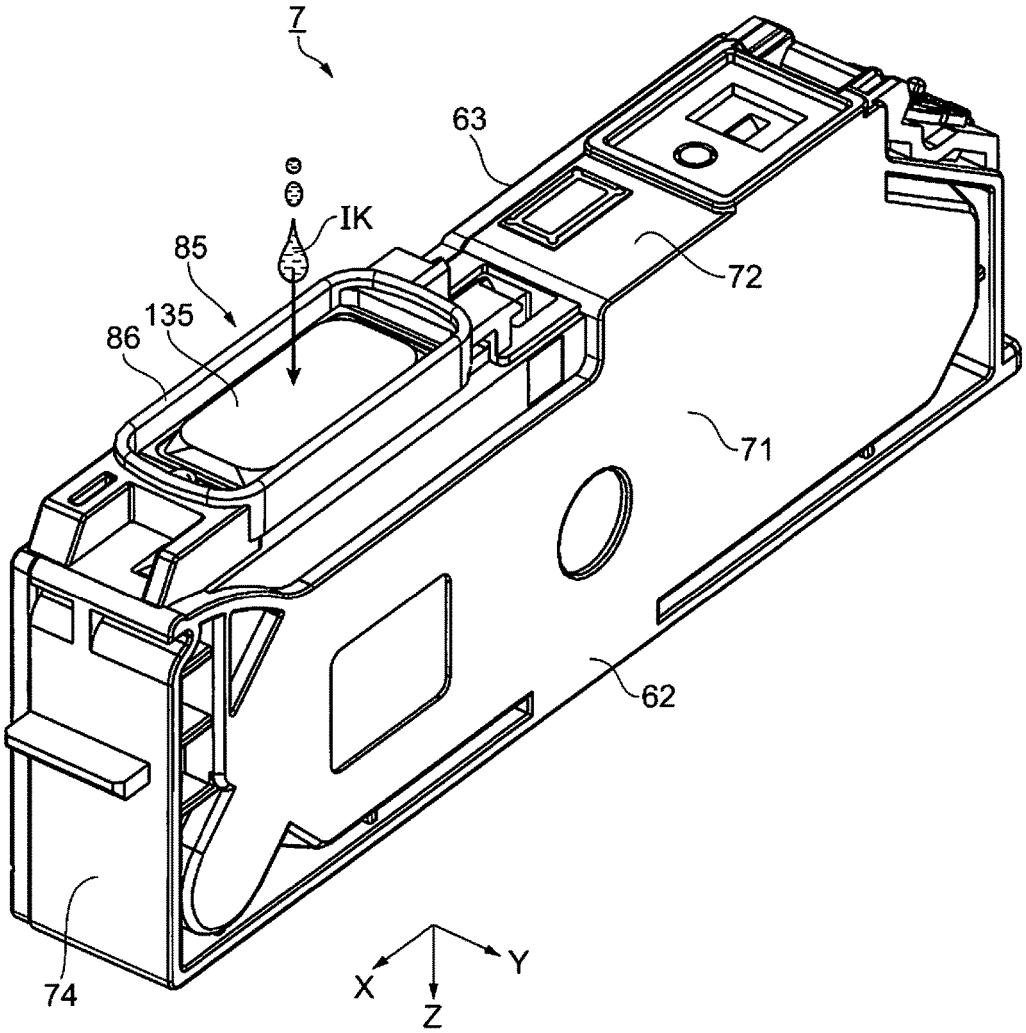
FIG. 26 is a perspective view for explaining the filling step with working example 9.

With working example 1 and working example 2 noted above, the filling port 181 is formed on the cartridge 7, and ink IK was filled inside the chamber 109 from this filling port 181. However, it is also possible to fill the ink IK inside the chamber 109 from the supply port 85 without forming the filling port 181. Working example 9 is an example of filling the ink IK inside the chamber 109 from the supply port 85 without forming the filling port 181. With working example 9, as shown in FIG. 26, the ink IK is filled from the supply port 85 via the filter 135. With the example shown in FIG. 26, in a state with the cartridge 7 oriented so that the supply port 85 is on top, the ink IK is made to be filled by being dripped from above. With working example 9, it is not necessary to form the filling port 181 and seal it as was the case with working example 1 and working example 2, so it is possible to manufacture the cartridge more easily than with the method of embodiment 1 and embodiment 2.

Working Example 10

Figure 27:
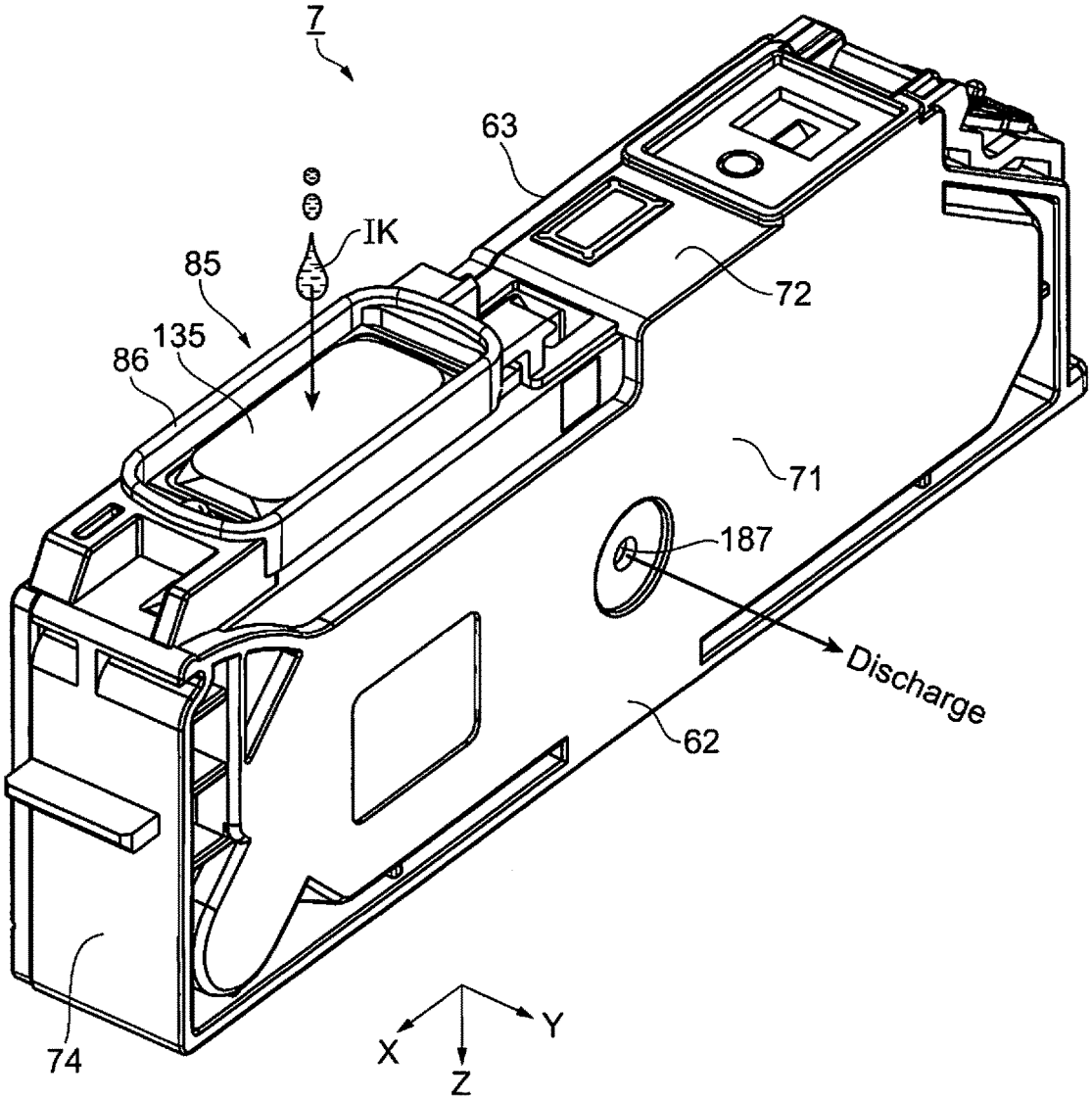
FIG. 27 is a perspective view showing the exhaust port with working example 10.

For the working example 9 noted above, the same as with working example 3 through working example 6, the exhaust port 187 is formed, and it is possible to use the exhaust port 187 with the exhaust step S20 and the filling step S30. FIG. 27 shows an example of forming the exhaust port 187 on the first wall 71 of the first case 62.

With the example shown in FIG. 27, the position at which the exhaust port 187 is formed, the same as with working example 3 and working example 6, is acceptable as long as it is a position that directly communicates with the chamber 109, and is not limited to being the first wall 71 of the first case 62.

Figure 28:
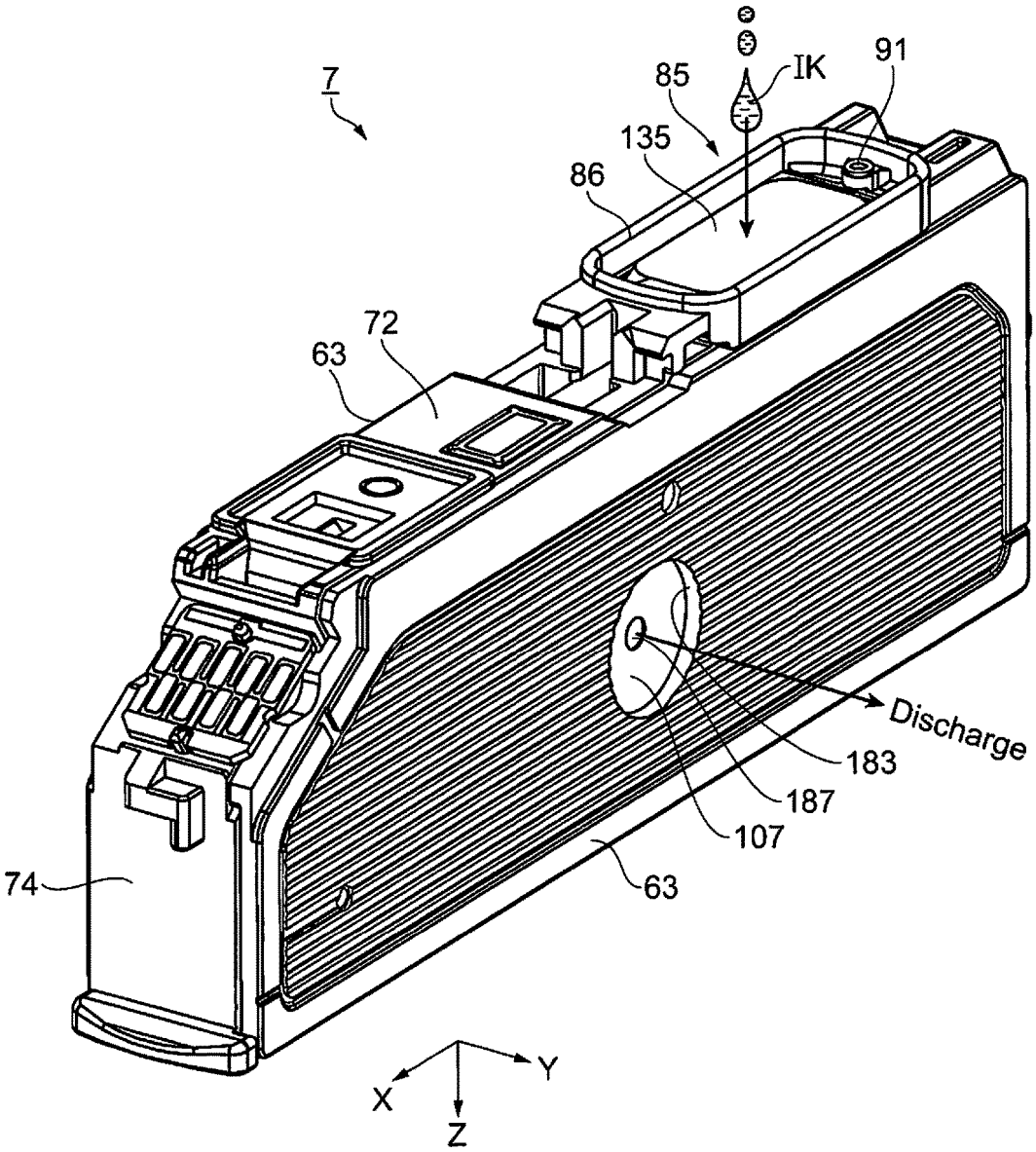
FIG. 28 is a perspective view showing the exhaust port with working example 11.

Furthermore, FIG. 28 shows an example of the exhaust port 187 formed on the sheet member 107. With the example shown in FIG. 28, the same as with working examples 4 and 5, the position at which the exhaust port 187 is formed is acceptable as long as it is a position that directly communicates with the chamber 109, and is not limited to being a position like that shown in FIG. 28.

These exhaust ports 187 bring the same effects as those explained with working example 3 through working example 6 by using in the same way as with the exhaust port 187 of working example 3 through working example 6. The position and shape of the exhaust port 187, the method of forming the exhaust port 187, and the method of sealing the exhaust port 187 are as described with working example 3 through working example 6 previously, so a detailed description is omitted.

Working Example 11

For working example 9 noted above, instead of providing the exhaust port 187 of working example 10, by having the air introduction port 171 in an open state and using this as the exhaust port, it is possible to obtain the same effects as working example 10. Also, with this method, it is possible to omit the exhaust port 187, so it is possible to obtain the same effect as working example 7. The method of putting the air introduction port 171 in an open state, and the method of sealing the air introduction port 171 as the exhaust port after ink filling ends are as with working example 7 described previously, so a detailed description will be omitted.

Figure 29:
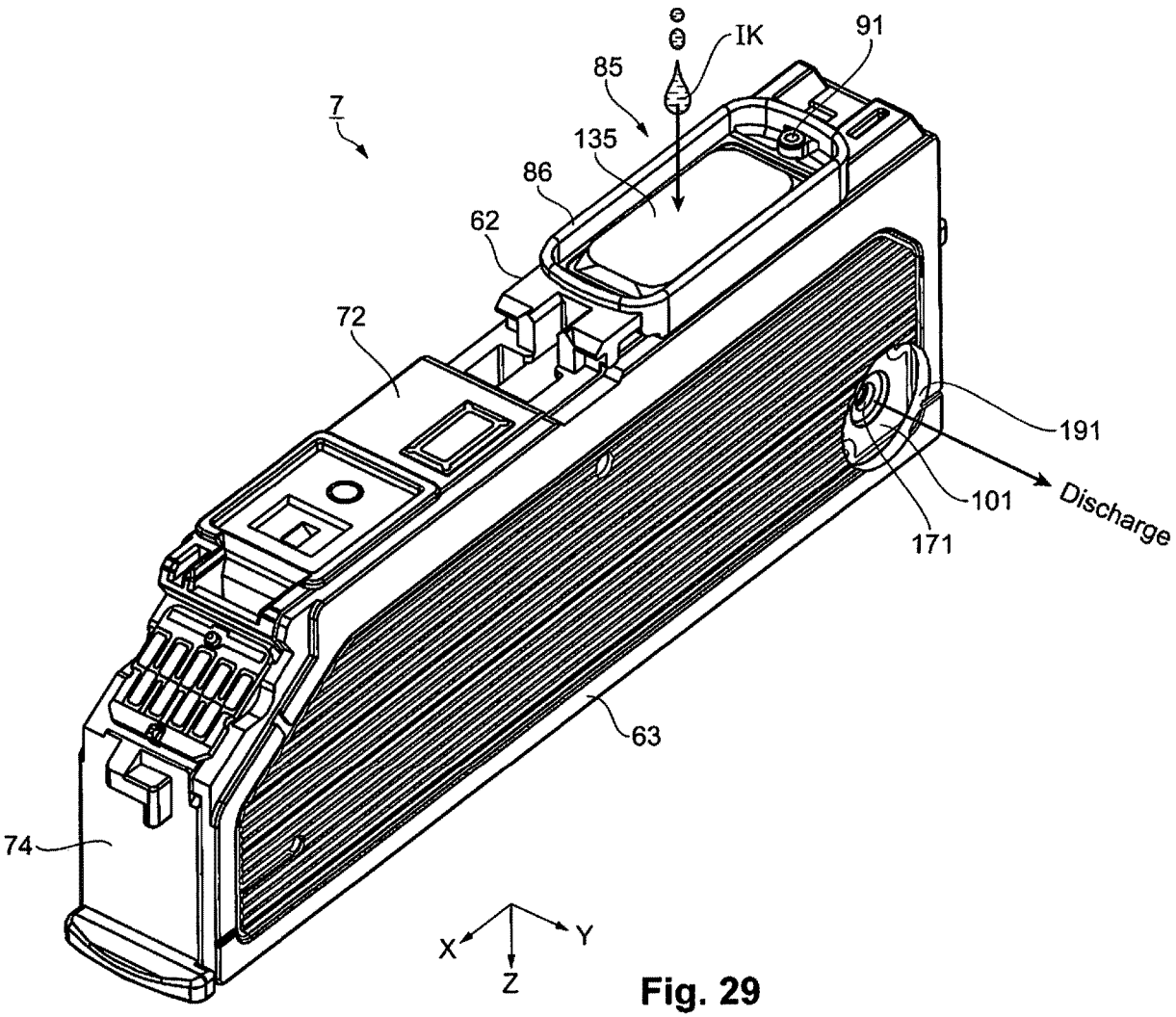
FIG. 29 is a perspective view of working example 11, showing the situation of using the air introduction port 171 as the exhaust port for the working example 9.

FIG. 29 shows an example of using the air introduction port 171 as the exhaust port for working example 9 noted above. With working example 11, the opening part 191 is formed on the second case 63, and the air introduction port 171 is pushed open from there. The opening part 191 can be formed at the same kind of position, size, shape, and using the same method as with the opening part 191 described with working example 7.

With working example 11, it is possible to omit the exhaust port 187, so it is possible to manufacture the cartridge more easily than with working example 10.

Working Example 12

By applying force that compresses the chamber 109 for working example 9 noted above, it is possible to implement the exhaust step S20. Also, by applying force that expands the capacity of the chamber 109, it is possible to implement the filling step S30. This kind of force can be applied by pressurizing or reducing pressure of the space outside the chamber 109.

Figure 30:
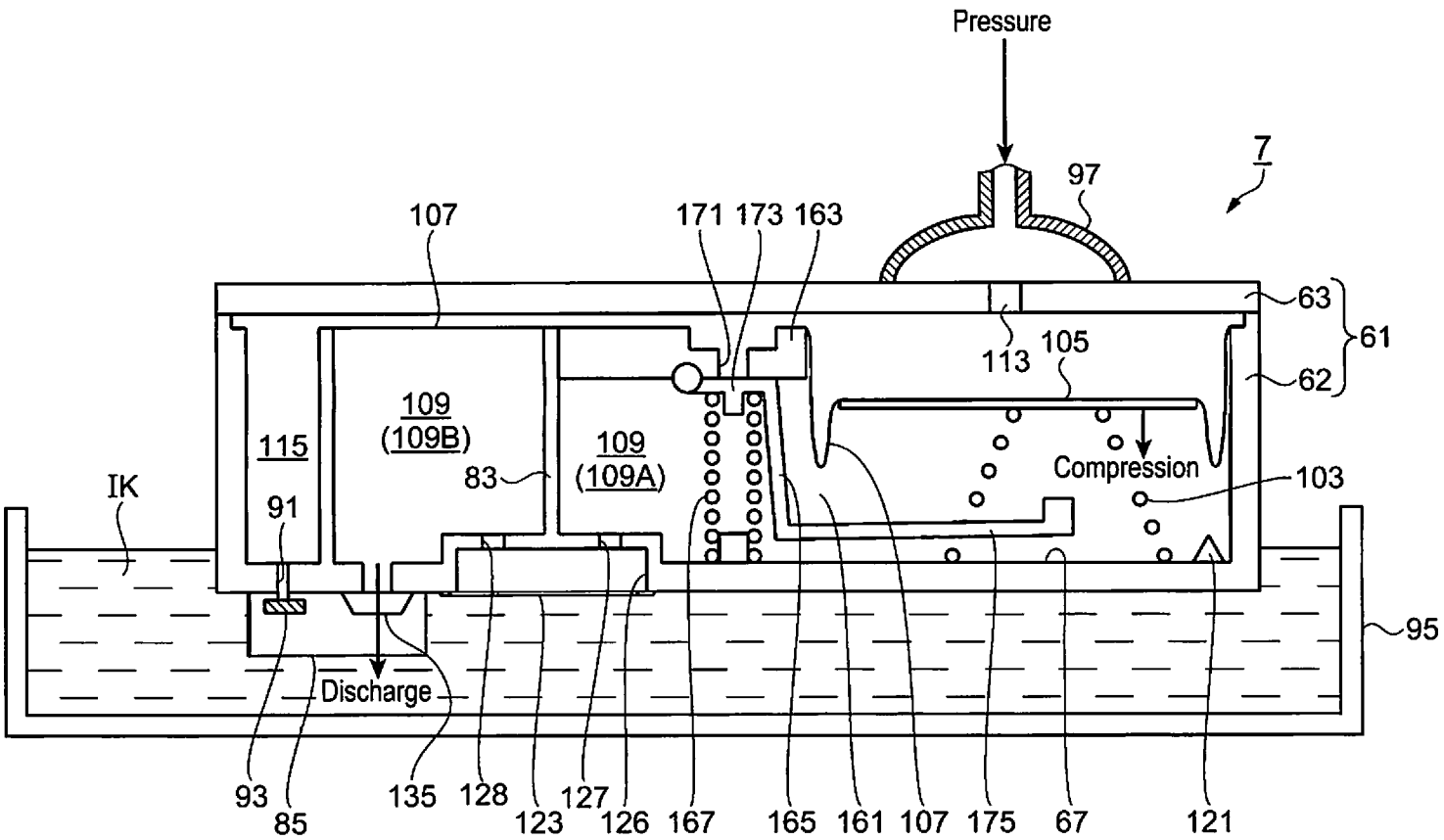
FIG. 30 is a cross section view typically showing the exhaust step with working example 12.
Figure 32:
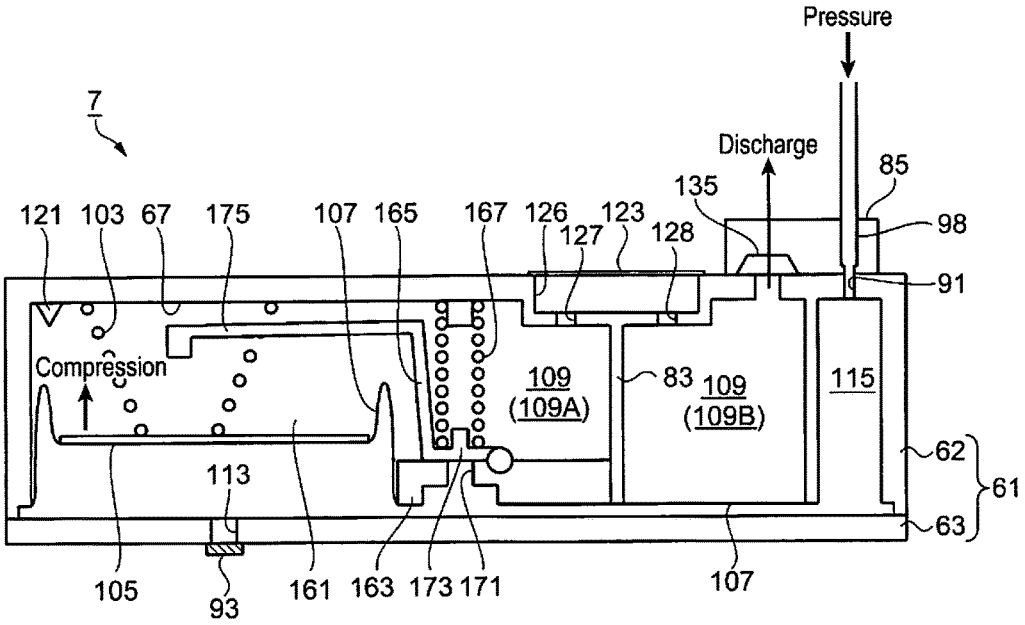
FIG. 32 is a cross section view typically showing the exhaust step with working example 12.

FIG. 30 and FIG. 32 show an example of exhausting the substance inside the chamber 109, for example ink, air or the like from the supply port 85 by pressurizing the space outside the chamber 109, specifically the air chamber 115, for working example 9.

Figure 31:
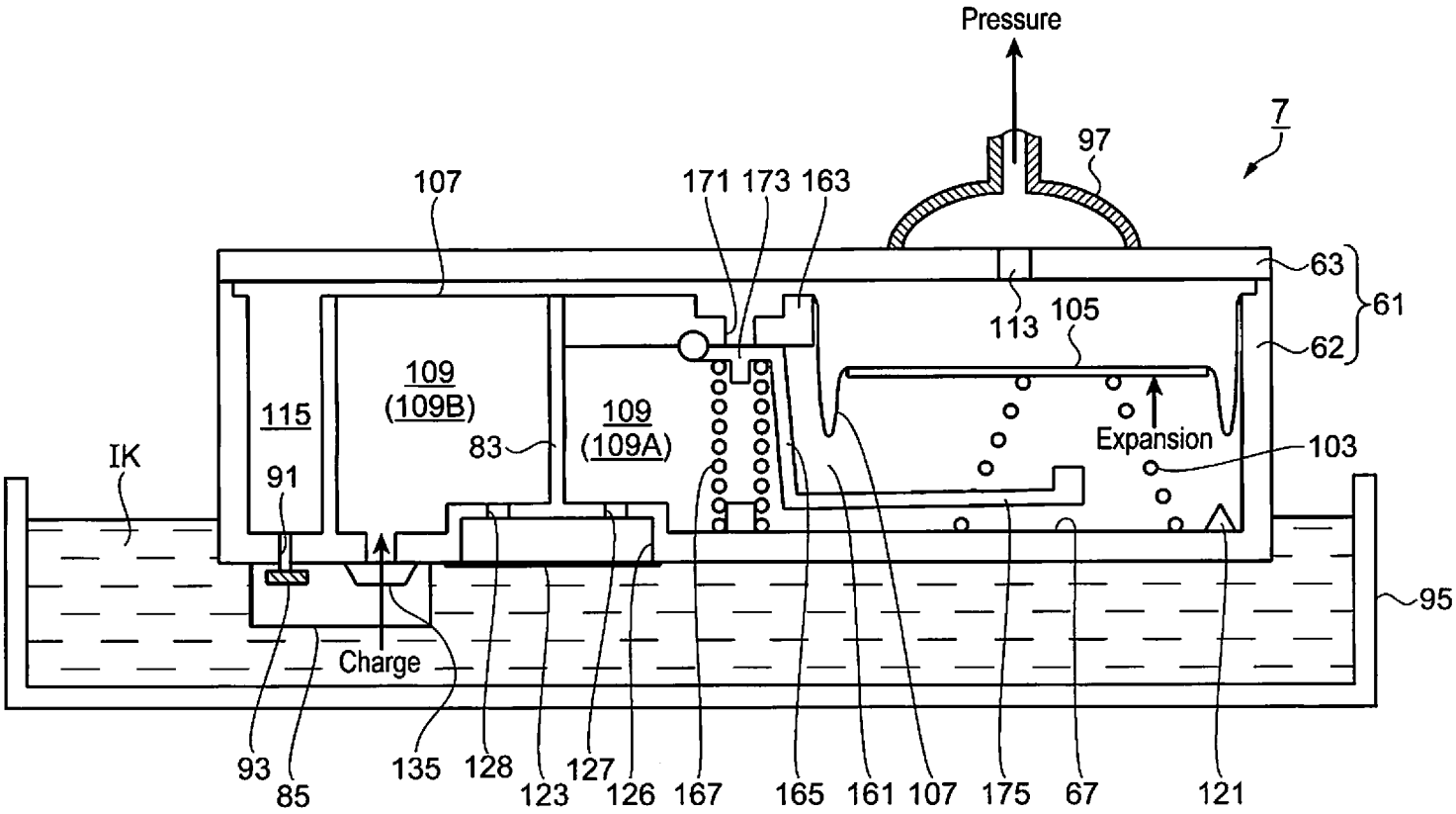
FIG. 31 is a cross section view typically showing the filling step with working example 12.
Figure 33:
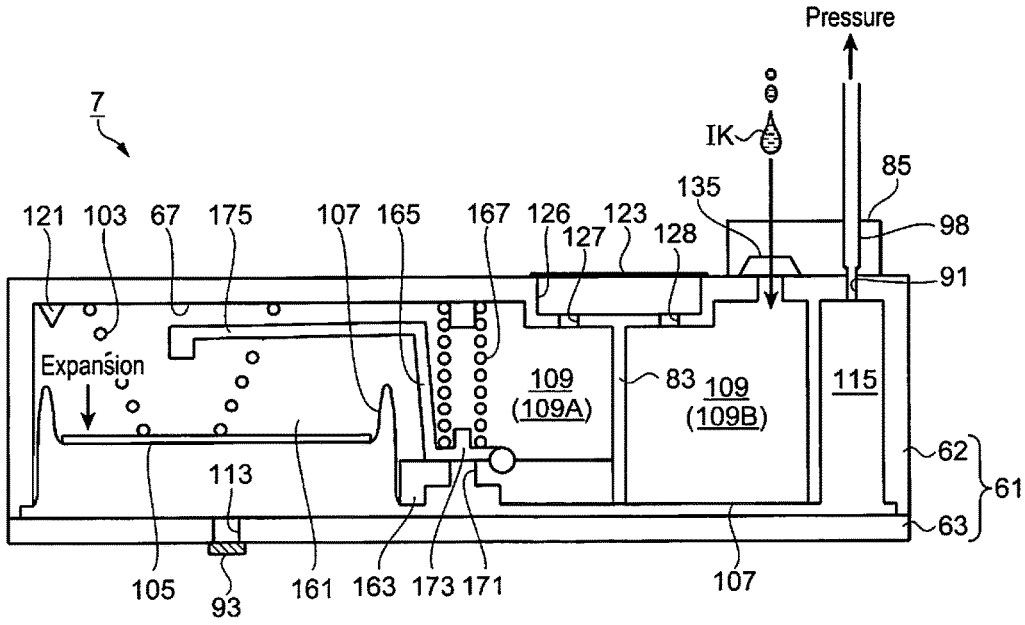
FIG. 33 is a cross section view typically showing the filling step with working example 12.

Also, FIG. 31 and FIG. 33 show an example of filling the ink IK in the chamber 109 by reducing the pressure of the space outside the chamber 109, specifically, the air chamber 115, for working example 9.

With the example shown in FIG. 30, so that ink or air does not flow in from the communication hole 91, the communication hole 91 is closed by a plug 93 or the like. Then, the supply port 85 is immersed in the ink tank 95. After that, a pressure addition and reduction device 97 is attached to the air communication hole 113, and as shown by the arrow in FIG. 30, pressurization of the cartridge interior is done via the air communication hole 113. Having done that, the air chamber 115 is pressurized, and the chamber 109 is compressed. By this force, the substance inside the chamber 109, for example ink, air or the like, is exhausted from the supply port 85. Next, the cartridge interior pressure is reduced by the pressure addition and reduction device 97. Specifically, the pressurization from the state of FIG. 30 is cancelled, and the air chamber 115 is returned to atmospheric pressure. Having done that, as shown by the arrow in FIG. 31, the air chamber 115 has pressure reduced, and the sheet member 107 is pulled in the direction that expands the capacity of the chamber 109. Then, by this force, the ink IK is drawn inside the chamber 109 from the supply port 85 via the filter 135.

Meanwhile, with the example shown in FIG. 32, the air communication hole 113 is closed by the plug 93 or the like, and a pressure addition and reduction device 98 is attached to the communication hole 91. Then, as shown by the arrow in FIG. 32, the cartridge interior is pressurized via the communication hole 91. Having done that, the air chamber 115 is pressurized, and the chamber 109 has the pressure reduced. By this force, the substance inside the chamber 109, for example ink, air or the like, is exhausted from the supply port 85. Next, the cartridge interior has the pressure reduced by the pressure addition and reduction device 98. In specific terms, the pressurization is cancelled from the state in FIG. 32, and the air chamber 115 is returned to atmospheric pressure. Having done that, as shown by the arrow in FIG. 33, the pressure is reduced for the air chamber 115, and the sheet member 107 is pulled in the direction that expands the capacity of the chamber 109. Then, by this force, the ink IK is pulled inside the chamber 109 from the supply port 85 via the filter 135.

With working example 12, by exhausting the substance inside the chamber 109, such as ink, air or the like, for example before filling the ink IK, it is possible to manufacture a higher quality cartridge. Also, when filling the ink IK, by giving a force so as to draw the ink IK into the chamber 109 by reducing the pressure outside the chamber 109, it is possible to shorten the time it takes for filling. Also, with this embodiment, it is possible to implement the exhaust step and the filling step without opening a hole or scratching the cartridge, so it is possible to manufacture the cartridge more easily than with working example 10 or working example 11. Furthermore, with the example shown in FIG. 30 and FIG. 31, pressurization and pressure reduction of the air chamber 115 is performed using the air communication hole 113. Also, with the example shown in FIG. 32 and FIG. 33, pressurization and pressure reduction of the air chamber 115 is performed using the communication hole 91. In this way, with working example 12, it is possible to continuously implement the exhaust step and the filling step using the same hole, so it is possible to manufacture the cartridge with good efficiency.

Working Example 13

Figure 34:
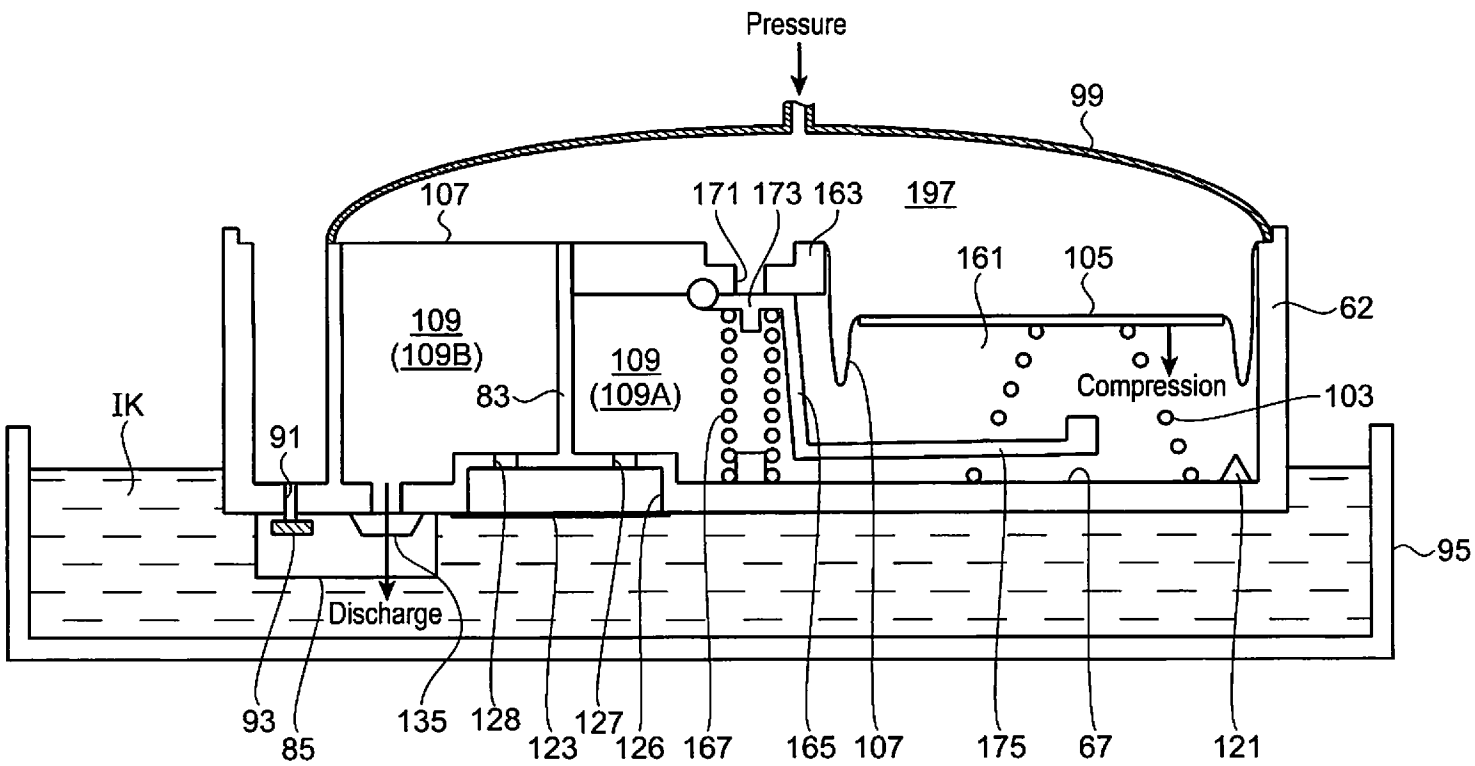
FIG. 34 is a cross section view typically showing the exhaust step with working example 13.
Figure 35:
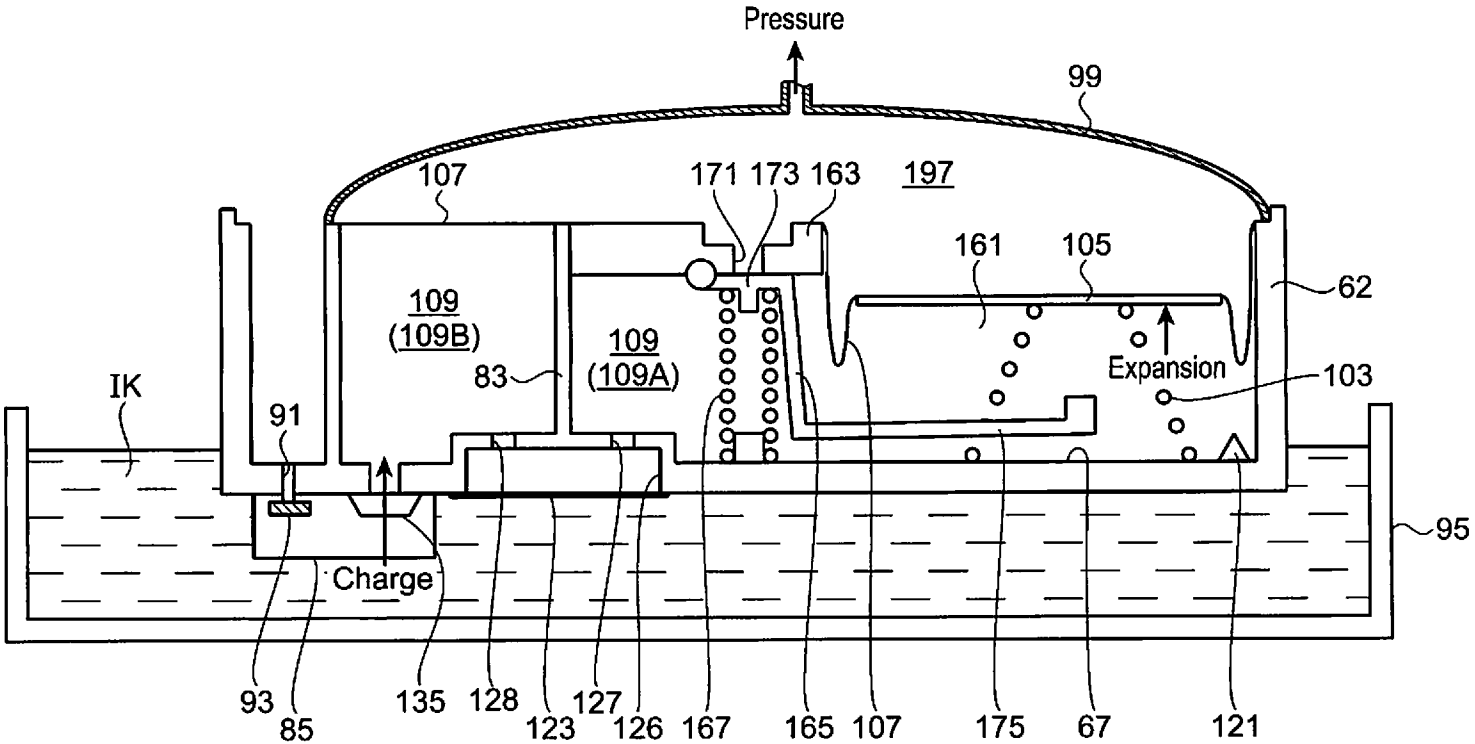
FIG. 35 is a cross section view typically showing the filling step with working example 13.

With working example 12, to give force that compresses or expands the chamber 109, the air communication hole 113 or the communication hole 91 was used to reduce the pressure of the air chamber 115. Instead of that, in a state without the second case 63, it is also possible to pressurize or reduce pressure of the space outside the chamber 109. FIG. 34 shows an example of applying force that compresses the chamber 109 in a state without the second case for the working example 9. Also, FIG. 35 shows an example of applying force that expands the capacity of the chamber 109 in a state without the second case for working example 9.

With working example 13, first, the second case 63 is removed. Also, in a state without the second case, the communication hole 91 is closed by a plug 93 or the like so as not to have ink or air flow in from the communication hole 91. Then, the supply port 85 is immersed in the ink tank 95. After that, as shown in FIG. 34, a pressure addition and reduction device 99 is attached to the side opposite to the chamber 109 of the sheet member 107. By doing this, the area corresponding to the chamber 109 is sealed. At this time, the airtight space 197 formed outside the chamber 109 by the pressure addition and reduction device 99 becomes the space corresponding to the air chamber 115 of working example 12. In that state, as shown by the arrow in FIG. 34, when the space 197 is pressurized, the chamber 109 is compressed. By this force, the substance inside the chamber 109, such as ink, air or the like, for example, is exhausted from the supply port 85. Next, the space 197 has pressure reduced by the pressure addition and reduction device 99. In specific terms, the pressurization is cancelled from the state in FIG. 34, and the space 197 is returned to atmospheric pressure. Having done that, as shown by the arrow in FIG. 35, the pressure is reduced for the space 197, and the sheet member 107 is pulled in the direction for which the capacity of the chamber 109 will expand. Then, by this force, the ink IK is drawn inside the chamber 109 from the supply port 85 via the filter 135.

With working example 13, by exhausting the substance inside the chamber 109, such as ink, air or the like, for example, before filling the ink IK, it is possible to manufacture a higher quality cartridge. Also, when filling the ink IK, by applying force that draws the ink IK inside the chamber 109 by reducing the pressure outside the chamber 109, it is possible to shorten the time taken for filling. Also, with this working example, it is possible to continuously implement the exhaust step and the filling step using the same space 197, so it is possible to manufacture the cartridge with good efficiency.

Working Example 14

With working example 12 and working example 13, the force for compressing or the force for expanding the chamber 109 was applied from outside the chamber. Instead of that, it is also possible to apply this kind of force by reducing the pressure of the chamber 109 from the supply port 85.

Figure 36:
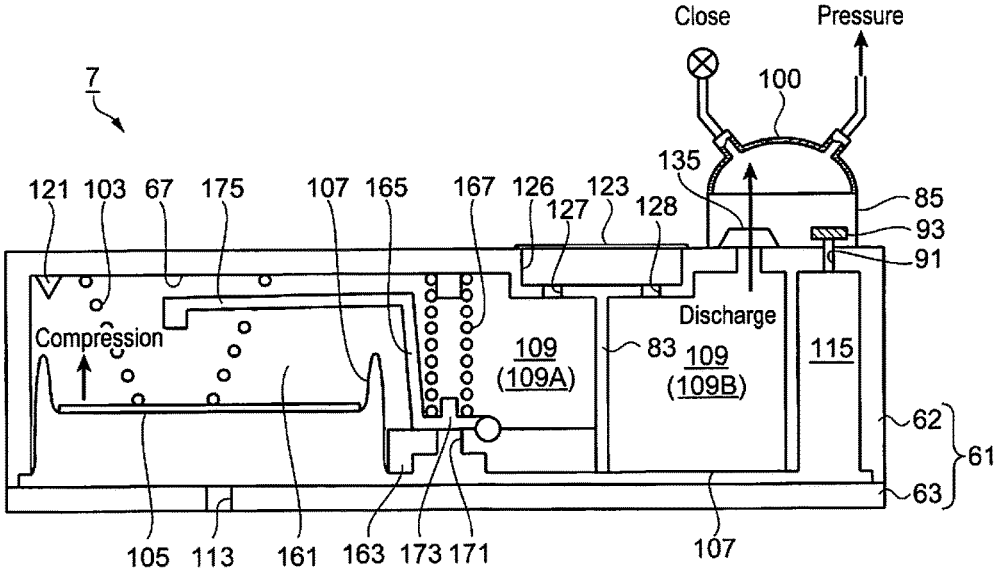
FIG. 36 is a cross section view typically showing the exhaust step with working example 14.

FIG. 36 shows an example of exhausting the substance inside the chamber 109 such as ink, air or the like, for example, by reducing the pressure of the chamber 109 from the supply port 85, and after that, filling the ink IK from the supply port 85 for working example 9. With working example 14, first, the communication hole 91 is closed using the plug 93 or the like so that air does not flow out from the communication hole 91. Next, the supply port 85 is covered by a pressure reduction filling device 100. In specific terms, the interior of the supply port 85 is made to be in an airtight state. In that state, the pressure is reduced for the chamber 109 via the supply port 85. In specific terms, as shown by the arrow in FIG. 36, the substance inside the chamber 109, such as ink, air or the like, for example, is exhausted to outside by suctioning. At this time, the capacity of the chamber 109 shrinks.

Figure 37:
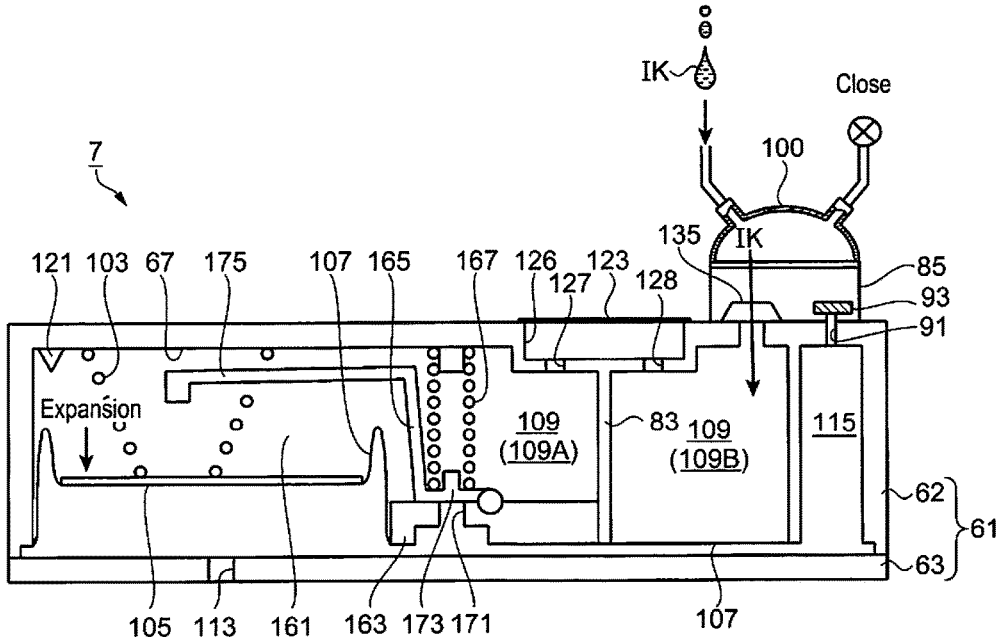
FIG. 37 is a cross section view typically showing the filling step with working example 14.

Next, using the pressure reduction filling device 100, ink is sent from the supply port 85 to the chamber 109. In specific terms, as shown by the arrow in FIG. 37, ink is sent to the supply port 85. Because the chamber 109 has had the pressure reduced and contracted, the difference between the pressure inside the chamber 109 and the atmospheric pressure outside the chamber 109 is large. Thus, the ink sent to the supply port 85 is drawn smoothly inside the chamber 109 by using the force generated by the pressure difference inside and outside the chamber 109.

With working example 14, by exhausting the substance inside the chamber 109 such as ink, air or the like before filling the ink IK, it is possible to manufacture a higher quality cartridge. Also, when filling the ink IK, by applying force that will draw the ink IK inside the chamber by reducing the pressure of the chamber 109, it is possible to shorten the time taken for filling. Also, with working example 14, it is possible to manufacture the cartridge more easily than with working example 10 or working example 11 because it is possible to implement the exhaust step and the filling step without opening a hole or scratching the cartridge. Furthermore, with working example 14, it is possible to continuously implement the exhaust step and the filling step using the same ink supply port 85, so it is possible to manufacture the cartridge with good efficiency.

Working Example 15

When filling the ink IK into the chamber 109 from the supply port 85, it is possible to use the negative pressure within the chamber 109. With the cartridge 7 of this embodiment, the sheet member 107 is biased by the coil spring 103 which is the biasing member in the direction for which the capacity of the chamber 109 expands. Thus, if in a state for which the capacity of the chamber 109 is shrunk to a certain degree, negative pressure will be generated inside the chamber 109. For example, if it is a cartridge directly after use, by the ink having been consumed, the chamber 109 is compressed. At this time, the air communication hole 113 is in a closed state, so air does not flow into the chamber 109 from the air communication hole 113. Also, as long as the filter 135 of the supply port 85 is wet by the ink, there is also no inflow of air to the chamber 109 from the supply port 85. Also, even if the filter 135 is dry and air flows into the chamber 109, by removing a portion of the case 61 or the like and pressing the chamber 109 from outside the sheet member 107, it is possible to compress the chamber 109. The same is also true when manufacturing a new cartridge.

In this way, with the cartridge 7 of this embodiment, it is possible to easily create a state for which negative pressure is generated inside the chamber 109. If in a state for which negative pressure is generated inside the chamber 109, as shown in FIG. 38, ink is drawn into the chamber 109 from the supply port simply by immersing the supply port 85 in the ink tank 95.

Figure 38:
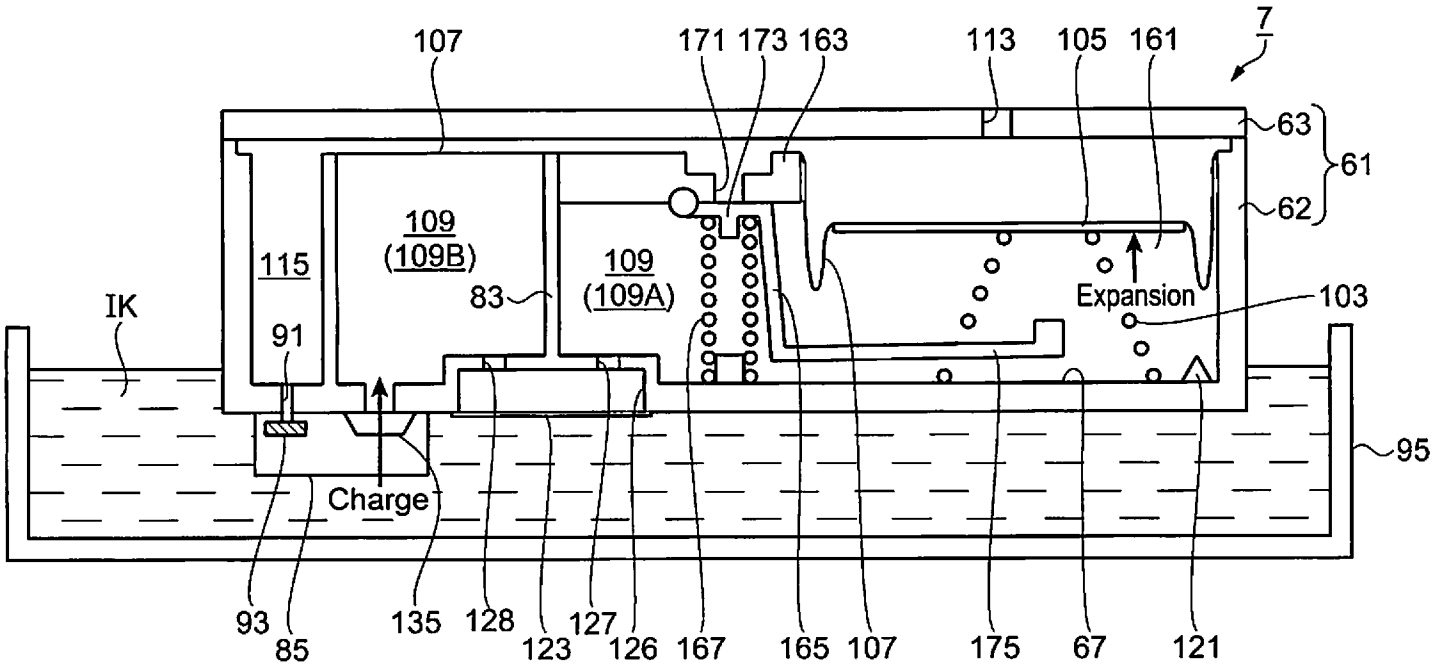
FIG. 38 is a cross section view typically showing the filling step with working example 15.

Specifically, as shown in FIG. 38, it is also possible to fill ink from the supply port 85 into the chamber 109 by immersing the supply port 85 of the cartridge in a state for which negative pressure is generated inside the chamber 109 in the ink tank 95, and using the negative pressure generated inside the chamber 109. By working in this way, it is possible to easily fill ink without performing the pressurization or pressure reduction like that described with working example 12 through working example 14.

Working Example 16

To give a force that shrinks and expands the chamber 109, it is also possible to use a reduced pressure atmosphere. With working example 16, we will describe an example of applying force that shrinks and expands the chamber by using a reduced pressure atmosphere in this way.

Figure 39:
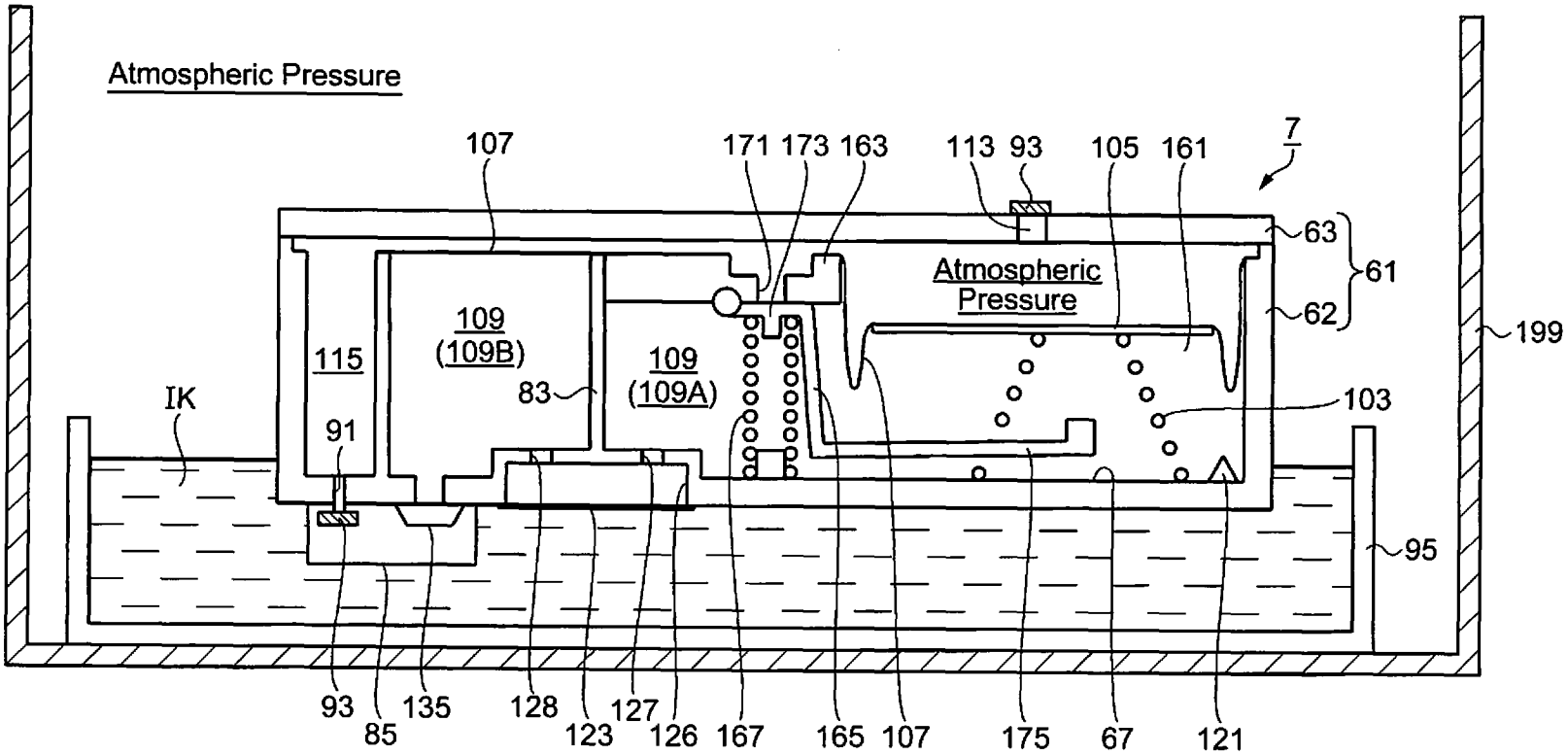
FIG. 39 is a cross section view typically showing the preparation step with working example 16.
Figure 40:
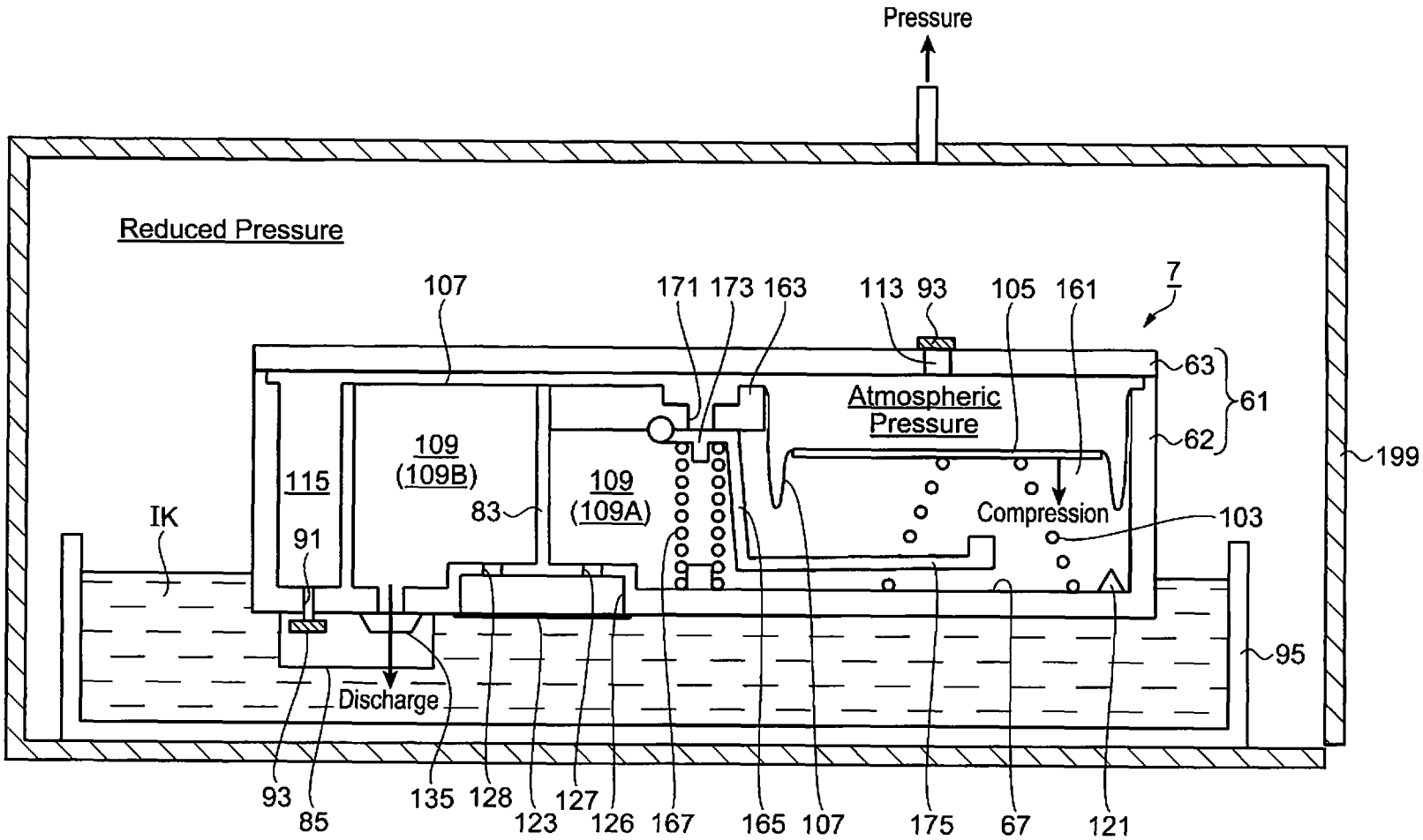
FIG. 40 is a cross section view typically showing the exhaust step with working example 16.

First, as shown in FIG. 39, the communication hole 91 and the air communication hole 113 are closed in an atmospheric pressure atmosphere. In other words, the air chamber 115 is made to be a tightly closed space. Then, the ink supply port 85 is immersed in the ink tank 95. Next, while kept in the state shown in FIG. 39, the cartridge is placed in a reduced pressure atmosphere. For example, as shown in FIG. 40, the communication hole 91 and the air communication hole 113 are closed, and after housing the cartridge in a pressure reduction container 199 in a state with the ink supply port 85 immersed in the ink tank 95, the pressure is reduced inside the pressure reduction container 199. The pressure reduction container 199 is a container having strength that can withstand a reduced pressure environment. At this time, because the air chamber 115 is tightly closed, this is kept as is at atmospheric pressure. Meanwhile, the chamber 109 communicates with the outside atmosphere through the ink supply port 85. Thus, the chamber 109 has the pressure reduced, and the substance inside the chamber 109, such as ink, air or the like for example, is exhausted to outside via the ink supply port 85.

Figure 41:
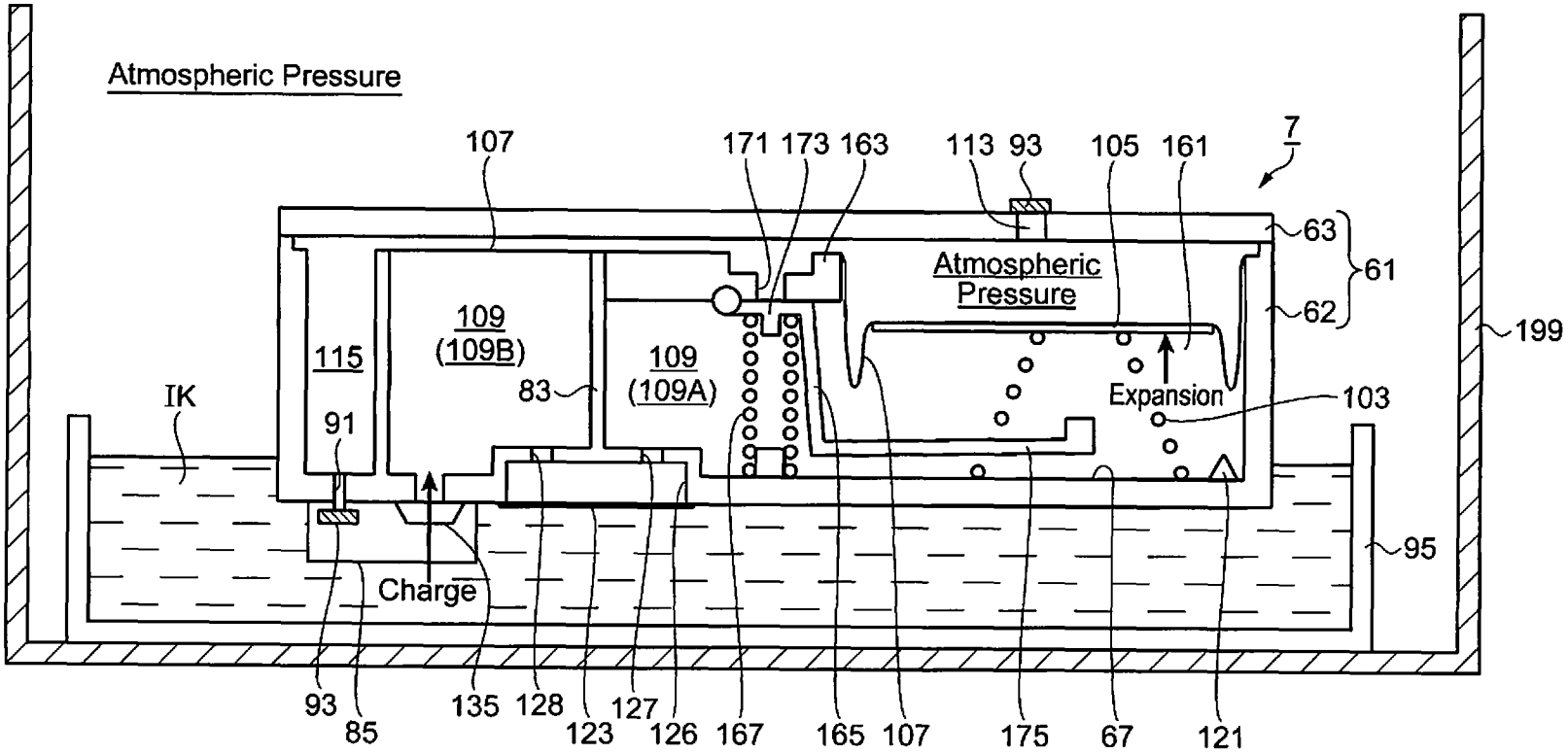
FIG. 41 is a cross section view typically showing the filling step with working example 16.

Finally, as shown in FIG. 41, keeping the state in FIG. 40 as is, the cartridge is returned to an atmospheric pressure atmosphere. With the step shown in FIG. 39, in contrast to the pressure being reduced and shrinking of the chamber 109, the air chamber 115 stays at atmospheric pressure. Thus, the difference between the pressure inside the chamber 109 and the atmospheric pressure of the air chamber 115 becomes large. The ink IK is drawn to inside the chamber 109 smoothly using the force that occurs by the chamber 109 internal and external pressure difference.

With working example 16, by exhausting the substance inside the chamber 109 such as ink, air or the like, for example, before filling the ink IK, it is possible to manufacture a higher quality cartridge. Also, when filling the ink IK, by having the pressure reduced for the chamber 109, a force that draws the ink IK inside the chamber 109 is generated, so it is possible to shorten the time it takes for filling. Also, with working example 16, it is possible to implement the exhaust step and the filling step without opening a hole or scratching the cartridge, so it is possible to manufacture the cartridge more easily than with working example 10 or working example 11. Furthermore, with working example 16, it is possible to continuously implement the exhaust step and the filling step using the same ink supply port 85, so it is possible to manufacture the cartridge with good efficiency.

Manufacturing Apparatus 1

Figure 42:
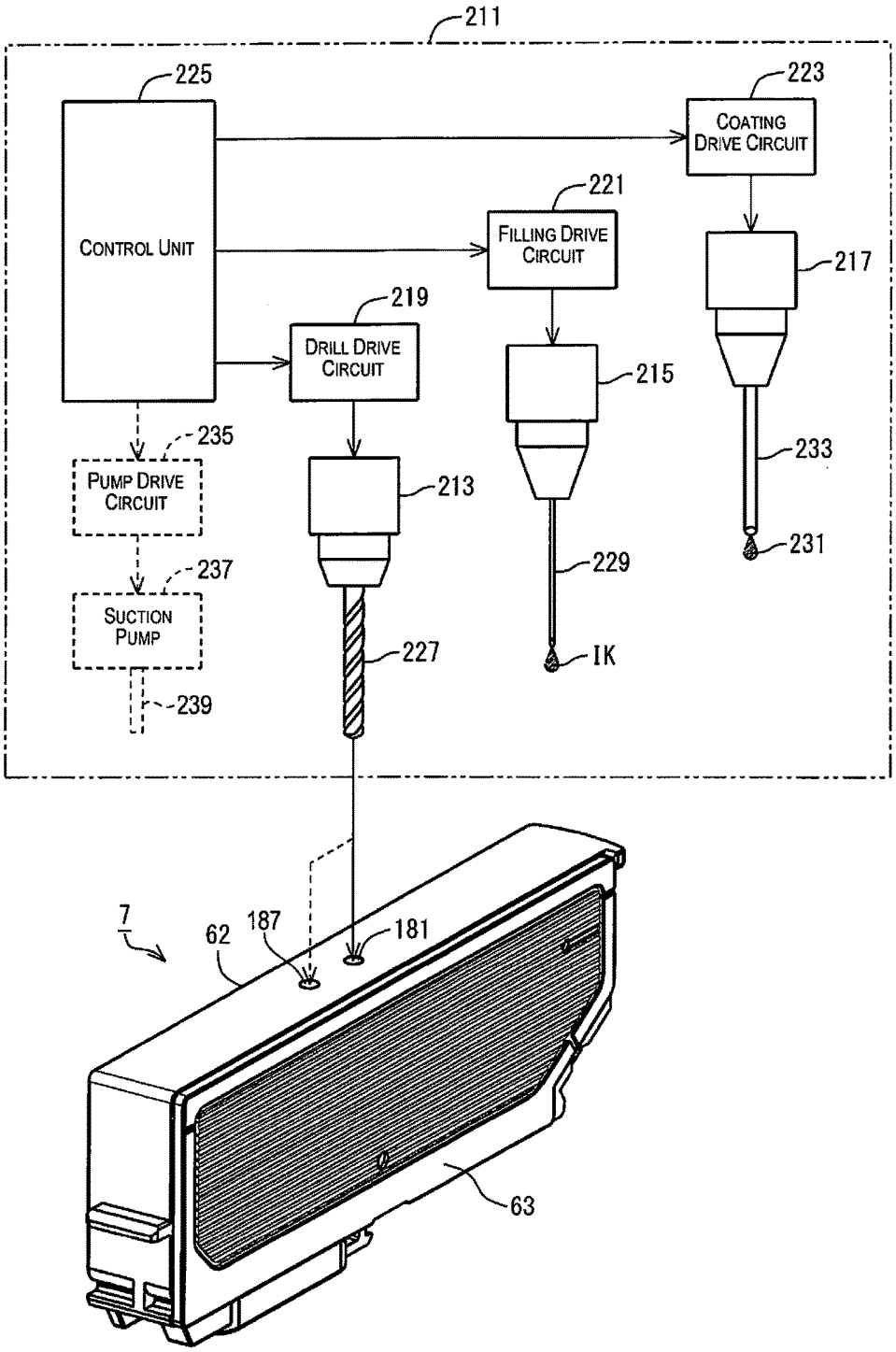
FIG. 42 is a drawing for explaining a first example of the cartridge manufacturing apparatus.

Next, we will describe an example of a manufacturing apparatus for the cartridge 7. As shown in FIG. 42, a first manufacturing apparatus 211 has a drill device 213, a filling device 215, a sealing member forming device 217, a drill drive circuit 219, a filling drive circuit 221, a coating drive circuit 223, and a control unit 225. This first manufacturing apparatus 211 can be applied to the cartridge manufacturing method described with working example 1 and working example 2.

The drill device 213 is a device for forming the filling port 181 on the first case 62 and the sheet member 107, and has a hole opening member 227. The drill device 213 forms the filling port 181 on the first case 62 and the sheet member 107 by rotationally driving the hole opening member 227. The drill drive circuit 219 controls driving of the drill device 213 based on instructions from the control unit 225.

The filling device 215 is a device for filling the ink IK from the filling port 181, and has a filling needle 229 as a filling member. The filling device 215 fills the ink IK inside the chamber 109 from the filling needle 229 inserted in the filling port 181. The filling drive circuit 221 controls driving of the filling device 215 based on instructions from the control unit 225.

The sealing member forming device 217 is a device for sealing the filling port 181, and coats a sealing material 231 for forming the sealing member 185 (FIG. 14 and FIG. 16) on the filling port 181. The sealing material 231 is in a liquid state. When the coated sealing material 231 solidifies, the sealing member 185 (FIG. 14 and FIG. 16) is formed, and the filling port 181 is sealed. The sealing member forming device 217 has a coating needle 233 for coating the sealing material 231. The coating drive circuit 223 controls driving of the sealing member forming device 217 based on instructions from the control unit 225.

With the first manufacturing apparatus 211, it is also possible to omit the drill device 213 and form the filling port 181 by directly pricking the filling needle 229 of the filling device 215 into the case 61. Specifically, it is possible to use the filling needle 229 as a hole opening member. Also, in this case, as described with working example 1 and working example 2 previously, by forming the sealing member 185 (FIG. 14 and FIG. 16) having a self-sealing function on the case 61 using the sealing material 231 before directly pricking the filling needle 229 in the case 61, if the filling needle 229 is removed after pricking the filling needle 229 in the sealing member 185 and filling the ink IK, it is possible to automatically seal the filling port 181 using the self-sealing function of the sealing member 185. In this way, if the sealing member 185 having a self-sealing function is used, when the filling needle 229 is removed, it is easy to prevent air flowing into the chamber 109 from the filling port 181.

Also, a rubber plug or the like is also possible as the sealing member 185 having a self-sealing function. In this case, instead of coating the sealing material 231, it is possible to seal the filling port 181 using the rubber plug.

When this first manufacturing apparatus 211 is applied to the cartridge manufacturing method described with working examples 3 through 6, means for forming the exhaust port 187, exhaust means for exhausting the substance inside the chamber 109 such as ink, air or the like for example, and means for sealing the exhaust port 187 are necessary. With working example 3 through working example 6, as shown by the dotted line in FIG. 42, the means for sealing the exhaust port 187 can be realized using the drill device 213. The means for sealing the exhaust port can be realized using the sealing member forming device 217. The exhaust means can be constituted using a pump drive circuit 235, a suction pump 237, and an exhaust path 239 that connects the exhaust port 187 (FIG. 17 to FIG. 20) and the suction pump 237 as shown by the dotted line in FIG. 42, for example.

At this time, it is also possible to omit the drill device 213, to constitute the exhaust path 239 with an item such as a needle, and to form the exhaust port 187 by directly pricking this in the case 61. Specifically, it is possible to use the exhaust path 239 as the hole opening member. Also, in this case, the same as with the filling port 181 described above, if the sealing member having the self-sealing function is used, it is easy to prevent inflow of air from the exhaust port 187 into the chamber 109.

Furthermore, when applying this first manufacturing apparatus 211 to the cartridge manufacturing method described with working example 7, means that puts the air introduction port 171 (FIG. 21 to FIG. 23) to an open state, and exhaust means for exhausting the substance inside the chamber 109 such as ink, air or the like, for example, are necessary. For example, by constituting the exhaust path 239 shown by dotted lines in FIG. 42 using an item such as a needle, and by directly pricking this in the case 61, it is possible to put the air introduction port 171 in an open state, and to connect the air introduction port 171 and the suction pump 237.

Furthermore, when applying this first manufacturing apparatus 211 to the cartridge manufacturing method described with working example 8, it is possible to use the exhaust path 239 to connect the suction pump 237 and the supply port 85 as the exhaust port.

To summarize the explanations above, the first manufacturing apparatus 211 for realizing the cartridge manufacturing method described with working example 1 and working example 2 is acceptable as long as it is equipped with a mechanism for forming the filling port 181, a mechanism for filling the ink IK, and a mechanism for sealing the filling port 181. Then, it is also possible to realize the mechanism for forming the filling port 181 and the mechanism for filling the ink IK using one means.

Also, the manufacturing method for realizing the cartridge manufacturing method described with working example 3 through working example 6 is acceptable as long as it is equipped with, in addition to the first manufacturing apparatus 211 noted above, a mechanism for forming the exhaust port 187, a mechanism for exhausting the substance inside the chamber 109, such as ink, air or the like, for example, and a mechanism for sealing the exhaust port 187. Also, the mechanism for forming the exhaust port 187 and the mechanism for exhausting the substance inside the chamber 109, such as ink, air or the like, for example, can be realized using one means.

Furthermore, the manufacturing apparatus for realizing the cartridge manufacturing method described with working example 7, in addition to the first manufacturing apparatus 211 noted above, is acceptable as long as it is equipped with a mechanism for putting the air introduction port 171 to an open state, and a mechanism for exhausting the substance inside the chamber 109 such as ink, air, or the like, for example. These mechanisms can be realized using a single means.

Furthermore, the manufacturing apparatus for realizing the cartridge manufacturing method described with working example 8, in addition to the first manufacturing apparatus 211 noted above, is acceptable as long as it is equipped with a mechanism for exhausting the substance inside the chamber 109 from the supply port 85, such as ink, air or the like, for example.

Forming of the filling port 181 or the exhaust port 187, filling of the ink IK, forming of the sealing member 185 and the like can also be performed by hand. For example, using a manufacturing kit with a hole opening member, a filling member, a sealing member and the like as a set, it is possible to manually perform formation of the filling port 181 or the exhaust port 187, filling of the ink IK, and formation of the sealing member 185. It is also possible to give the filling member the function of the hole opening member. Specifically, the cartridge manufacturing method described with working example 1 through working example 8 can be realized using a manufacturing kit which offers the tools corresponding to each of the mechanisms noted above as a set. This kind of manufacturing kit is also included in the manufacturing apparatus of the present invention.

Manufacturing Apparatus 2

Figure 43:
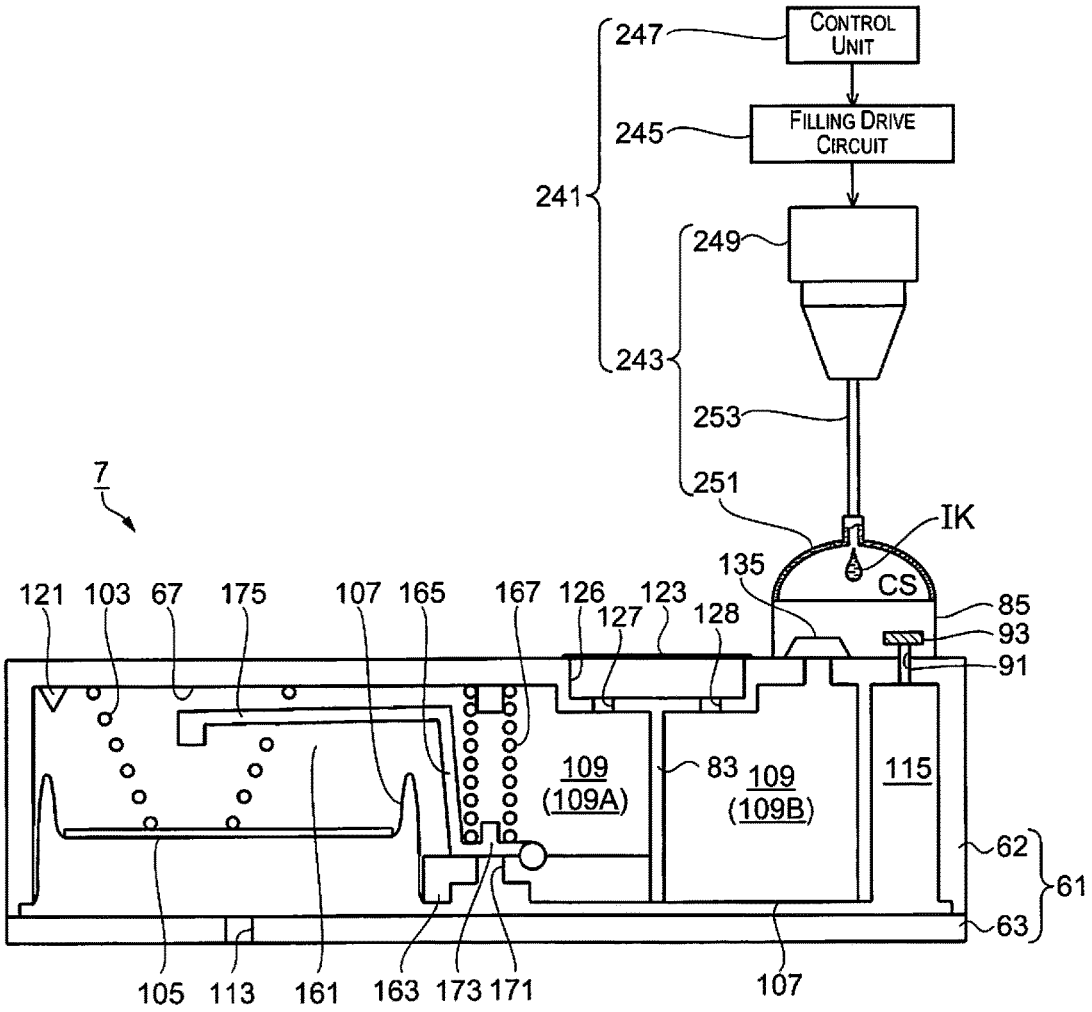
FIG. 43 is a drawing for explaining a second example of the cartridge manufacturing apparatus.

We will describe a second example of the manufacturing apparatus for the cartridge 7. The second manufacturing apparatus 241 has a filling device 243, a filling drive circuit 245, and a control unit 247 as shown in FIG. 43. The filling device 243 is a device for filling the ink IK from the supply port 85, and has an injector 249 as the filling member. Also, the filling device 243 has a cap 251, a tube 253, and a plug 255. The plug 255 closes the communication hole 91. The cap 251 covers the supply port 85 for each filter 135 from outside the cartridge 7. By the opening of the supply port 85 being closed by the cap 251, and the communication hole 81 being closed by the plug 255, the space inside the supply port 85 becomes closed space CS. The tube 253 connects this closed space CS with the injector 249. This second manufacturing apparatus 241 can be applied to the cartridge manufacturing method described with working example 9.

The ink IK discharged from the injector 249 is filled into the inside of the cap 251 via the tube 253. In other words, the injector 249 fills the ink IK to the supply port 85 with the cap 251 in between. The filling drive circuit 245 controls the driving of the injector 249 based on instructions from the control unit 247. The communication hole 91 is closed by the plug 255, so even when the ink IK is filled swiftly and overflows to outside the filter 135, it is possible to prevent infiltration to outside the chamber 109 from the communication hole 91. Also, because the space inside the supply port 85 is the closed space CS, even when the ink IK is filled swiftly and overflows to outside the filter 135, it is possible to prevent overflowing to outside the supply port 85.

When this second manufacturing apparatus 241 is applied to the cartridge manufacturing method described with working example 10, means for forming the exhaust port 187 (FIG. 27 and FIG. 28), exhaust means for exhausting the substance inside the chamber 109 such as ink, air or the like, for example, and means for sealing the exhaust port 187 are necessary. The means for forming the exhaust port 187 can be realized using the drill device 213 like that described with the first manufacturing apparatus 211 (FIG. 42). The means for sealing the exhaust port 187 can be realized using the sealing member forming device 217 described with the first manufacturing apparatus 211 (FIG. 42). The exhaust means can be constituted using the pump drive circuit 235, the suction pump 237, and the exhaust path 239 that connects the exhaust port 187 and the suction pump 237 like those described with the first manufacturing apparatus 211 (FIG. 42).

At this time, it is possible to omit the drill device 213, to constitute the exhaust path 239 with an item such as a needle, and by directly pricking this into the case 61, to form the exhaust port 187. Specifically, it is possible to use the exhaust path 239 as the hole opening member. Also, in this case, as described in relation to the first manufacturing apparatus, if the sealing member having the self-sealing function is used, it is possible to prevent the inflow of air from the exhaust port 187 into the chamber 109.

Furthermore, when this second manufacturing apparatus 241 is applied to the cartridge manufacturing method described with working example 11, means for making the air introduction port 171 (FIG. 29) to an open state, and exhaust means for exhausting the substance inside the chamber 109 such as ink, air or the like, for example, are necessary. For example, it is acceptable to have the air introduction port 171 in an open state and also to connect the air introduction port 171 and the suction pump 237 by constituting the exhaust path 239 shown by the dotted line in FIG. 42 using an item such as a needle and directly pricking this in the case 61.

To summarize the explanation above, the second manufacturing apparatus 241 for realizing the cartridge manufacturing method described with working example 9 is acceptable as long as it is equipped with a mechanism for supplying ink to the supply port 85. Also, this second manufacturing apparatus 241 is preferably equipped with a mechanism for making the space inside the supply port 85 the closed space CS to prevent ink from overflowing and flowing to outside from the supply port 85. Also, this second manufacturing apparatus 241 is preferably equipped with a mechanism for blocking the communication hole 91 in order to prevent ink from infiltrating from the communication hole 91 to outside the chamber 109.

Also, the second manufacturing apparatus 241 for realizing the cartridge manufacturing method described with working example 10 is acceptable as long as, in addition to the first manufacturing device 211 noted above, there are equipped a mechanism for forming the exhaust port 187, a mechanism for exhausting the substance inside the chamber 109 such as ink, air or the like, for example, and a mechanism for sealing the exhaust port 187. Also, the mechanism for forming the exhaust port 187 and the mechanism for exhausting the substance inside the chamber 109 such as ink, air or the like, for example, can be realized with one means.

Furthermore, the manufacturing apparatus for realizing the cartridge manufacturing method described with working example 11 is acceptable as long as, in addition to the second manufacturing apparatus 241 noted above, equipped are a mechanism for putting the air introduction port 171 in an open state, and a mechanism for exhausting the substance inside the chamber 109 such as ink, air or the like, for example. Also, these mechanisms can be realized with one means.

Figure 44:
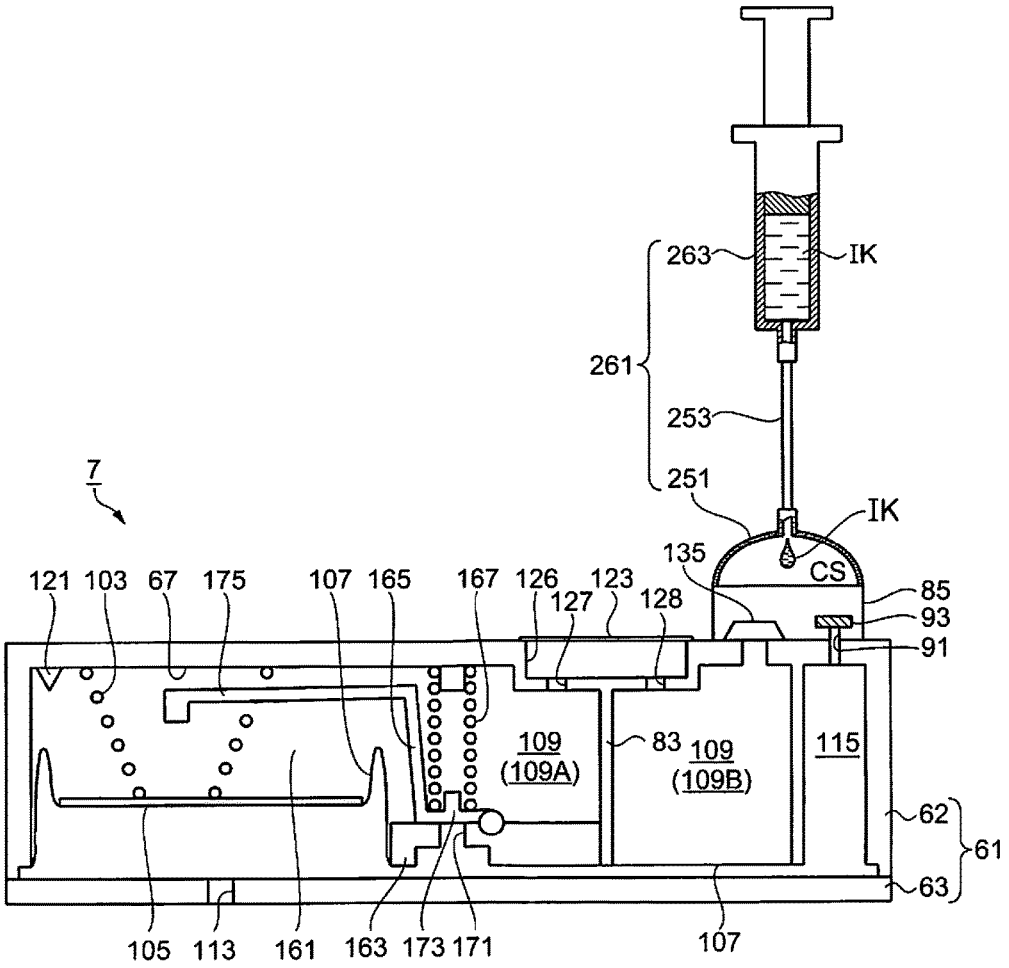
FIG. 44 is a drawing for explaining a second example of a cartridge manufacturing apparatus (manufacturing kit).

The cartridge manufacturing method described with working example 9 through working example 11 can be implemented by hand. For example, as shown in FIG. 44, to implement the cartridge manufacturing method described with working example 9, it is possible to use a manufacturing kit (manufacturing apparatus) having an injector 263, the cap 251, the tube 253, and the plug 255. The injector 263 is a tool for filling the ink IK from the supply port 85 into the chamber 109. FIG. 44 shows a syringe as an example of the injector 263. The cap 251 and the tube 253 are respectively the same as the constitution of the second manufacturing apparatus 241, so a detailed description is omitted.

In this way, the cartridge manufacturing method described with working example 9 through working example 11 can be realized using the manufacturing kit for which the tools corresponding to each of the mechanisms noted above are offered as a set. This kind of manufacturing kit is also included in the manufacturing apparatus of the present invention.

Manufacturing Apparatus 3

Figure 45:
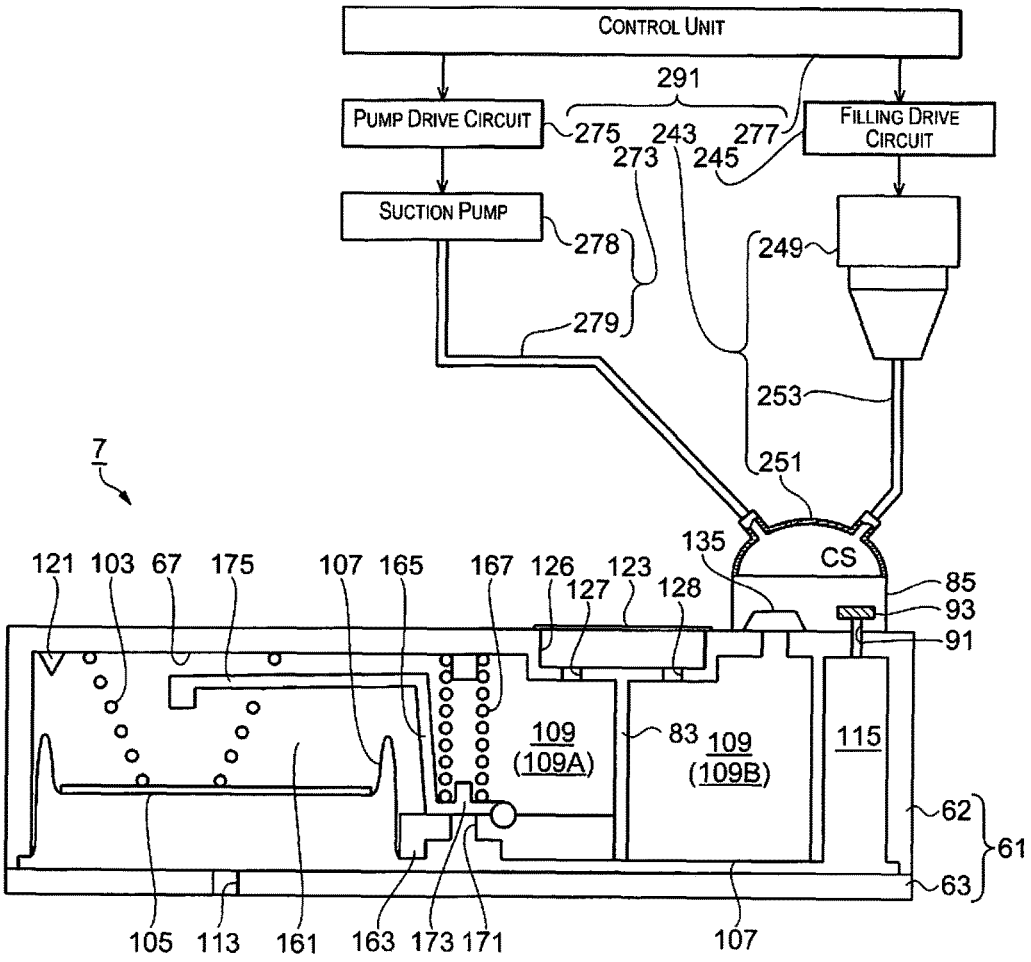
FIG. 45 is a drawing for explaining a third example of the cartridge manufacturing apparatus.

We will describe a third example of the manufacturing apparatus of the cartridge 7. As shown in FIG. 45, the third manufacturing apparatus 271 has a filling device 243, a filling drive circuit 245, a suction device 273, a pump drive circuit 275, and a control unit 277. The filling device 243 and the filling drive circuit 245 have the same constitution as the filling device 243 and the filling drive circuit 245 of the second manufacturing apparatus 241 (FIG. 43), so a detailed description is omitted. The suction device 273 has a suction pump 278 and a tube 279. The tube 279 is connected to the cap 251, and connects the cap 251 interior and the suction pump 278. The pump drive circuit 275 controls driving of the suction pump 278 based on instructions from the control unit 277. Also, the filling device 243 is equipped with the plug 255 that closes the communication hole 91. The cap 251 covers the supply port 85 from outside the cartridge 7 for each filter 135. By the opening of the supply port 85 being closed by the cap 251, and the communication hole being closed by the plug 255, the space inside the supply port 85 becomes the closed space CS. This third manufacturing apparatus 271 can be applied to the cartridge manufacturing method described with working example 14.

The control unit 277 first drives the suction pump 278 and suctions the closed space CS of the interior of the supply port 85. The communication hole 91 is closed by the plug 255, so the suction force of the suction pump 278 acts on the chamber 109, and the pressure is reduced inside the chamber 109. At this time, the substance inside the chamber 109 such as ink, air or the like, for example, can have at least a portion exhausted to outside the cartridge 7 from the supply port 85. After that, the control unit 277 drives the injector 249, and the ink IK is filled from the supply port 85 into the chamber 109. At this time, the communication hole 91 is closed by the plug 255, so even when the ink IK is filled swiftly and overflows to outside the filter 135, it is possible to prevent it from infiltrating outside the chamber 109 from the communication hole 91. Also, it is possible to prevent the ink IK that overflowed in this way from leaking out to the outside of the supply port 85.

The third manufacturing apparatus 271 for realizing the cartridge manufacturing method described with working example 14 is acceptable as long as it is equipped with a mechanism for exhausting the substance inside the chamber 109 such as ink, air or the like, for example, from the supply port, a mechanism for making the interior of the supply port 85 into the closed space CS, and a mechanism for supplying ink to the supply port 85.

Figure 46:
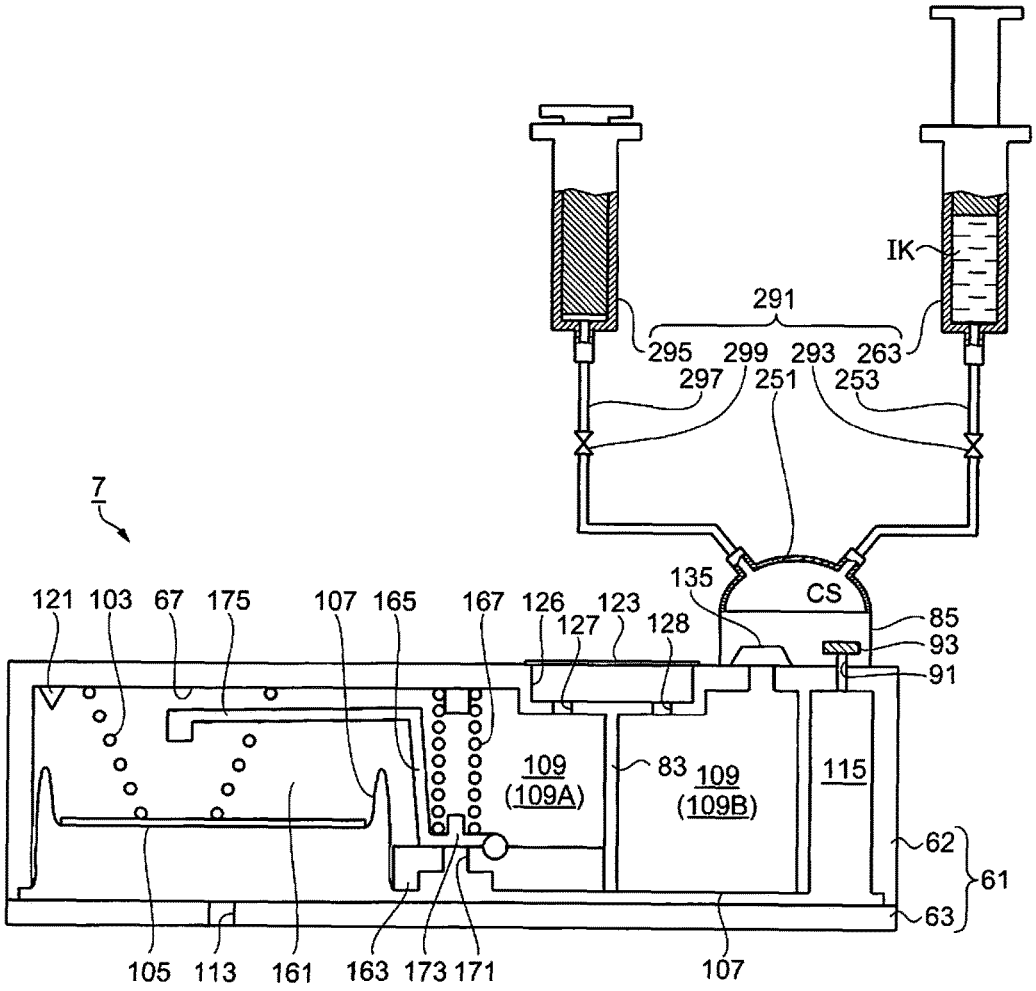
FIG. 46 is a drawing for explaining a fourth example of the cartridge manufacturing apparatus (manufacturing kit).

Furthermore, the manufacturing method of the cartridge 7 described with working example 14 can be realized using a manufacturing kit for which tools corresponding to each of the mechanisms noted above are offered as a set. For example, as shown in FIG. 46, this is acceptable as long as the manufacturing kit (manufacturing apparatus) 291 having the injector 263, the cap 251, the tube 253, a valve 293, a suction instrument 295, a tube 297, a valve 299, and the plug 255 is used. The injector 263, the cap 251, and the tube 253 respectively have the same constitution as the manufacturing kit 261 (FIG. 44) described previously, so a detailed description is omitted. The valve 293 is provided on the tube 253, and opens and closes the flow path between the injector 263 and the cap 251.

The suction instrument 295 is a tool that suctions the substance inside the chamber 109 such as ink, air or the like, for example, from the supply port 85. With FIG. 46, a syringe is shown as an example of the suction instrument 295. The tube 297 is connected to the cap 251, and connects the interior of the cap 251 and the suction instrument 295. The valve 299 is provided on the tube 297, and opens and closes the flow path between the suction instrument 295 and the cap 251. The suction instrument 295 exhausts the substance inside the chamber 109 such as ink, air or the like, for example, to outside the cartridge 7 by suctioning the closed space CS of the interior of the supply port 85.

The use method for this manufacturing kit 291 is as follows. First, the manufacturing kit 291 is attached to the cartridge 7 in a state such as that shown in FIG. 46. Then, by closing the valve 293, the flow path between the injector 263 and the cap 251 is closed. Also, by opening the valve 299, the flow path between the suction instrument 295 and the cap 251 is opened. Then, by suctioning the closed space CS inside the supply port 85 using the suction instrument 295, the substance inside the chamber 109 such as ink, air or the like, for example, is exhausted to outside the cartridge 7.

Next by closing the valve 299, the flow path between the suction instrument 295 and the cap 251 is closed. Also, by opening the valve 293, the flow path between the injector 263 and the cap 251 is opened. Then, using the injector 263, the ink IK is filled from the supply port 85 to inside the chamber 109.

In this way, the cartridge manufacturing method described with working example 14 can be realized using the manufacturing kit for which the tools corresponding to each of the mechanisms noted above are offered as a set. This kind of manufacturing kit is also included in the manufacturing apparatus of the present invention.

Other Manufacturing Apparatus

Above, we described manufacturing apparatuses 1 through 3 for realizing the manufacturing methods of working example 1 through working example 8, working example 9 through working example 11, and working example 14, but it goes without saying that it is possible to realize this as manufacturing apparatuses and manufacturing kits equipped with functions that can implement each step included in these methods for other working example methods as well.

Modification Example 1

With a number of working examples such as working example 2 and working example 4, we described a method of manufacturing the cartridge in a state without the second case 63, but it is also possible to implement the state without the second case 63 with the manufacturing method of working examples other than these (except for working example 12). If the exhaust step S20 and the filling step S30 are implemented in a state without the second case 63, it is easier to understand the situation of the chamber 109 at each step, such as the exhaust state of the substance inside the chamber 109 such as ink, air or the like, for example, the status of pressure reduction of the chamber 109, the filling status of the ink IK into the chamber 109 or the like. Also, if the exhaust step S20 and the filling step S30 are implemented in a state without the second case 63, it is easier to implement the various work for these steps. After implementing the exhaust step S20 and the filling step S30 in a state without the second case 63, joining the second case 63 and the first case 62 is not essential. Even in a state left without the second case 63, the function as the cartridge is not lost, so it is also acceptable to leave that status as is. Of course it is also possible to again join the removed second case 63 to the first case 62, and it is also possible to cover the opening of the first case 62 that was exposed by removing the second case 63 using a different part.

Modification Example 2

Also, with working example 3 through working example 6, these respectively had the filling port 181 and the exhaust port 187 formed separately, but it is also possible to give a function as the filling port 181 and the exhaust port 187 such as with using the supply port 85 with the working example 14 for both functions of the filling port and the exhaust port. In this case, the same as with working example 14, after the pressure is reduced for the chamber 109 via the filling port 181, ink is filled via the filling port 181.

Modification Example 3

The same as with modification example 2, with working example 7, it is possible to use the air introduction port 171 for both functions of the filling port and the exhaust port. In this case, the same as with working example 14, after the pressure is reduced for the chamber 109 via the air introduction port 171, ink is filled via the air introduction port 171.

Modification Example 4

With working examples 1 through 6 and working example 8, instead of forming the filling port 181, it is possible to use the air introduction port 171 as the filling port. In this case, instead of forming the filling port 181, the air introduction port 171 is opened with the method like that described with working example 7, and ink is filled from there.

Modification Example 5

The present invention is not limited to an inkjet printer and its ink cartridge, and can also be applied to any printing device that sprays other printing material other than ink as well as the cartridge thereof. For example, it can be applied to the following types of printing devices and their cartridges.

(1) Image recording devices such as facsimile devices or the like. (2) Printing devices that spray coloring material used for manufacturing color filters for image display devices such as liquid crystal displays or the like. (3) Printing devices for spraying electrode material used for forming electrodes such as of organic EL (Electro Luminescence) displays, field emission displays (FED) or the like. (4) Printing devices for spraying printing material containing bioorganic material used for biochip manufacturing. (5) A sample printing device as a precision pipette. (6) A lubricating oil printing device. (7) A resin liquid printing device. (8) A printing device for spraying lubricating oil in a pinpoint on precision machines such as watches, cameras or the like. (9) A printing device for spraying on a substrate a transparent resin liquid such as an ultraviolet curing resin or the like for forming a miniature hemispheric lens (optical lens) used for optical communication elements or the like. (10) A printing device for spraying an acid or alkaline etching fluid for etching a substrate or the like. (11) Any other printing device equipped with a print head for discharging tiny volume droplets.

The "droplets" means the state of a printing material discharged from the printing device and includes granular shapes, tear shapes, and threadlike shapes with a tail. Also, a "printing material" is acceptable as long as it is a material that can be sprayed by the printing device. For example, liquid state materials such as liquid state materials of high or low viscosity, as well as sol, gel water, other inorganic solvents, organic solvents, solutions, liquid resin, liquid metal (metal melt), and the like are included in "printing material." Also, this is not limited to liquids as one physical property state, but items for which particles of functional materials consisting of a solid such as a pigment, metal particles or the like are dissolved, dispersed, or blended in a solvent and the like are also included in "printing material." The "printing material" such as those noted above can also be expressed as "liquid" or "liquid body." Representative examples of liquid or liquid body printing materials include the kind of ink like that described with the embodiments noted above, liquid crystal and the like. Here, ink includes various types of liquid body compositions such as typical water based inks and oil based inks as well as gel inks, hot melt inks and the like.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

The invention claimed is:

1. A manufacturing method of a recycled cartridge comprising:

preparing a used cartridge having a case, a chamber adapted to be refilled with printing material, the chamber provided inside the case, a supply port that leads printing material inside the chamber to outside the case, a flexible sheet member constituting at least a portion of the chamber, a biasing member that biases the flexible sheet member in a direction that expands a capacity of the chamber, the biasing member provided inside the case, an air introduction port configured and arranged to introduce air from outside the chamber to inside the chamber, and a valve section that opens and closes the air introduction port;

forming a filling port in the case or the flexible sheet member by making a hole in the case or the flexible member, the filling port communicating with an inside of the chamber;

refilling the chamber with printing material from the filling port; and closing the filling port after refilling the chamber with the printing material from the filling port.

2. The manufacturing method of a recycled cartridge according to claim 1, further comprising exhausting at least a portion of a substance inside the chamber using the air introduction port before refilling the chamber with the printing material.

3. A manufacturing apparatus of a cartridge for implementing the manufacturing method according to claim 1, comprising:

a filling port forming member that forms the filling port, a filling member that refills the chamber with the printing material from the filling port, and a filling port sealing member that closes the filling port.

4. A manufacturing method of a recycled cartridge comprising:

preparing a used cartridge having a case, a chamber adapted to be refilled with printing material, the chamber provided inside the case, a supply port that leads printing material inside the chamber to outside the case, a flexible sheet member constituting at least a portion of the chamber, and a biasing member that biases the flexible sheet member in a direction that expands a capacity of the chamber, the biasing member provided inside the case;

forming a filling port in the case or the flexible sheet member by making a hole in the case or the flexible member, the filling port communicating with an inside of the chamber;

exhausting at least a portion of a substance inside the chamber using the filling port before refilling printing material;

thereafter refilling the chamber with the printing material from the filling port; and thereafter closing the filling port.

5. A manufacturing method of a recycled cartridge comprising:

preparing a used cartridge having a chamber adapted to be refilled with printing material, a flexible sheet member constituting at least a portion of the chamber, a case in which the chamber is provided, the case including a first case to which the flexible sheet member is joined and a second case attached to the first case so as to cover the flexible sheet member, a supply port that leads printing material inside the chamber to outside the case, and a biasing member that biases the flexible sheet member in a direction that expands a capacity of the chamber, the biasing member provided inside the case;

removing the second case;

forming a filling port in the case or the flexible sheet member by making a hole in the case or the flexible member, the filling port communicating with an inside of the chamber;

refilling the chamber with printing material from the filling port; and closing the filling port after refilling the chamber with the printing material from the filling port.

6. A manufacturing method of a recycled cartridge comprising preparing a used cartridge having a case, a chamber adapted to be refilled with printing material, the chamber provided inside the case, a supply port that leads printing material inside the chamber to outside the case, the supply port leading from an inside of the chamber to an outside of the case, a sheet member having flexibility and constituting at least a portion of a wall of the chamber, a biasing member that biases the sheet member in a direction that expands a capacity of the chamber, the biasing member provided inside the case, an air introduction port through which air is introduced from outside the chamber to inside the chamber, and a valve section that opens and closes the air introduction port: and refilling the chamber with printing material from the supply port in a state with the inside of the chamber in communication with the outside of the chamber while opening the air introduction port by applying an external force on the valve section.

7. The manufacturing method of a recycled cartridge according to claim 6, further comprising exhausting at least a portion of a substance inside the chamber using the air introduction port before refilling the chamber with the printing material.

8. The manufacturing method of a recycled cartridge according to claim 6, further comprising a step of removing at least a portion of the case.

9. The manufacturing method of a recycled cartridge according to claim 8, wherein the case includes a first case to which the sheet member is joined and a second case attached to the first case so as to cover the sheet member, and the step of removing at least a portion of the case is a step of removing the second case.

10. A manufacturing apparatus of a cartridge for implementing the manufacturing method according to claim 6, comprising:

an opening member that opens the air introduction port, and a filling member that refills the chamber with the printing material from the supply port.

11. A manufacturing method of a recycled cartridge comprising:

preparing a used cartridge having a case, a chamber adapted to be refilled with printing material, the chamber provided inside the case, a supply port that leads printing material inside the chamber to outside the case, the supply port leading from an inside of the chamber to an outside of the case, a sheet member having flexibility and constituting at least a portion of a wall of the chamber, and a biasing member that biases the sheet member in a direction that expands a capacity of the chamber, the biasing member provided inside the case;

opening an exhaust port on the chamber, the exhaust port leading from the inside of the chamber to the outside of the chamber;

refilling the chamber with printing material from the supply port in a state with the exhaust port open; and closing the exhaust port after refilling the chamber with the printing material.

12. The manufacturing method of a recycled cartridge according to claim 11, further comprising exhausting at least a portion of a substance inside the chamber to outside the case using the exhaust port before refilling the chamber with the printing material.

13. The manufacturing method of a recycled cartridge according to claim 11, further comprising a step of removing at least a portion of the case.

14. The manufacturing method of a recycled cartridge according to claim 13, wherein the case includes a first case to which the sheet member is joined and a second case attached to the first case so as to cover the sheet member, and the step of removing at least a portion of the case is a step of removing the second case.

15. A manufacturing apparatus of a. cartridge for implementing the manufacturing method according to claim 11, comprising:

an exhaust port forming member that forms the exhaust port, an exhaust port sealing member that closes the exhaust port, and a filling member that refills the chamber with the printing material from the supply port.

16. The manufacturing method of a recycled cartridge according to claim 11, wherein the supply port includes a foam which is a porous member and a filter which is a porous member, the filter being formed on the foam.

17. A manufacturing method of a recycled cartridge comprising:

preparing a used cartridge having a case, a chamber adapted to be refilled with printing material, the chamber provided inside the case, a supply port that leads printing material inside the chamber to outside the case, the supply port leading from an inside of the chamber to an outside of the case, a sheet member having flexibility and constituting at least a portion of a wall of the chamber, a biasing member that biases the sheet member in a direction that expands a capacity of the chamber, the biasing member provided inside the case, and an air chamber provided inside the case and outside the chamber, wherein the case has a first case to which the sheet member is joined, and a second case attached to the first case so as to cover the sheet member;

removing the second case;

forming an airtight space corresponding to the air chamber outside the chamber after removing the second case; and refilling the chamber with printing material from the supply port while reducing pressure of the airtight space.

18. The manufacturing method of a recycled cartridge according to claim 17, further comprising exhausting at least a portion of a substance inside the chamber to outside the case from the supply port by pressurizing the airtight space, before refilling the chamber with the printing material and after forming the airtight space corresponding to the air chamber on the outside of the chamber.

19. A manufacturing apparatus of a cartridge for implementing the manufacturing method according to claim 17, wherein an airtight space corresponding to the air chamber is formed on the outside of the chamber, and comprising a pressure addition and reduction device that increases and reduces pressure of the airtight space.

20. The manufacturing method of a recycled cartridge according to claim 17, wherein the supply port includes a foam which is a porous member and a filter which is a porous member, the filter being formed on the foam.

21. A manufacturing method of a recycled cartridge comprising:

preparing a used cartridge having a case, a chamber adapted to be refilled with printing material, the chamber provided inside the case, a supply port that leads printing material inside the chamber to outside the case, the supply port leading from an inside of the chamber to an outside of the case, a sheet member having flexibility and constituting at least a portion of a wall of the chamber, a biasing member that biases the sheet member in a direction that expands a capacity of the chamber, the biasing member provided inside the case, an air introduction port by which air from outside the chamber adapted to be introduced to inside the chamber, and a valve section that opens and closes the air introduction port; and refilling the chamber with printing material from the air introduction port in a state with the inside of the chamber in communication with the outside of the chamber while opening the air introduction port by applying an external force on the valve section.

22. The manufacturing method of a recycled cartridge according to claim 21, further comprising making an exhaust port that leads from inside the chamber to outside the chamber on the chamber before refilling the chamber with the printing material, wherein refilling the chamber with the printing material is performed in a state with the exhaust port open.

23. The manufacturing method of a recycled cartridge according to claim 22, further comprising exhausting at least a portion of a substance inside the chamber using the exhaust port before refilling the chamber with the printing material.

24. The manufacturing method of a recycled cartridge according to claim 20, further comprising exhausting at least a portion of a substance inside the chamber using the air introduction port before refilling the chamber with the printing material.

25. The manufacturing method of a recycled cartridge according to claim 21, further comprising exhausting at least a portion of a substance inside the chamber using the supply port before refilling the chamber with the printing material.

26. The manufacturing method of a recycled cartridge according to claim 21, further comprising a step of removing at least a portion of the case.

27. The manufacturing method of a recycled cartridge according to claim 26, wherein the case includes a first case to which the sheet member is joined and a second case attached to the first case so as to cover the sheet member, and the step of removing at least a portion of the case is a step of removing the second case.

28. A manufacturing apparatus of a cartridge for implementing the manufacturing method according to claim 21, comprising:

an opening member that opens the air introduction port, and a filling member that refills the chamber with the printing material from the air introduction port.

* * * * *